US011090533B2

(12) United States Patent
Ripp et al.

(10) Patent No.: US 11,090,533 B2
(45) Date of Patent: Aug. 17, 2021

(54) GOLF CLUB HEAD AND METHOD OF MANUFACTURING THE SAME

(71) Applicant: SUMITOMO RUBBER INDUSTRIES, LTD., Kobe (JP)

(72) Inventors: Patrick Ripp, Huntington Beach, CA (US); Dan S. Nivanh, Garden Grove, CA (US); Mika Becktor, New York, NY (US); Jesse D. Sukman, Long Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/521,804

(22) Filed: Jul. 25, 2019

(65) Prior Publication Data

US 2019/0381371 A1 Dec. 19, 2019

Related U.S. Application Data

(62) Division of application No. 15/431,004, filed on Feb. 13, 2017, now Pat. No. 10,406,409.

(51) Int. Cl.
*A63B 53/04* (2015.01)

(52) U.S. Cl.
CPC ..... *A63B 53/047* (2013.01); *A63B 53/04* (2013.01); *A63B 53/0408* (2020.08); *A63B 53/0416* (2020.08); *A63B 53/0445* (2020.08); *A63B 53/0475* (2013.01); *A63B 2209/00* (2013.01)

(58) Field of Classification Search
CPC ..... A63B 53/047; A63B 2053/0445; A63B 53/0475; A63B 2053/0408; A63B 2209/00; A63B 53/04; A63B 53/0408; A63B 53/0416; A63B 53/0445
USPC ..... 473/331
See application file for complete search history.

(56) References Cited

U.S. PATENT DOCUMENTS

| | | | | |
|---|---|---|---|---|
| 6,059,670 | A * | 5/2000 | Mogan | A63B 53/04 473/342 |
| 7,794,333 | B2 | 9/2010 | Wallans et al. | |
| 7,927,230 | B2 | 4/2011 | Solheim | |
| 2010/0113179 | A1* | 5/2010 | Solheim | B23P 11/025 473/331 |

(Continued)

OTHER PUBLICATIONS

Jan. 5, 2018 Office Action issued in U.S. Appl. No. 15/431,004.
Jul. 19, 2018 Office Action issued in U.S. Appl. No. 15/431,004.
Nov. 28, 2018 Office Action issued in U.S. Appl. No. 15/431,004.

*Primary Examiner* — Michael D Dennis
(74) *Attorney, Agent, or Firm* — Oliff PLC

(57) ABSTRACT

A method comprising, in a striking face of a golf club head, the striking face being formed of a first material having a first hardness, creating a plurality of initial grooves, the initial grooves having a first cross-sectional area ($A_1$) and a first pitch ($P_1$) such that $A_1/P_1>0.0030$ in. The method continues with modifying the initial grooves at least by positioning a second material in each of the plurality of initial grooves, the second material having a second hardness that is less than the first hardness, such that the first material and the second material form a plurality of final grooves each having a second cross-sectional area ($A_2$) and a second pitch ($P_2$) such that $A_2/P_2<0.0030$ in.

9 Claims, 34 Drawing Sheets

(56) References Cited

U.S. PATENT DOCUMENTS

| | | | | |
|---|---|---|---|---|
| 2011/0070963 | A1* | 3/2011 | Fedorochko | A63B 60/00 473/226 |
| 2013/0017898 | A1* | 1/2013 | Molinari | A63B 53/08 473/245 |
| 2013/0303303 | A1 | 11/2013 | Ban | |
| 2014/0274451 | A1* | 9/2014 | Knight | A63B 53/04 473/331 |

* cited by examiner

GOLF CLUB HEAD AND METHOD OF MANUFACTURING THE SAME

This application is a division of U.S. application Ser. No. 15/431,004, filed Feb. 13, 2017. The prior application, including the specification, drawings and abstract are incorporated herein by reference in its entirety.

BACKGROUND

Increasing the amount of backspin and improving feel during golf shots has long been a goal in golf club design. One of the most common ways to increase spin for golf clubs is through the use of scorelines. Scorelines have been applied to many different types of club heads. However, iron and wedge type golf clubs are the types of clubs where the scorelines are most valuable. As club designers have continually found ways to increase spin, the Unites States Golf Association (USGA), a regulatory body promulgating rules governing equipment used in officially-sanctioned Tour events, has imposed limits on the size, shape, characteristics, and dimensions of scorelines in order to provide a level playing field. In response, new and interesting ways of designing scorelines within the confines of the USGA rules have emerged in an effort to further increase the spin effects club heads or at a minimum maintain consistent levels of spin provided these sanctioned limitations. In addition, provided these regulations, attention has turned toward improving spin in other manners such as consistency/intended variability across the striking face of club heads and consistency across differing environmental and turf conditions. For example, different shapes, materials, and sizes of scorelines have been utilized. However, these efforts have fallen short. There remains a need for more effective construction, within the confines of the USGA rules, that can both appropriately manipulate spin and improve feel relying on processes and materials that are low cost and mass-efficient.

SUMMARY

The following presents a general summary of aspects of the disclosure in order to provide a basic understanding thereof. This summary is not an extensive overview of the disclosure. It is not intended to identify key or critical elements of the disclosure or to delineate the scope of the disclosure. The following summary merely presents some concepts of the disclosure in a general form as a prelude to the more detailed description provided below.

The present disclosure describes, in one implementation, a method comprising, in a striking face of a golf club head, the striking face being formed of a first material having a first hardness, creating a plurality of initial grooves, the initial grooves having a first cross-sectional area ($A_1$) and a first pitch ($P_1$) such that $A_1/P_1>0.0030$ in. The method continues with modifying the initial grooves at least by positioning a second material in each of the plurality of initial grooves, the second material having a second hardness that is less than the first hardness, such that the first material and the second material form a plurality of final grooves each having a second cross-sectional area ($A_2$) and a second pitch ($P_2$) such that $A_2/P_2<0.0030$ in.

In another implementation, the present disclosure includes a golf club head comprising a toe portion, a heel portion, a sole portion, a top portion, a rear portion and a striking face. The striking face is formed of a first material and includes a plurality of recesses each having a first pitch $P_1$ and a first cross-sectional area $A_1$ such that $A_1/P_1>0.0030$ in., the plurality of recesses each at least partially filled with a second material to form a plurality of open grooves each having a second pitch $P_2$ and a second cross-sectional area $A_2$ such that $A_2/P_2<0.0030$ in.

In yet another implementation of the present disclosure, there is provided a golf club head comprising a toe portion, a heel portion, a sole portion, a top portion, a rear portion, and a striking face. The striking face is formed of a first material and includes a plurality of recesses each having a first depth $D_1$ greater than 0.020 in., the plurality of recesses each at least partially filled with a second material to form a plurality of open grooves each having a second depth $D_2$ less than 0.020. A base of the open grooves is formed by the second material and edges of the open grooves where the open grooves meet the striking face are formed by the first material.

BRIEF DESCRIPTION OF THE DRAWINGS

The present disclosure is illustrated by way of example and not limited in the accompanying figures, in which like reference numerals indicate similar elements throughout, and in which.

DETAILED DESCRIPTION

In describing preferred embodiments of the subject matter of the present disclosure, as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

It should be noted that although the present disclosure is primarily directed toward iron-type and wedge-type golf clubs, the disclosure is not intended to be limiting to such implementations. As such, any type of golf club head in addition to those described may benefit from an implementation described in the present disclosure, including but not limited to driver-type, wood-type, hybrid-type, or putter-type golf clubs, for example.

It should further be noted that for the purposes of the present disclosure, the use of the term "scorelines," "final scorelines," and "final grooves" may be used interchangeably.

Figure 1A:
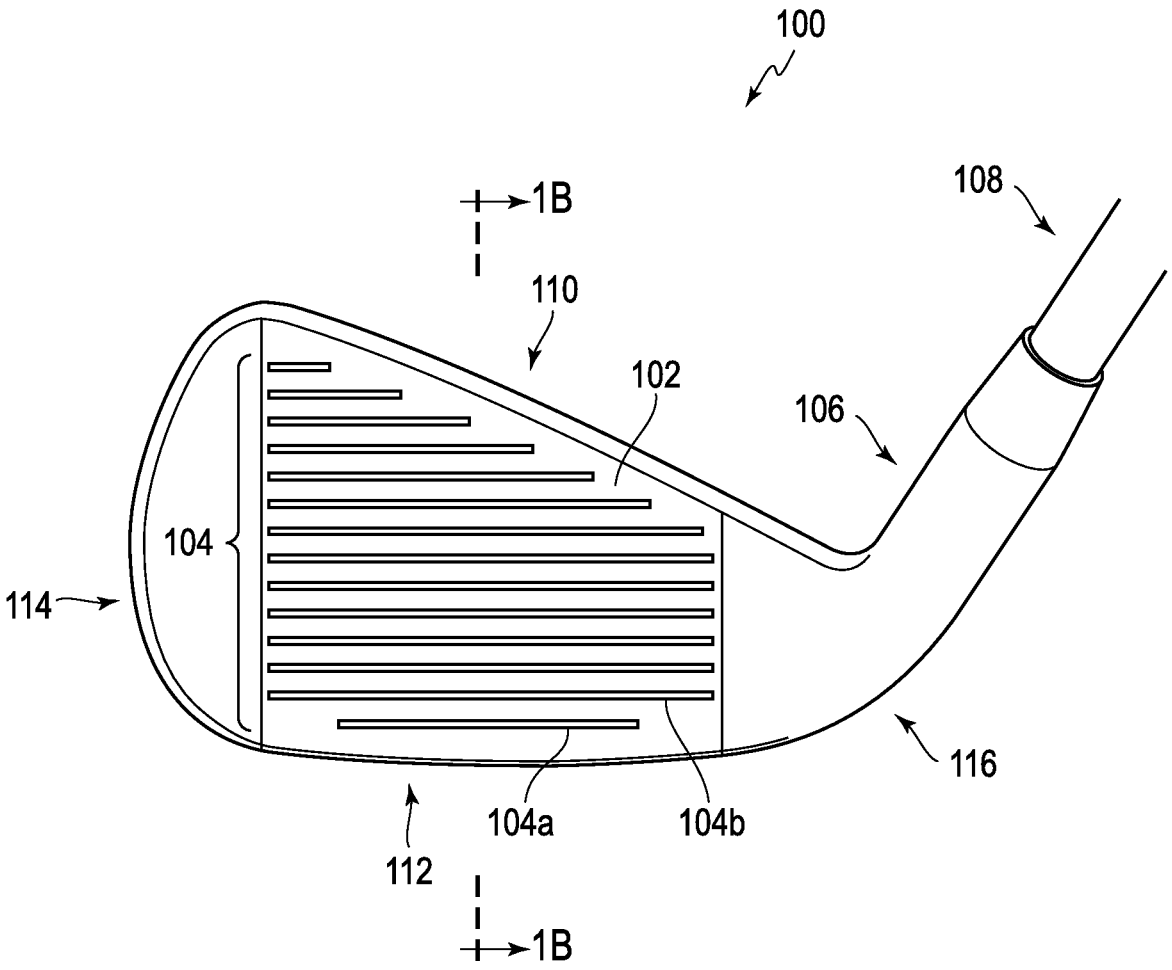
Fig. 1A Prior Art
FIG. 1A is a front elevation view of a prior art golf club head.

Now referring to FIG. 1A, FIG. 1A is a front elevation view of a prior art golf club head. Club head 100 of FIG. 1A includes striking face 102 which includes scorelines 104. The scorelines 104 include, for example, scoreline 104*a* and scoreline 104*b*. The club head 100 further includes a toe portion 114, a heel portion 116, a top portion 110, a rear portion (not shown) opposite the striking face 102, and a sole portion 112. The club head 100 further includes hosel 106 for securing the club head 100 to a shaft 108.

The scorelines 104 of the club head 100 extend parallel to each other between the toe portion 114 and the heel portion 116. In typical club heads, such as the club head 100, the striking face 102 comprises a unitary element of a single homogenouous metallic material, whereby the scorelines 104 are formed in the unitarily structured striking face 102, partially defining the striking face 102. For example, if the striking face 102 comprises a stainless steel, the scorelines are machined into the striking face 102, and thus comprise scoreline surfaces of the same stainless steel as the striking face 102.

Additionally, conventionally-accepted regulatory bodies govern the design of golf equipment (e.g. the USGA) including the shape and dimensions of scorelines. Thus, most scorelines have dimension and characteristics that fall within the confines of the USGA regulations. The USGA regulations on scoreline dimensions and characteristics are outlined in Appendix II, Section 5, of "Rules of Golf," published by the USGA. "Rules of Golf," The United States Golf Association, Effective Jan. 1, 2012, <http://www.usga.org/content/dam/usga/pdf/CompleteROG-book.pdf>, (hereinafter referred to as "Rules of Golf"). An explanation of the dimensions and characteristics of the scorelines as well as guidelines of taking measurements relating to scoreline dimensions and characteristics, especially the characteristics and dimensions referred to herein, may be found at pages 155-158 of the Rules of Golf.

Figure 1B:
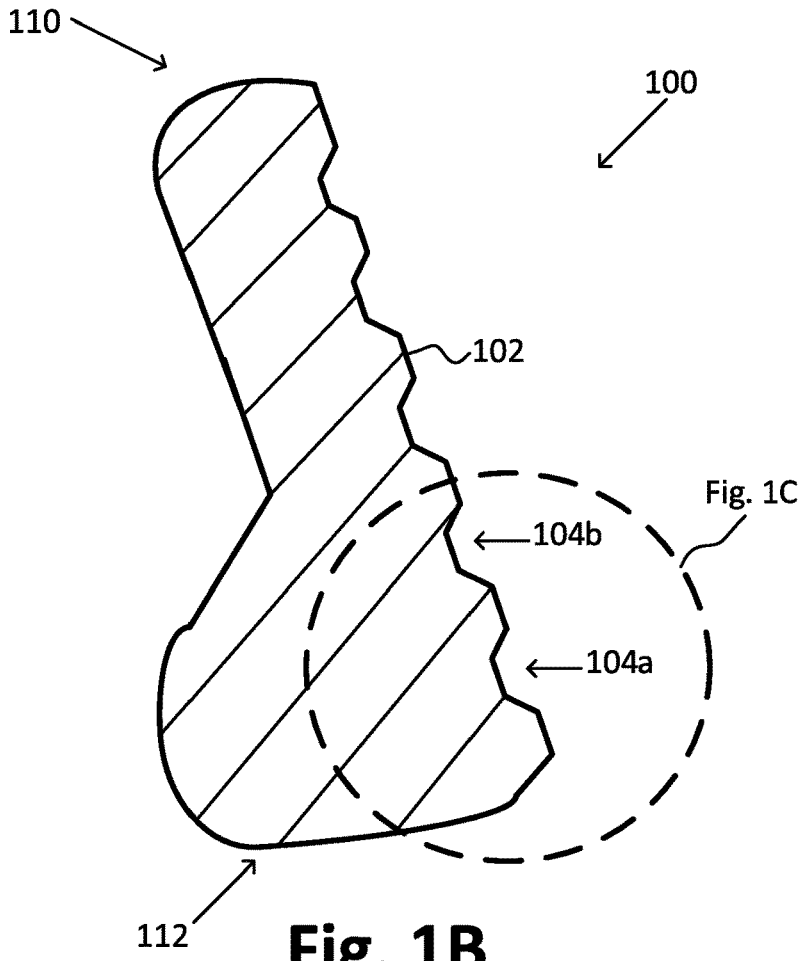
Fig. 1B (Prior Art)
FIG. 1B is a cross-sectional view of a portion of the golf club head of FIG. 1A.
Figure 1C:
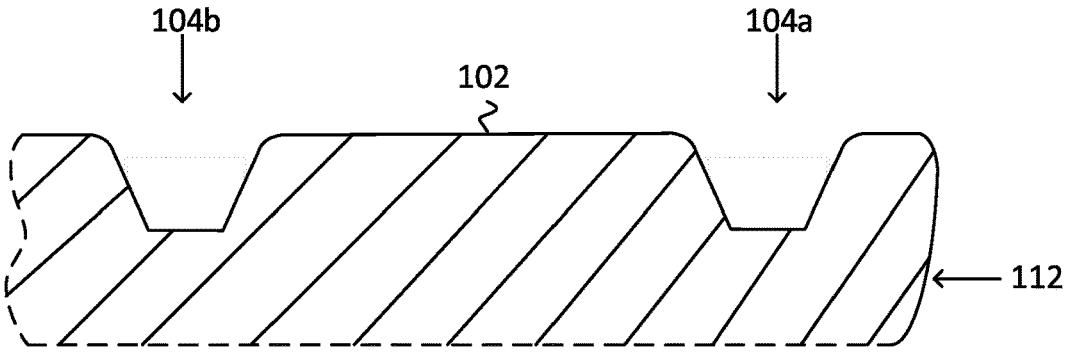
Fig. 1C (Prior Art)
FIG. 1C is an enlarged perspective view of a portion of the cross-section of the portion of the golf club head of FIG. 1B.

Now referring to FIG. 1B, FIG. 1B is a cross-sectional view of a portion of the golf club head of FIG. 1A. More specifically, FIG. 1B is a cross-sectional view of the club head 100 of FIG. 1A. The club head 100 includes the top portion 110, the sole portion 112, the striking face 102, and the scorelines 104, specifically the scorelines 104*a* and 104*b*. As can be seen from FIG. 1B, the striking face 102 comprises a unitary element of a single homogenouous metallic material, whereby the scorelines 104 are formed in the unitarily structured striking face 102, partially defining the striking face 102. Moreover, FIG. 1C, which illustrates an enlarged perspective view of a portion of the cross-section of the portion of the golf club head of FIG. 1B, provides an even more clear illustration of this concept.

Figure 2A:
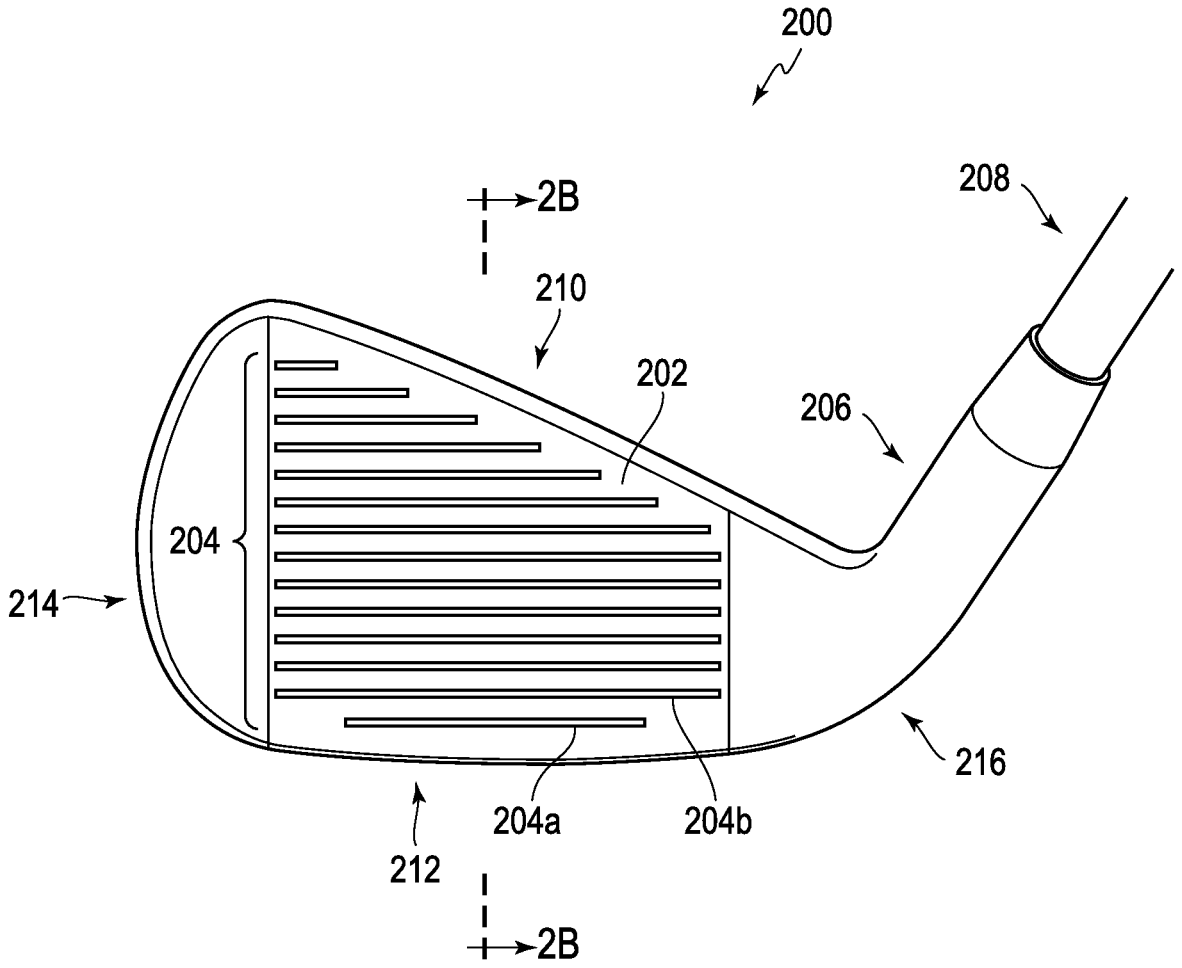
FIG. 2A is a front elevation view of a golf club head according to an implementation of the present disclosure.

Now referring to FIG. 2A, FIG. 2A is a front elevation view of a golf club head according to an implementation of the present disclosure. Club head 200 of FIG. 2A includes striking face 202 which includes scorelines 204. The scorelines 204 include, for example, scoreline 204*a* and scoreline 204*b*. The club head 200 further includes a toe portion 214, a heel portion 216, a top portion 210, a rear portion 217 (not shown) opposite the striking face 202, and a sole portion 212. The club head 200 further includes hosel 206 for securing the club head 200 to a shaft (not shown).

Figure 2B:
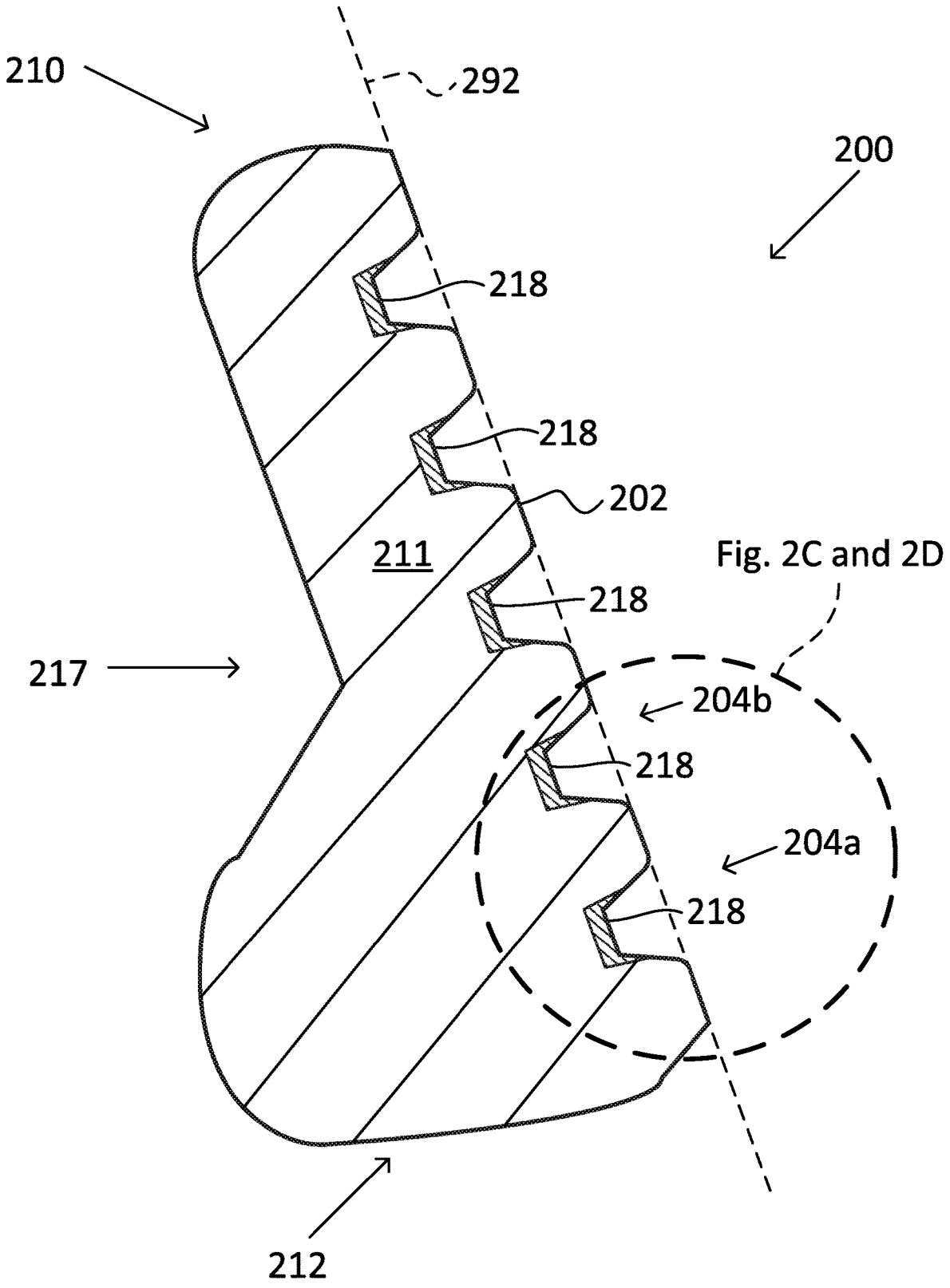
FIG. 2B is a cross-sectional view of a portion of the golf club head of FIG. 2A.

Now referring to FIG. 2B, FIG. 2B is a cross-sectional view of a portion of the golf club head of FIG. 2A. More specifically, FIG. 2B is a cross-sectional view of the club head 200 of FIG. 2A taken along plane 2B-2B. FIG. 2B includes the scorelines 204, which includes the scorelines 204*a* and 204*b*, the sole portion 212, the striking face 202, the rear portion 217 opposite the striking face 202, and the club head body 211. Each of the scorelines 204 includes resilient inserts 218. The striking face 202 defines a plane 292.

The club head body 211 may comprise any number of different materials including a metallic material, a composite material, a polymeric material, a carbon fiber material, or any other material suitable for use in the club head 200. In some implementations, the club head body 211 may be formed of the same material as the striking face 202, and at least part of the scorelines 204*a* and 204*b*. For example, if the club head body 211 is formed of a metallic material such as stainless steel, at least a portion of the sidewalls of the scorelines 204 in addition to the striking face may also be formed of the same metallic material.

The scorelines 204 may be machined into the striking face 202, by milling, drilling, or blasting, for example, or may be electroformed or cast during fabrication of the striking face 202. Various different manufacturing methods will be described below in more detail with reference to FIGS. 3A-5D.

Figure 2C:
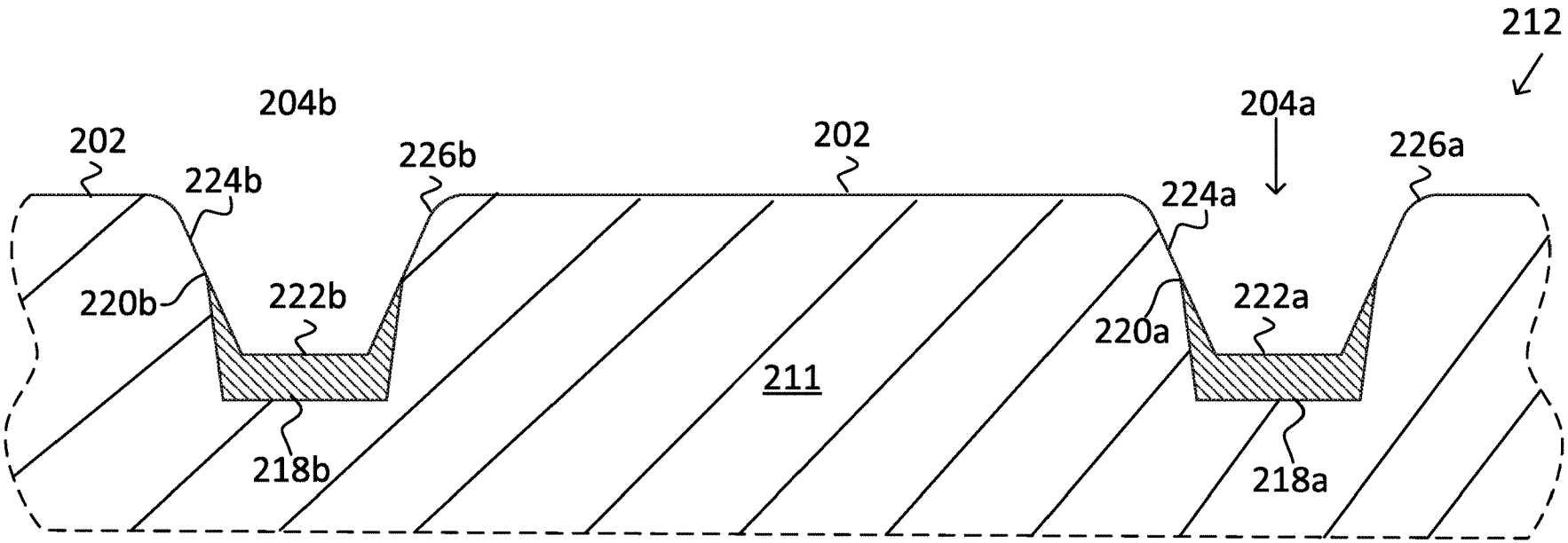
FIG. 2C is an enlarged perspective view of a portion of the cross-section of the portion of the golf club head of FIG. 2B.
Figure 2D:
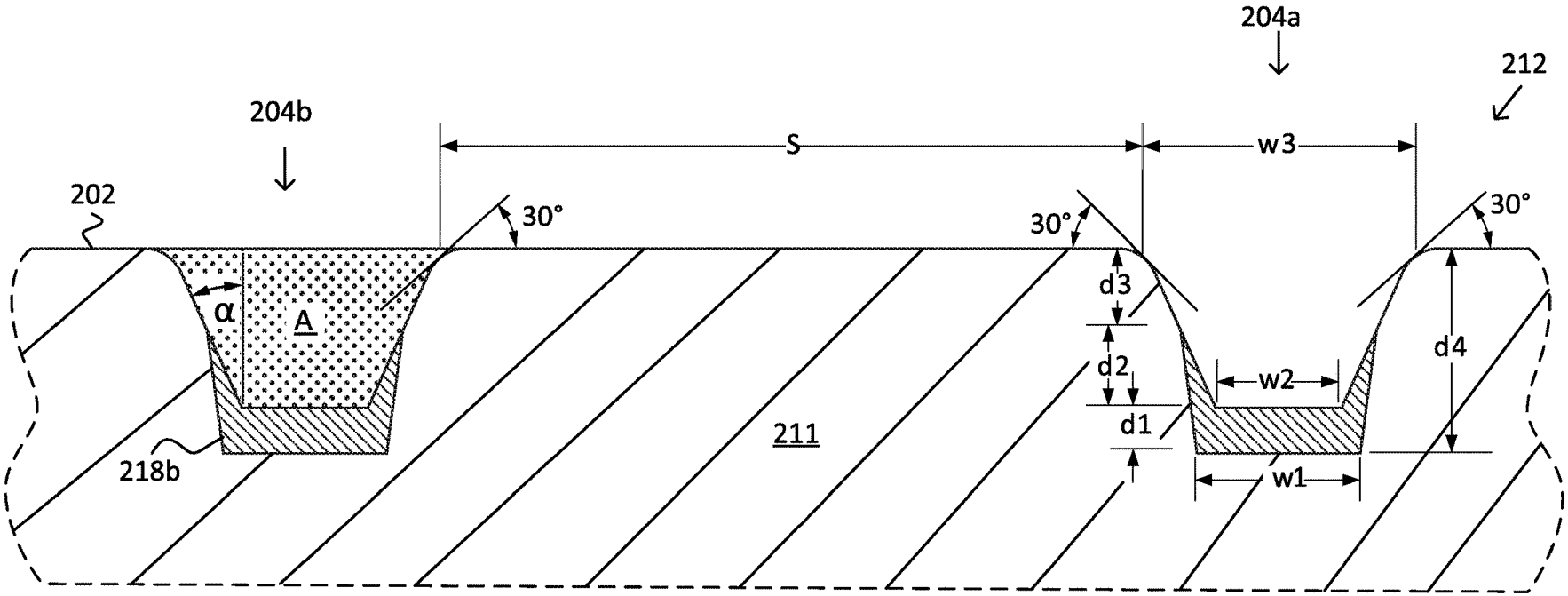
FIG. 2D is an identical enlarged perspective view as that of FIG. 2C.

Now referring to FIGS. 2C and 2D, FIGS. 2C and 2D include enlarged perspective views of a portion of the cross-section of the portion of the golf club head of FIG. 2B. More specifically, FIGS. 2C and 2D illustrate the same enlarged portion of the cross-section of FIG. 2B. FIGS. 2C and 2D include scoreline 204*a* which includes sidewall 224*a*, base 222*a*, transition portion 220*a*, and edge 226*a*. The scoreline 204*b* includes resilient insert 218*b*, sidewall 224*b*, base 222*b*, transition portion 220*b*, and edge 226*b*.

It should be noted that the scorelines 204 have symmetrical cross-sections. As a result, for example, the scoreline 204*a* includes a substantially mirrored sidewall opposite the sidewall 224*a*, a substantially mirrored edge opposite the edge 226*a*, and a substantially mirrored transition region opposite the transition region 220*a*. Each additional scoreline of the scorelines 204 on the striking face 202 from FIGS. 2A and 2B include similar structure. While such symmetrical structure is preferable, other configurations are also possible. For example, transition regions 220*a* and 220*b* may lie at different depths relative to the plane 292 of the striking face 202. Alternatively, or additionally, scorelines 204 may vary in depth, width, cross-sectional area, or other dimension, along its length and/or from scoreline to scoreline on the striking face 202, and/or between similarly positioned scorelines on progressively-lofted club heads in a same set of e.g. iron-type club heads.

The scorelines 224*a* and 224*b* include the resilient inserts 218*a* and 218*b*, respectively. The resilient inserts 218*a* and 218*b* (hereinafter referred to collectively as resilient inserts 218), may be located within the scorelines 204 by a variety of methods including pouring then milling, prefabricating and inserting, etc. Various different methods will be described in more detail below with respect to FIGS. 3A-5D. The resilient inserts 218 may comprise, for example, a polymer, a foam, a rubber, a rubber foam, a resin, or any other suitable material. For example, as explained below, the resilient inserts 218 may comprise a Surlyn material or a thermoplastic polyurethane (TPU). The resilient inserts 218 preferably have a durometer hardness of between 10 and 80 Shore D, more preferably between 30 and 75 Shore D, even more preferably between 50 and 70 Shore D, and most preferably about 66 Shore D. For most golfers, increased backspin and softer feel are commonly desired characteristics for higher lofted clubs (i.e., 46-64 degrees of loft), such as wedge type golf clubs, for example, while less backspin and a feel that is less soft than higher lofted clubs are commonly desired characteristics for lower lofted clubs (i.e., 20-45 degrees of loft), such as the lofts in a traditional set of iron type golf clubs, for example. As such, the resilient inserts 218 for golf clubs with a loft of 46-64 degrees preferably have a durometer hardness of less than 70 Shore D, more preferably between 20 and 70 Shore D, and even more preferably between 30 and 65 Shore D. The resilient inserts 218 for the golf clubs with a loft of 20-45 degrees preferably have a durometer hardness of greater than 40 Shore D, more preferably between 40 and 90 Shore D, and even more preferably between 50 and 80 Shore D.

The resilient inserts 218 form may also comprise a variety of colors. For example, each of the resilient inserts 218 may include an identical color. In some implementations, the color may be selected to create a contrast between the resilient inserts 218 and the surrounding materials, such as the metallic color of the striking face 202 and the scorelines 204, for example. An example of colors may be tour yellow, similar to that used on Srixon® balls, neon green, neon orange, or dark blue. By utilizing a color that creates a contrast, the scorelines 204 appear larger and are more visible, indicating to a golfer latent properties of the club head, including increased spin and a softer feel. However, in other implementations, the color of the resilient inserts 218 may be similar to that of the surrounding materials to provide a more traditional club head appearance. It should be noted that this choice of colors for the resilient inserts 218 applies to all resilient inserts in this disclosure, including those of club head 300, 400, 500, 600, 700, and 800.

The resilient inserts 218 form at least a portion of the scorelines 204. For example, the resilient insert 218*a* forms a portion of the sidewall 224*a* and the entire base 222*a* of the scoreline 204*a*. In FIG. 2B, the resilient insert 218*a* forms a lower portion of the sidewall 224*a* and extends until the transition region 220*a* where the resilient insert 218*a* ends and the upper portion of the sidewall 224*a*, which comprises the metallic material of the striking face 202, begins. As such, the scorelines 204 include at least two materials, a first material formed from the material of the striking face 202 and a second material from the resilient inserts 218.

The transition portions 220*a* and 220*b* (hereinafter collectively referred to as transition portions 220) form a smooth and consistent transition between resilient inserts 218 portion of the sidewalls 224 and the remaining upper portion of the sidewalls 224. The transition portions 220 may begin at any point on the sidewalls 224. For example, as will be described in greater detail below, the resilient inserts 218 may form 25% of the total height of the sidewalls 224 while the material of the striking face 202 may form the remaining 75% of the sidewalls 224.

It should be noted that this disclosure is not intended to limit the scorelines 204 to only two materials, and that any number of materials may be utilized for the scorelines 204. For example, with reference to the scoreline 204*a*, the base 222*a* may comprise a first material formed by the resilient insert 218*a*, a lower portion of the sidewall 224*a* may comprise a second material different than that of the first material formed by a second resilient insert (not shown), for example, and the upper portion of the sidewall 224*a* may include the material of the striking face 202. As a result, each of the scorelines 204 may have a tiered structure including several different materials in order to generate the desired spin on golf shots using the club head 200. In addition, different scorelines of the scorelines 204 may have different material compositions and/or properties dependent on where the scoreline is located in a top to sole direction, or dependent on which portion of the scoreline is being considered in a heel to toe direction. For example, the scorelines near the top portion 210, the toe portion 214, and the heel portion 216 of the striking face 202 may include a more resilient material for the resilient inserts 218 in order to reduce spin for mishit shots, while the scorelines near the center and sole portion 212 of the striking face 202 may include a less resilient material for the resilient inserts 218 in order to increase the spin for shots hit near a sweet spot of the striking face 202. Alternatively, or in addition, material properties and/or composition of like positioned scorelines 204 may vary between progressively-lofted club heads e.g. in a set of iron-type club heads. For example, materials of greater resilience may be applied to a higher lofted club head of a correlated set of iron-type club heads, where backspin may be a more desirable feature.

Now referring more specifically to FIG. 2C, FIG. 2C includes a variety of dimensions and characteristics for various features of the striking face 202 and the scorelines 204 of the club head 200.

The width w1 defines the width of the base of the initial grooves. The initial grooves will be described in more detail below with reference to at least features 330*a* and 330*b* of FIGS. 3B-3E and features 430*a* and 430*b* of FIGS. 4B-4D. The width w1 is preferably between 0.36 mm and 1.01 mm (0.014 inch and 0.040 inch), more preferably between 0.41 and 0.89 mm (0.016 inch and 0.035 inch), and most preferably between 0.46 mm and 0.61 mm (0.018 inch and 0.024 inch). The resilient inserts 318 form the base of the scorelines 204, so the width w1 of the base of the initial grooves is preferably equal to or greater than the width w2 of the base 222 of the scorelines 204. In addition, due to the sidewall geometry requirements in the Rules of Golf which state that the sidewalls 224 of the scorelines 204 cannot be converging, the width w1 is preferably equal to or less than the width w3 of the scorelines 204. The width w3 of the scorelines 204 is measured by using the 30 degree rule as outlined in the Rules of Golf and further discussed below. However, depending on the implementation of the present disclosure, the width w1 may be less than the width w2 and the width w3 may be less than the width w1. In such implementations, the overall design of the scorelines 204, including the resilient inserts 218, may be altered to ensure compliance with the scoreline dimension and characteristics outlined in the Rules of Golf.

The width w2 is defined as the width of the base 222 of the scorelines 204. The same rule on converging sidewalls 224 as outlined in the Rules of Golf described above makes it preferable for the width w2 of the base 222 of the scorelines 204 to be equal to or less than the width w3 of the scorelines 204. However, in addition, the width w2 is preferably also less than 0.89 mm (0.035 inch) to comply with groove geometry regulations outlined in the Rules of Golf. As such, the width w2 is preferably between 0.36 mm and 0.89 (0.014 and 0.035 inch), more preferably between 0.41 mm and 0.76 mm (0.016 inch and 0.030 inch), and most preferably between 0.46 mm and 0.61 mm (0.018 inch and 0.024 inch). This range of dimensions for the width w2 is preferable because the maximum width of the scorelines 204 at any point along the cross-section of the scorelines 204 conforms to the requirements outlined in the Rules of Golf while also enabling diverging sidewalls 224 which aid in producing greater spin at impact. In addition, this range of dimensions also takes into account the requirements on spacing between the scorelines 204 outlined in the Rules of Golf and creates a preferable ratio between scoreline 204 geometry and striking face 202 surface area creating preferable spin rates on the golf ball and preferable feel for the golfer at impact.

The distance d1 of the resilient inserts 218 is defined as the distance between the portion of the resilient inserts 218 that makes up the base 222 of the scorelines 204 and the base of the resilient insert 218 itself, which in the implementation of FIG. 2D is located at the base of the initial groove. The distance d1 and the material for the resilient inserts 218 factor into the deformation characteristics at impact with a golf ball. More specifically, the more deformation of the resilient inserts 218, especially compressive deformation, the greater the increase in overall responsiveness to interaction with moisture and debris at impact with a golf ball, thus generating increased spin rates and a softer feel at impact. As such, the distance d1 may differ based on a variety of factors including the material hardness and resiliency used in creating the resilient inserts 218 in combination with the desired spin rates imparted on the golf ball and the desired feel for the golfer at impact with the golf ball. As described above, increased backspin and softer feel are commonly desired characteristics for higher lofted clubs (i.e., 46-64 degrees of loft), such as wedge type golf clubs, for example, while less backspin and a feel that is less soft than higher lofted clubs are commonly desired characteristics for lower lofted clubs (i.e., 20-45 degrees of loft), such as the lofts in a traditional set of iron type golf clubs, for example.

Therefore, in order to create desired spin rates and feel across golf clubs of different lofts, adjustments to the resiliency of the material used for the resilient inserts 218 and adjustments to the distance d1 of the resilient inserts 218 may be made. In general, the distance d1 is preferably between 0.23 mm and 0.61 mm (0.009 inch and 0.025 inch), more preferably between 0.30 mm and 0.56 mm (0.012 inch and 0.022 inch), and most preferably between 0.36 mm and 0.51 mm (0.014 and 0.020 inch). In implementations where more spin is desired upon impact, the distance d1 may be at the higher end of the above cited ranges such that the resilient inserts 218 have more capability to deform. For example, in such implementations, the distance d1 is preferably between 0.38 and 0.61 mm (0.015 inch and 0.025 inch), more preferably between 0.51 and 0.61 mm (0.02 inch and 0.025 inch), and most preferably between about 0.53 and 0.58 mm (0.21 inch and 0.023 inch). However, in implementations where less spin is desired, the distance d1 may be at the lower end of the above cited ranges so that the resilient inserts 218 have less capability to deform. For example, in such implementations, the distance d1 is preferably between 0.21 mm and 0.38 mm (0.009 inch and 0.015 inch), more preferably between 0.25 mm and 0.36 mm (0.01 inch and 0.014 inch), and most preferably between 0.28 mm and 0.33 mm (0.011 inch and 0.013 inch).

In addition, the resiliency of the material of the resilient inserts 218 also factors into the distance d1. If the material of the resilient inserts 218 is a softer material, for example, the distance d1 may not need to be as large to create the same deformation as if the material was a harder material. In such an example, if the resilient inserts 218 have a durometer hardness of between 40 and 60 Shore D, the distance d1 is preferably between 0.38 mm and 0.53 mm (0.015 inch and 0.021 inch). If the material of the resilient inserts 218 is a harder material, for example, the distance d1 may need to be larger to create the required deformation than if the material was a softer material. For example, if the resilient inserts 218 have a durometer hardness of between 70 and 80 Shore D, the distance d1 is preferably between 0.51 mm and 0.61 mm (0.02 inch and 0.025 inch). The above mentioned ranges provide adequate durability of the resilient inserts 218 while also allowing for the necessary resiliency desired of the resilient inserts 218 to accomplish the above stated feel and spin desires of the golfer.

Additionally, the distance d1 may differ at different locations on the striking face 202 of the club head 200 depending on the desired spin and feel characteristics for each different location on the striking face 202. For example, the distance d1 may be less at locations on the striking face 202 where less spin is desired and greater at location on the striking face 202 where more spin is desired. Mishit shots often strike the toe side, heel side, sole side, or top-line side of the striking face 202, so it may be desirable to decrease the distance d1 at one or more of these locations on the striking face 202. At the same time, the resiliency of the material may be increased where mishit shots often occur to create a softer feel and remove some of the "sting" felt by the golfer on mishit shots. In implementations where the distance d1 differs at different locations within individual scorelines 204 or within different scorelines 204, the values for w1, w2, d2, d3, and w3 should stay consistent, and only the values of d1 and resultantly d4 should change. That is to say the initial grooves (described in more detail below with respect to FIGS. 3B-3E and 4B-4D) would be less deep but the cross-section of the scorelines 204 would remain consistent for each scoreline 204 on the striking face 202 in order to conform to the scoreline characteristics and dimensions outlined in the Rules of Golf.

As described above, the sidewalls 224 of the scorelines 204 may be formed of different materials. For example, the sidewalls 224 may be formed partially by the resilient inserts 218 and partially by the metallic material of the striking face 202. As such, the total elevation of the scorelines 204 is defined as the combination of the distance d2 of the resilient insert 218 portion of the sidewall 224 and the distance d3 of the metallic striking face 202 material portion of the sidewall 224. The distance d2 is defined as the distance from the base 222 of the scorelines 204 to the uppermost portion of the resilient inserts 218. The distance d3 is defined as the distance from the uppermost portion of the resilient inserts 218 to the plane 292 of the striking face 202. Keeping in mind that the Rules of Golf require that the total elevation of the sidewalls 224 is less than 0.51 mm (0.020 inch), the total elevation of the sidewalls (d2+d3) is preferably between 0.30 mm and 0.51 mm (0.012 inch and 0.020 inch), more preferably between 0.33 mm and 0.46 mm (0.013 inch and 0.018 inch), and most preferably between 0.36 mm and 0.43 mm (0.014 inch and 0.017 inch).

The determination of the individual distance d2 and d3 depends on the desired performance characteristics of the club head 200. For example, as described above, in some implementations more spin on the golf ball is desired. In such an implementation, the distance d2 of the resilient insert 218 portion of the sidewall 224 may be increased to provide an increased compressive deformation at impact as compared to the metallic material of the striking face 202 and the metallic material portion of the sidewalls 224. However, in implementations where less spin is desired, the distance d2 may be decreased to reduce the compressive deformation at impact. In addition to the deformation of the resilient inserts 218 for increasing spin, the material of the resilient inserts 218 may also factor into the spin created at impact. For example, the material of the resilient inserts 218 may have a higher static coefficient of friction than the material of the striking face 202, thereby imparting greater spin on the golf ball. As such, if an increase in spin is desired, the distance d2 of the resilient insert 218 portion of the sidewall 224 may be increased such that a larger portion of the sidewall 224 has this increased static coefficient of friction. In such an example, the increased friction of the resilient inserts 218 in addition to the compressive deformation characteristics of the resilient inserts 218 may work in concert to increase the desired spin of the golf ball at impact.

The distance d2 may comprise preferably between 10% and 75% of the total elevation of the sidewalls 224, more preferably between 20% and 65% of the total elevation of the sidewalls 224, and most preferably between 30% and 50% of the total height of the sidewalls 224. The above identified ranges allow for the scorelines 204 to remain durable over the life of the club head 200 while still providing the desired performance benefits at impact, e.g. spin rates and feel. For example, if the distance d2 were outside of the above specified ranges, the scorelines 204 may deform permanently after repeated impacts to a point where the static dimensions of the scorelines 204 were outside of the scoreline dimensions and characteristics outlined in the Rules of Golf. A result of the above specified ranges for the distance d2 is that the distance d3 of the striking face 202 metallic material portion of the sidewalls 224 is significantly large enough such that the shape and structure of the scorelines 204 is maintained over the life of the club head 200. The necessity for the upper portion of the sidewalls 224, defined by the distance d3, to be of appropriate dimension is that the initial impact with the golf ball is absorbed primarily by the striking face 202 and the upper portion of the sidewalls 224 of the scorelines 204.

It should be noted that in some implementations, the distance d2 of the resilient insert 218 portion of the sidewalls 224 may be equal to the entire height of the scoreline 204, or substantially the entire height of the scorelines 204. In such implementations, the distance d3 may be zero or a negligible value and the distance d2 may account for the entire elevation of the sidewalls 224. These implementations would be preferable for club heads that are not subject to impacts from full swings, but may be preferable for wedge type club heads having lofts greater than 50 degrees, for example, where increased spin is desired and less force is imparted on the scorelines 204 and the striking face 202 at impact.

Conversely, it should be noted that in some implementations, the distance d3 of striking face portion of the sidewalls 224 may account for the entire elevation of the scorelines 204, or substantially the entire elevation of the scorelines 204. In such implementations, the distance d2 may be zero or negligible. Implementations of this kind, for example, may be utilized where the club head 200 has lower lofts (e.g., less than 30 degrees) that are subject to repeated full swings, such as driving irons. In such implementations, the resilient inserts 218 may be located in the initial grooves such that the resilient inserts 218 form only the base 222 of the scorelines 204.

The distance d4 is defined as the total elevation of the intial grooves, i.e. the depth of the initial grooves. The distance d4 is a results directly from the desired dimensions of d1, d2, and d3. The distance d4 is preferably between 0.51 mm and 1.02 mm (0.02 inch and 0.04 inch), more preferably between 0.64 mm and 0.91 mm (0.025 inch and 0.036 inch) and most preferably between 0.71 mm and 0.86 mm (0.028 inch and 0.034).

The draft angle $\alpha$ is defined as the angle between the sidewalls 224 and an imaginary vertical line extending perpendicular to the plane 292 of the striking face. The Rules of Golf require that the ratio of the cross sectional area A of the scorelines 204 to the pitch P (w3+S) must be less than 0.76 $mm^2$(0030 $in^2$). In addition, the draft angle $\alpha$ must be 0 degrees or greater in order to conform to the Rules of Golf requirement that the sidewalls 224 cannot converge. The angle $\alpha$ is preferably between 0 degrees and 35 degrees, more preferably between 10 degrees and 25 degrees, and most preferably between 14 degrees and 19 degrees. These cited ranges for the draft angle $\alpha$ enable desired cross-sectional areas A of the scorelines 204 while reducing the pitch P (w3+S) of the scorelines 204 while maintaining conformance to the Rules of Golf. In addition, including an angle greater than 0 degrees enables more surface area of the sidewalls 224 of the scorelines 204 to contact the golf ball at impact, ultimately creating more spin.

Each sidewall 224 has two edges 226 that each include an effective radius r, and each of the edges 226 are substantially in the form of a round, as defined in the Rules of Golf. In addition, the effective radius r of the edges 226 of the scorelines 204 is measured in conformance with the definition outlined at page 157 of the Rules of Golf. To summarize the Rules of Golf, the effective radius must be greater than 0.25 mm (0.010 inch) and less than 0.51 mm (0.020 inch), with a 0.025 mm (0.001 inch) deviation being permissible. With that in mind, only club heads having a loft angle greater than or equal to 25 degrees are subject to the effective radius standards outlined in the Rules of Golf.

From a design standpoint, increasing effective radius r often results in increasing the width w3 of the scorelines 204, as explained in more detail below. This may negatively impact a designer's ability to create scorelines 204 having an increased width between the edges 226 and the base 222 of the scorelines 204. Thus, the effective radius r of the scorelines 204 is preferably between 0.23 mm and 0.53 mm (0.009 inch and 0.021 inch), more preferably between 0.23 mm and 0.38 mm (0.009 inch and 0.015 inch), and most preferably between 0.23 mm and 0.28 mm (0.009 inch and 0.011 inch). In some implementations, it is preferable to design the edges 226 to have an effective radius r as close to 0.25 mm (0.010 inch) as possible in order to create the sharpest edges 226 thereby increasing the amount of spin imparted on the golf ball at impact. However, if a particular club head 200 is intended to impart less spin on the golf ball at impact, the effective radius r may be increased toward the 0.51 mm (0.020 inch) limit.

The scorelines 204 have a width w3 that is defined in conformance to the 30 degree method outlined in the Rules of Golf and on file with the USGA. The width w3 is based on the width w2, the draft angle $\alpha$, and the effective radius r of the edges 226. The width w3 of the scorelines 204 cannot exceed 0.89 mm (0.035 inch) based on the Rules of Golf requirements. As such, the width w3 is preferably between 0.51 mm and 0.89 mm (0.02 inch and 0.035 inch), more preferably between 0.56 mm and 0.86 mm (0.022 inch and 0.034 inch), and most preferably between and 0.64 mm and 0.79 mm (0.025 inch and 0.031 inch). The above cited ranges are determined based on of the desire to create scorelines 204 that achieve a preferred cross-sectional area A to pitch P ratio. Moreover, there may be a desire to include as many scorelines 204 of maximum cross-sectional area as possible on the striking face 202, and because the Rules of Golf require that the distance S between edges of adjacent scorelines 204, as outlined in the Rules of Golf, be greater than three times that of the width w3 of the scorelines 204, it is necessary to dimension the width w3 such that the distance S is not unnecessarily large. By dimensioning the width w3 and the distance S such that an advantageous cross-sectional area A to pitch P ratio is achieved, greater amounts of spin can be imparted on the golf ball across a range of turf conditions.

The striking face 202 includes a distance S which defines the distance between edges 226 of adjacent scorelines 204 on the striking face 202. The distance S factors into the overall pitch P of the scorelines 204 on the striking face 202. The Rules of Golf require that the distance S is greater than three times the width w3 of the scorelines 204 and is at least 0.075 inches. Due to the desire to create larger cross-sectional areas A of the scorelines 204 in some implementations, which may necessitate increased w3 values, and because the value of the distance S is at least partially determined based on the w3 values based on the Rules of Golf, it is not always desirable to have the distance S be at the minimum 1.91 mm (0.075 inch). Preferably, the distance S is between 1.91 mm and 2.80 mm (0.075 inch and 0.110 inch), more preferably between 2.03 mm and 2.54 mm (0.080 inch and 0.100 inch), and most preferably between 2.26 and 2.46 mm (0.089 inches and 0.097 inches).

The scorelines 204 include a cross-sectional area A defined as the area delimited by the plane 292 of the striking face, the sidewalls 224, and the base 222 of the scorelines 204, as illustrated in scoreline 204*b* of FIG. 2D. The scorelines 204 are designed such that the cross-sectional area A of the scorelines 204 is as large as necessary to create the desired spin conditions for the golf club while still conforming to the scoreline dimension requirements of the Rules of Golf. The Rules of Golf require that the A/P ratio is less than 0.076 $mm^2$ (0.0030 $in^2$), where A is the cross-sectional area of the scorelines 204 and P (w3+S) is the pitch of the scorelines 204 on the striking face 202. By maximizing the ratio of A/P, the desired spin imparted on the golf ball at impact in addition to the desired feel experience by the golfer at impact can be achieved. As such, it is desirable to create an A/P ratio that is close to 0.076 $mm^2$ (0.0030 $in^2$). In some implementations, reaching the 0.076 $mm^2$ (0.0030 $in^2$) threshold may be accomplished by maximizing the cross-section area A, while other implementations may minimize the pitch P. For example, if a golf club is to be used in wet conditions with lots of debris, maximizing the cross-sectional area A may be preferable over minimizing pitch P. However, in dry conditions, where debris is less likely to affect a golf shot, it may be desirable to minimize the cross-sectional area A while also minimizing the pitch P to increase the overall number of scorelines 204 on the striking face 202. However, in either example, maximizing the ratio of A/P is preferable.

Figure 3A:
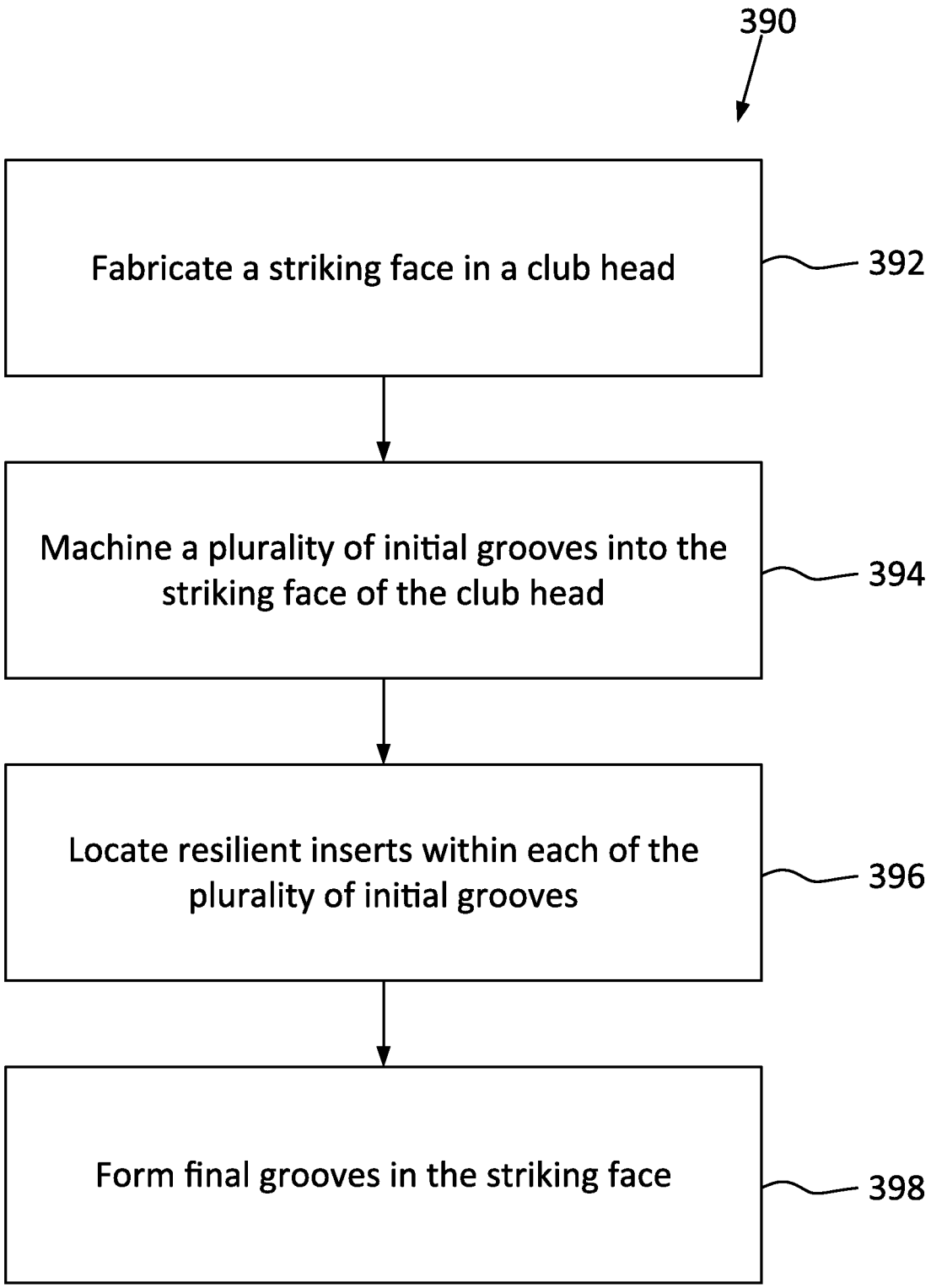
FIG. 3A is a flowchart exemplifying a process of manufacturing scorelines for a golf club head according to an implementation of the present disclosure.
Figure 3B:
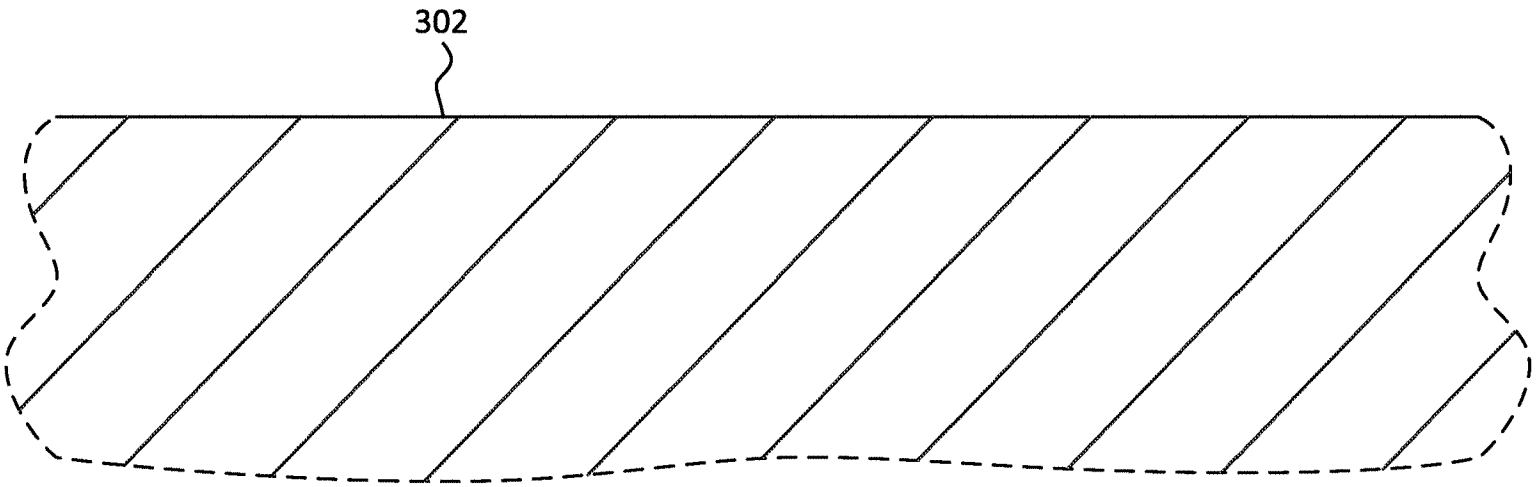
FIG. 3B is a cross-sectional view of a portion of an intermediate club head body corresponding to a step in the flowchart of FIG. 3A for manufacturing the scorelines for a golf club head.

Now referring to FIG. 3A, FIG. 3A is a flowchart illustrating the steps of manufacturing scorelines for a golf club head, according to an implementation of the present disclosure. The approach and technique indicated by flowchart 390 are sufficient to describe at least one implementation of the present disclosure. However, other implementations of the disclosure may utilize approaches and techniques different from those shown in flowchart 390. Furthermore, while flowchart 390 is described with respect to FIGS. 3B-3E, the disclosed inventive concepts are not intended to be limited by specific features shown and described with respect to FIGS. 3B-3E. Furthermore, with respect to the method illustrated in FIG. 3A, it is noted that certain details and features may have been omitted in order not to obscure the discussion of inventive features in the present application.

Figure 3C:
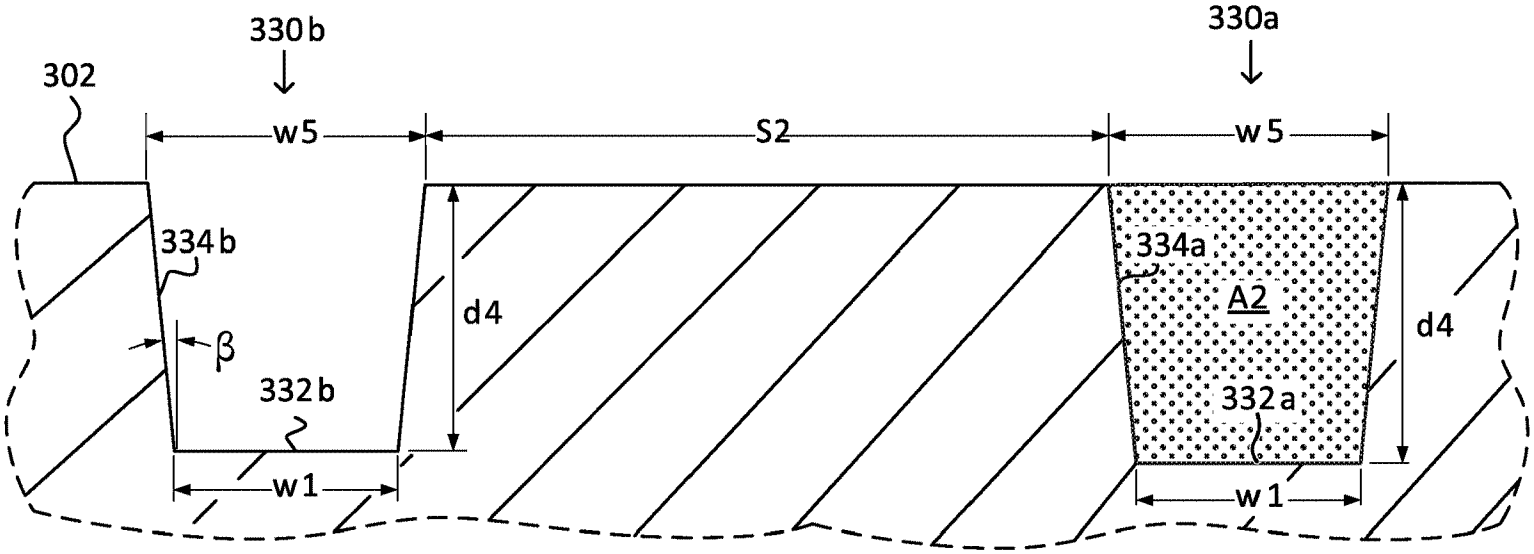
FIG. 3C is a cross-sectional view of a portion of an intermediate club head body corresponding to a step in the flowchart of FIG. 3A for manufacturing the scorelines for a golf club head.
Figure 3D:
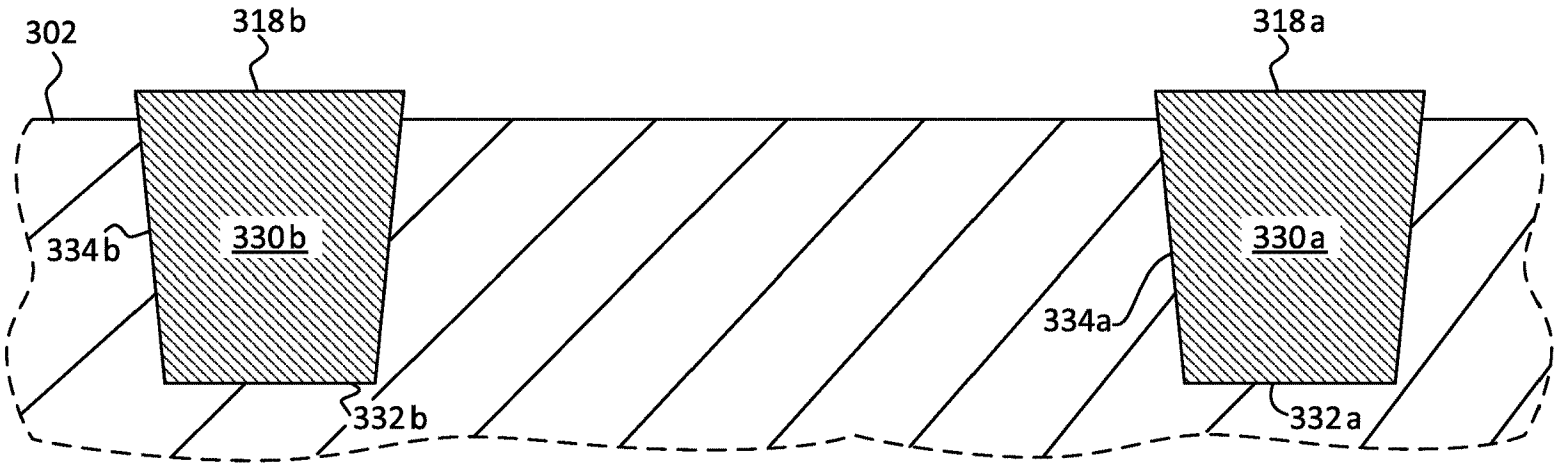
FIG. 3D is a cross-sectional view of a portion of an intermediate club head body corresponding to a step in the flowchart of FIG. 3A for manufacturing the scorelines for a golf club head.
Figure 3E:
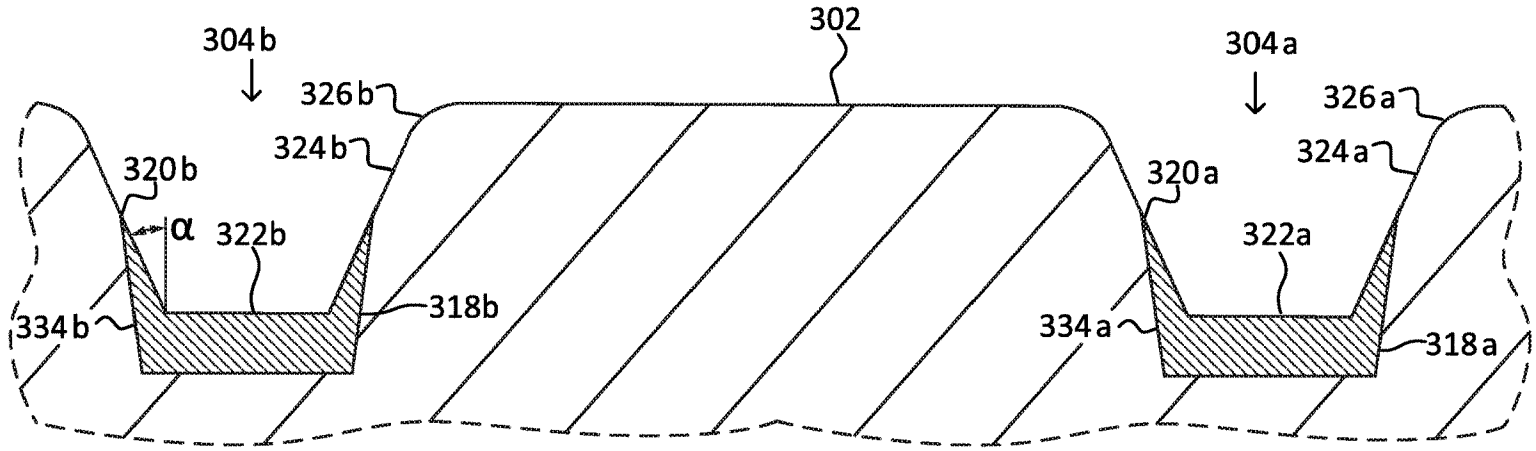
FIG. 3E is a cross-sectional view of a portion of a final club head body corresponding to a step in the flowchart of FIG. 3A for manufacturing the scorelines for a golf club head.
Figure 4A:
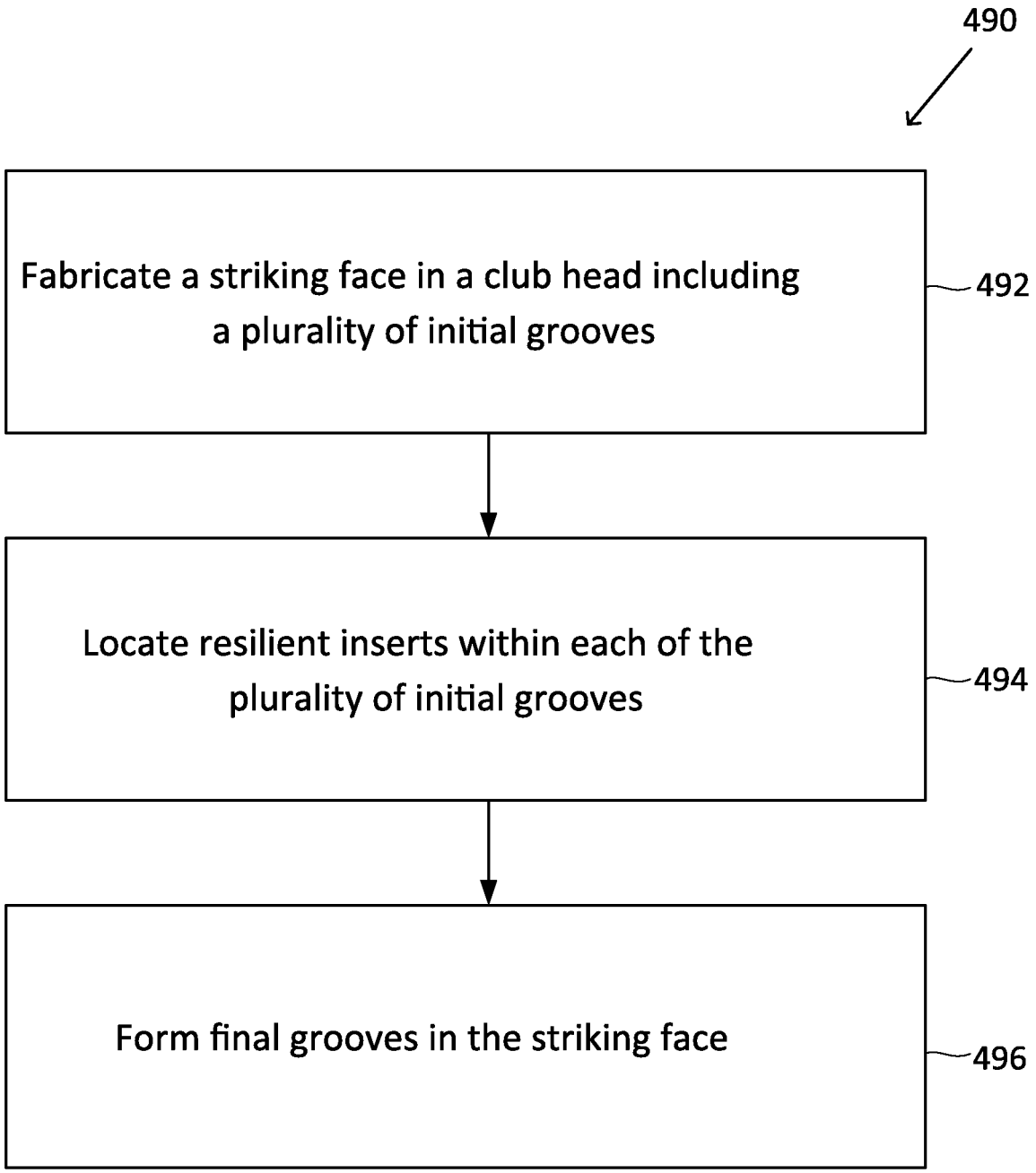
FIG. 4A is a flowchart exemplifying a process of manufacturing scorelines for a golf club head according to an implementation of the present disclosure.
Figure 4B:
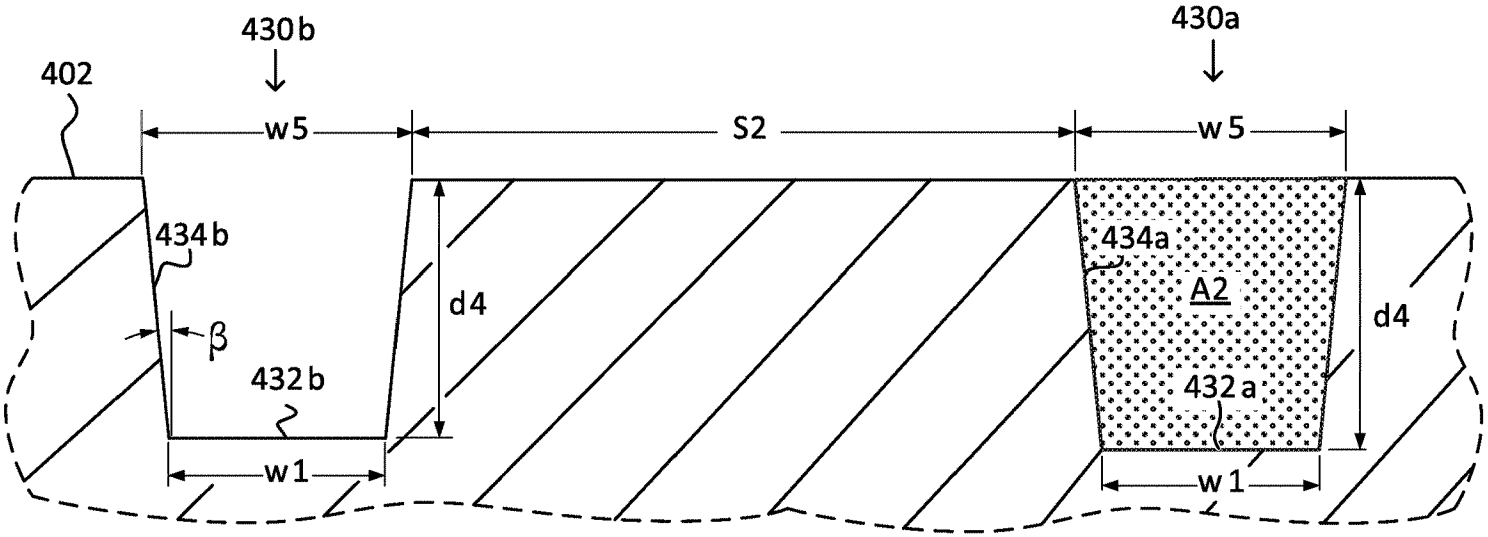
FIG. 4B is a cross-sectional view of a portion of an intermediate club head body corresponding to a step in the flowchart of FIG. 4A for manufacturing the scorelines for a golf club head.
Figure 4C:
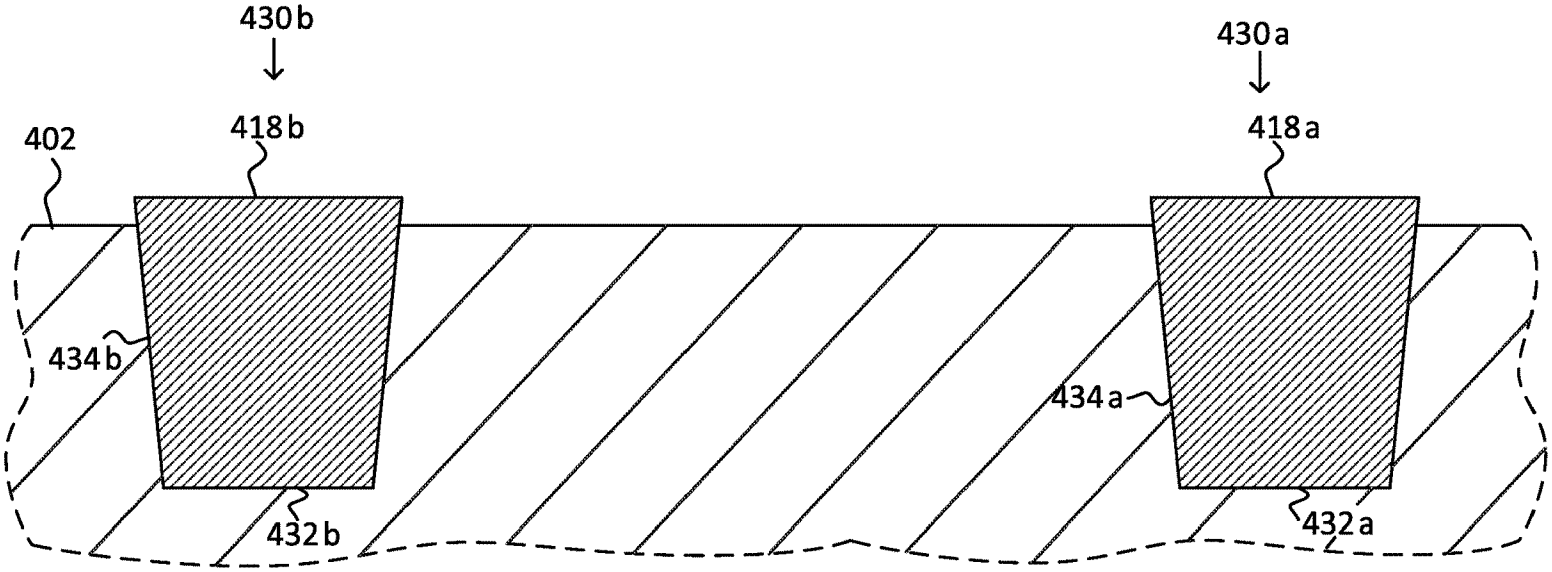
FIG. 4C is a cross-sectional view of a portion of an intermediate club head body corresponding to a step in the flowchart of FIG. 4A for manufacturing the scorelines for a golf club head.
Figure 4D:
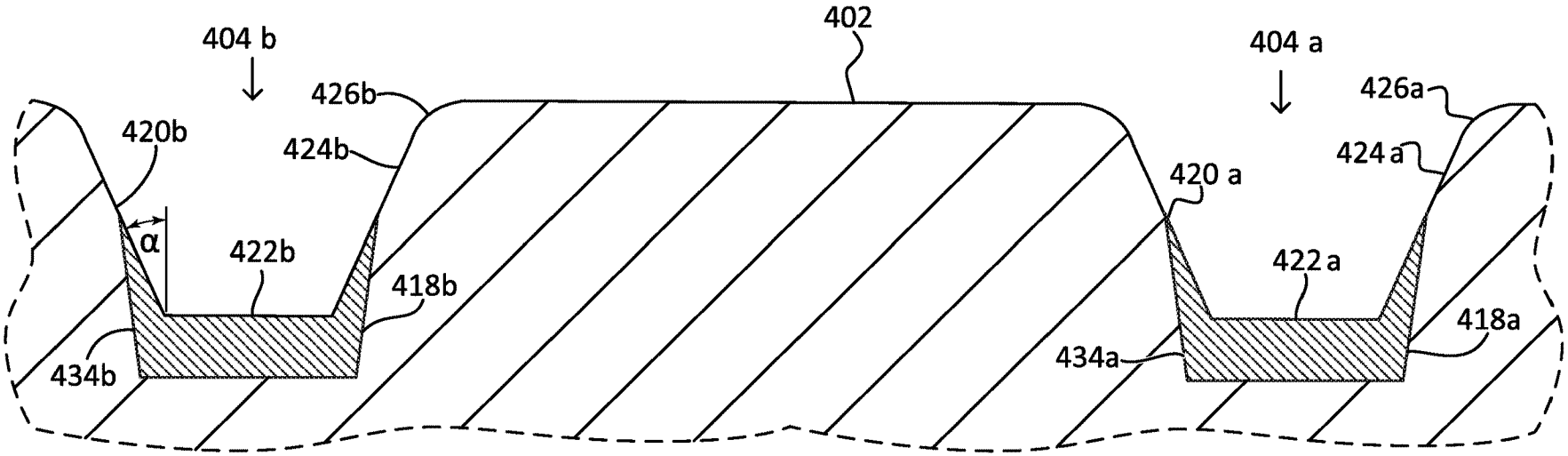
FIG. 4D is a cross-sectional view of a portion of final club head body corresponding to a step in the flowchart of FIG. 4A for manufacturing the scorelines for a golf club head.

It should be noted that the dimensions and characteristics and accompanying rationale of the enlarged cross-sectional views of FIGS. 2C-2D as explained above apply to the enlarged cross-sectional views of FIG. 3E and FIG. 4D. In other words, FIGS. 2C and 2D are substantially identical to FIGS. 3E and 4D. As such, the dimensions and characteristics described with respect to FIGS. 2C and 2D apply to FIGS. 3E and 4D, including but not limited to initial groove dimensions, final groove dimensions, and resilient insert dimensions and characteristics (e.g. hardness).

Flowchart 390 (at 392) includes fabricating a striking face in a club head. For example, referring to FIG. 3B, the striking face 302 is fabricated into a club head, such as club head 200 of FIG. 2A. The striking face 302 can be fabricated utilizing a variety of methods, including but not limited to milling, stamping, casting, sandblasting, electroforming, or any other fabrication method known in the art.

Flowchart 390 (at 394) includes machining a plurality of initial grooves into the striking face of the club head. For example, referring to FIG. 3C, the initial grooves 330*a* and 330*b* (hereinafter collectively referred to as initial grooves 330) are machined into the striking face 302 of the club head, such as club head 200 of FIG. 2A. The initial grooves 330 may be machined by milling, drilling, punching, blasting, or any other suitable method known in the art. The initial grooves 330 have sidewalls 334*a* and 334*b* (hereinafter collectively referred to as sidewalls 334), respectively. It should be noted that each of the initial grooves 330 has two sidewalls, the second sidewall of each initial groove is mirrored across the bases 332*a* and 332*b* (hereinafter collectively referred to as bases 332) of the initial grooves 330*a* and 330*b*, respectively. In addition, the initial grooves 330*a* and 330*b* have bases 332*a* and 332*b*, respectively.

The sidewalls 334 have an elevation defined by the distance d4. The distance d4 is determined based on the desired elevation of the final grooves 304*a* and 304*b* (hereinafter collectively referred to as final grooves 304), similar to the distance d2 and d3 as defined with respect to FIG. 2D. In addition, the distance d4 is determined based on the desired depth of the resilient inserts 318*a* and 318*b* (hereinafter collectively referred to as resilient inserts 318), similar to the distance d1 of the resilient inserts 218 in FIG. 2D. As such, the distance d4 is preferably between 0.51 mm and 1.01 mm (0.020 inch and 0.040 inch), more preferably between 0.64 mm and 0.91 mm (0.025 inch and 0.036 inche), and most preferably between 0.71 mm and 0.86 mm (0.028 inch and 0.034 inch).

The sidewalls 334 of the initial grooves 330 have a draft angle β measured with respect to an imaginary line that is perpendicular to the plane of the striking face, such as the plane 292 of the striking face 202 of FIG. 2B. In some implementations, the sidewalls 334 of the initial grooves 330 may be perpendicular to the plane of the striking face 302 such that the angle β is 0 degrees, while in other implementations the draft angle β of the sidewalls 334 may be greater than 0 degrees. It is possible that the draft angle β may be negative in some implementations, however, it is preferable that the angle β is 0 degrees or greater due to the increase in manufacturing difficulty if the sidewalls 334 were converging.

In some implementations, the angle β of the sidewalls 334 of the initial grooves 330, respectively, may be the same, or substantially the same, as to the draft angle α of the sidewalls 324 of the final grooves 304. In such an implementation, at least a portion of the sidewalls 334 of the initial grooves 330 may serve as at least a portion of the sidewalls 324 of the final grooves 304. However, in implementations such as where the angle β is not the same as the angle α, the sidewalls 334 will not make up any part of the sidewalls 324 of the final grooves 304. In such an implementation, the sidewalls 324 of the final grooves 304 may likely be manufactured during a different, additional step than that of the sidewalls 334, which will be described in more detail below with respect to FIG. 3E.

Referring again to FIG. 3C, the width w5 is the width of the initial grooves 330 as measured according to the 30 degree method outlined in the Rules of Golf, the same method used for measuring the width w3 in FIG. 2D. The width w5 is preferably equal to or less than the width w3 of the final grooves 304 because the width w3 is the final width of the final grooves 304, which are either equal in width or greater in width as a result of manufacturing steps, e.g. material removable processes, after the manufacturing of the initial grooves 330. Ultimately, the draft angle β and the width w1 of the bases 332 of the initial grooves 330 must be determined such that the width w5 of the initial grooves 330 is equal to or less than the width w3 of the final grooves 304 (see FIG. 3E). As such, the width w5 is preferably between 0.51 mm and 0.89 mm (0.020 inch and 0.035 inch), more preferably between 0.56 mm and 0.86 mm (0.022 inch and 0.034 inch), and most preferably between and 0.64 mm and 0.79 mm (0.025 inch and 0.031 inch).

The distance S2 is defined as the distance between adjacent edges of the initial grooves 330. The distance S2 together with the width w5 define the pitch P2 of the initial grooves 330. In some implementations, the pitch P2 of the initial grooves 330 is the same as the pitch P of the final grooves 304, the pitch P of the final grooves 304 being described in more detail below. Preferably, the distance S2 is between 1.91 mm and 2.79 mm (0.075 inch and 0.110 inch), more preferably between 2.03 mm and 2.54 mm (0.080 inch and 0.100 inch), and most preferably between 2.26 mm and 2.46 mm (0.089 inch and 0.097 inch).

In some implementations, such as where the draft angle β of the sidewalls 334 is the same as the draft angle α of the sidewalls 324, the width w3 and the width w5 (see FIG. 2D) are substantially the same and the distance S2 and the distance S are substantially the same. However, in other implementations, the width w3 and w5 are different and/or the distance S2 and the distance S are different. In either case, the ranges of values for the width w5 preferably generally coincide with the ranges of values for the width w3, and the ranges of values for the distance S2 preferably generally coincide with the ranges of values for the distance S. However, this does not mean that for each implementation the widths w3 and w5 and the distance S2 and S are the same. As discussed above with regard to the width w5 and the distance S2, these values depend on a variety of factors, including the desired width w1, the draft angle β, and the desired dimensions and characteristics of the resilient inserts 318 as well as the final grooves 304.

The cross-sectional area A2 of the initial grooves is defined as the area delimited by the base 332, the sidewalls 334, and the plane of the striking face 302, such as the plan 292 of the striking face 202 of FIG. 2B. The cross-sectional area A2 of the initial grooves is also illustrated by the pattern filling the initial groove 330*a* of FIG. 3C. For example, the initial groove 330*a* is defined by the plane of the striking face 302, the sidewall 334*a* and the mirrored sidewall opposite the sidewall 334*a*, and the base 332*a*. As such, the distance d4, the draft angle β, the width w1, and the width w5 aid in the determination of the design for the cross-sectional area A2 of the initial grooves. As mentioned above with respect to FIG. 2D, the Rules of Golf require that the ratio of cross-sectional area A to pitch P (A/P) of the scorelines (i e, final grooves 304) on the striking face be less than 0.076 $mm^2$ (0.0030 $in^2$). As described in this disclosure, the final grooves/scorelines are designed to be in conformance to the dimension and characteristic requirements outlined in the Rules of Golf. However, because the initial grooves 330 are not the final grooves 304, they are not bound by the dimension and characteristic restrictions outlined in the Rules of Golf. As such, the initial grooves are designed to have an A2/P2 ratio of greater than 0.076 $mm^2$ (0.0030 $in^2$), where P2=w5+S2, in order to accommodate the resilient inserts 318 such that the final grooves 304 can be designed to have an A2/P2 ratio of greater than 0.076 $mm^2$ (0.0030 $in^2$). In creating this combination of initial grooves 330 and resilient inserts 318, one or more surfaces of the final grooves 304 are formed of a resilient material. A structure of this kind provides improved accommodation of fluid and debris during impact with a golf ball enabling increased spin rates at impact in addition to providing better feel for the golfer at impact, while still conforming to the requirements of the Rules of Golf.

Referring again to FIG. 3A, flowchart 390 (at 396) includes locating resilient inserts within each of the plurality of initial grooves. For example, referring to FIG. 3D, the resilient inserts 318 are placed into the initial grooves 330. The locating may be done by placing, filling, pouring, inserting, or any other method known in the art. In some implementations, the resilient inserts 318 may be located within the initial grooves 330 in an unfinished form, such as that illustrated in FIG. 3D. However, in other implementations, the resilient inserts 318 may be pre-fabricated to the desired shape and dimensions and then located within the initial grooves 330. In such an implementation, the resilient inserts 318 may be pre-fabricated to be similarly dimensioned to those illustrated in FIG. 3E, or pre-fabricated to conform to any shape desired that still maintains conformity to the requirements of the Rules of Golf for the final grooves 304.

The resilient inserts 318 may be made of any suitable material, where the selection of material may depend on a variety of factors, including but not limited to the method about which the resilient inserts 318 are located within the initial grooves 330. For example, if the material is intended to be poured, the resilient inserts 318 may comprise a metallic, plastic, or thermoplastic polyurethane (TPU) type material, such that the material may be melted, poured into the initial grooves, and then allowed to harden. In such cases, if the material is a metallic material, a metal is preferably selected having a melting point below that melting point of any surrounding metallic material constituting the striking face 302, such that the striking face 302 is not melted or deformed in any way during the pouring process. In another example, if the material is intended to be inserted, the resilient inserts 318 may be made from a polymer, such that they may be pre-fabricated and inserted into the initial grooves 330. Such polymeric materials may include a polyurethane, TPU, resin, polyamide, synthetic rubber, and/or an elastomer, which may provide a higher static coefficient of friction and thereby enable increased accommodation of fluid and debris during impact with a golf ball. Other materials that may be utilized for the resilient inserts 318 include foam, rubber foam, composites, hardened plastic, or any other material that is known in the art. Where location of the insert material is by way of insertion of a solid, pre-fabricated component, the component may be secured within the initial groove 330 using dual sided tape, glue, or a chemical adhesive, for example. Alternatively, mechanical fasteners may be used such as a press-fit arrangement. The securement may be permanent or temporary e.g. for ease of replacing the component upon wear.

Although the resilient inserts 318 are illustrated as a single material in FIG. 3D, the embodiment of FIG. 3D is not intended to be limiting in this regard. For example, in some implementations, the resilient inserts 318 may comprise any number of materials, which may be layered vertically, side by side, or any other desired combination. For one example, the resilient inserts 318 may each comprise a first layer of a hardened plastic material that is located within the initial grooves 330 such that the hardened plastic material fills 25% of the total elevation of the initial grooves 330, defined as the distance d4 above. A second layer of a rubber material may then be placed into the initial grooves 330 to fill the initial grooves 330 to 50% of the total elevation. In such an example, after the final grooves 304 are machined, the resilient inserts 318 may have bases 322 that comprise the hardened plastic first layer and sidewalls 324 that at least partially comprise the rubber material second layer.

The resilient inserts in each of the final grooves 304, including the resilient inserts 318, may each comprise different materials. The materials and/or characteristics (e.g., hardness) of the resilient inserts 318 may differ depending on where on the striking face 302 the final grooves 304 are located. For example, on areas of the striking face 302 where more spin is desired, such as in the central area of the striking face 302, the resilient inserts may comprise a softer material (e.g., durometer hardness of between 30 and 70 Shore D) that will allow for greater accommodation of debris and fluid at impact thereby imparting increased spin on the golf ball. Alternatively, on areas of the striking face 302 where less spin is desired, such as near the top portion, the sole portion, the heel portion, and the toe portion of the striking face 302, the resilient inserts may comprise a harder material (e.g., durometer hardness of between 50 and 70

Shore D) that is designed to impart less spin on the golf ball at impact, e.g., by deforming less under the forces of impact.

In addition to different characteristics, there may be different materials used for each resilient insert 318 within the final grooves 304. The material of the resilient inserts 318 may differ depending on the portion of the final grooves 304 where the resilient inserts 318 are located. For example, the resilient insert 318*a* in the final groove 304*a* may comprise a hardened plastic on the toe and heel side of the final groove 304*a*, where mishit shots typically occur and less spin is desired, but may comprise a rubber in between the toe and heel side of the final groove 304*a*, where properly hit shots typically occur and more spin is desired. Specific hardness and material compositions are explained in more detail above with reference to FIGS. 2A-2D.

As such, the resilient inserts 318 proximate the central region of the striking face 302 may include softer materials while the resilient inserts 318 around the toe, heel, top, and sole portions of the striking face 302 may comprise harder materials in order to account for desired spin rates imparted on the golf ball over a wide range of impact areas. However, this is not intended to be limiting, and depending on the specific implementation and the target consumer, a different relationship between the materials and characteristics of the resilient inserts 318 may be implemented. Such as, for example, for club heads geared toward high handicap golfers (e.g., 18+ handicap), very soft material (e.g., durometer hardness of between 20 and 40 Shore D) resilient inserts 318 on areas of the face where mishit shots occur more often may be implemented to provide more of a forgiving and soft feel. Specific hardness and material compositions are explained in more detail above with reference to FIGS. 2A-2D.

The resilient inserts 318 may be located within the initial grooves 330 such that the resilient inserts 318 fill, or overfill, the initial grooves 330, as illustrated in FIG. 3D. In other implementations, the resilient inserts 318 may be located within the initial grooves 330 such that they are flush with the striking face 302. In yet another implementation, the resilient inserts 318 may be located within the initial grooves 330 to have any desired dimensions within the initial grooves 330 so long as the resilient inserts 318 are capable of forming final grooves 304 having dimensions and characteristics in conformance with the Rules of Golf.

As mentioned above, the resilient inserts 318 may be pre-fabricated before being located within the initial grooves 330. In such an example, the resilient inserts 318 may be pre-fabricated to have any initial dimensions, including the final dimensions of the resilient inserts 318 for the final grooves 304 as illustrated in FIG. 3E, or the unfinished dimensions that over-fill the initial grooves 330 as illustrated in FIG. 3D.

Flowchart 390 (at 398) includes forming the final grooves in the striking face. For example, referring to FIG. 3E, the final grooves 304 are formed in the striking face 302. The final grooves 304 may be formed by machining at least the resilient inserts 318 to their final dimensions and shape. In some implementations, as described above, the resilient inserts 318 may be pre-fabricated. In such implementations, the final grooves 304 may be formed by machining the striking face and/or the initial grooves 330 to form the sidewalls 324 of the final grooves 304. In addition, in some implementations, the initial grooves 330 may be machined to have the desired dimensions of the final grooves 304. In such implementations, if the resilient inserts 318 are not pre-fabricated, forming the final grooves 304 may only require machining the resilient inserts 318 to their final dimensions and shape. If the resilient inserts 318 are pre-fabricated, step 394 of flowchart 300, which includes placing the resilient inserts into each of the plurality of initial grooves, may constitute the forming of the final grooves 304 without any additional manufacturing steps being required.

It should be noted that the final grooves 304 correspond respectively to the scorelines 204 of FIGS. 2A-2D. That being said, the striking face 202, the edges 226, the sidewalls 224, the base 222, the transition portion 220, and the resilient inserts 218 of FIGS. 2A-2D correspond respectively to the striking face 302, the edges 326, the sidewalls 324, the base 322, the transition portion 320, and the resilient inserts 318 of FIG. 3E. Additionally, the dimensions and characteristics of the scorelines 204 of FIGS. 2A-2D are consistent with the dimensions and characteristics of the final grooves 304 of FIG. 3E.

Now referring to FIG. 4A, FIG. 4A is a flowchart illustrating the steps of manufacturing scorelines for a golf club head, according to an implementation of the present disclosure. The approach and technique indicated by flowchart 490 are sufficient to describe at least one implementation of the present disclosure. However, other implementations of the disclosure may utilize approaches and techniques different from those shown in flowchart 490. Furthermore, while flowchart 490 is described with respect to FIGS. 4B-4D, the disclosed inventive concepts are not intended to be limited by specific features shown and described with respect to FIGS. 4B-4D. Furthermore, with respect to the method illustrated in FIG. 4A, it is noted that certain details and features may have been omitted in order not to obscure the discussion of inventive features in the present application.

As mentioned above, it should be noted that the dimensions and characteristics and accompanying rationale of the enlarged cross-sectional views of FIGS. 2C-2D as explained above apply to the enlarged cross-sectional views of FIG. 4D. In other words, FIGS. 2C and 2D are substantially identical to FIG. 4D.

Flowchart 490 (at 492) includes fabricating a striking face in a club head including a plurality of initial grooves. For example, referring to FIG. 4B, the striking face 402 is fabricated into a club head, such as club head 200 of FIG. 2A, to include the initial grooves 430. Different from the embodiment of FIGS. 3A-3E, the initial grooves 430 are fabricated simultaneously with the striking face 402. The fabrication of the striking face 402 and the initial grooves 430 may be done by casting, stamping, or electroforming, for example.

It should be noted that the ranges of values for the dimensions and characteristics of the striking face 402 and the initial grooves 430 similarly apply to those of the striking face 302 and the initial grooves 330 in FIG. 3C, described above. As a result, the remaining steps, e.g. 494 and 496, in the flowchart 490 are identical to steps 396 and 398, respectively, of flowchart 390. As such, the striking face 402, the edges 426, the sidewalls 424, the base 422, the transition portion 420, the resilient inserts 418, the final grooves 404, the initial grooves 430, the bases 432, and the sidewalls 434 of FIGS. 4B-4D correspond respectively to the striking face 302, the edges 326, the sidewalls 324, the base 322, the transition portion 320, the resilient inserts 318, the final grooves 304, the initial grooves 330, the bases 332, and the sidewalls 334 of FIG. 3C-3E. Additionally, the dimensions and characteristics of the scorelines 204 of FIGS. 2A-2D are consistent with the dimensions and characteristics of the final grooves 404 of FIG. 4D.

Figure 5A:
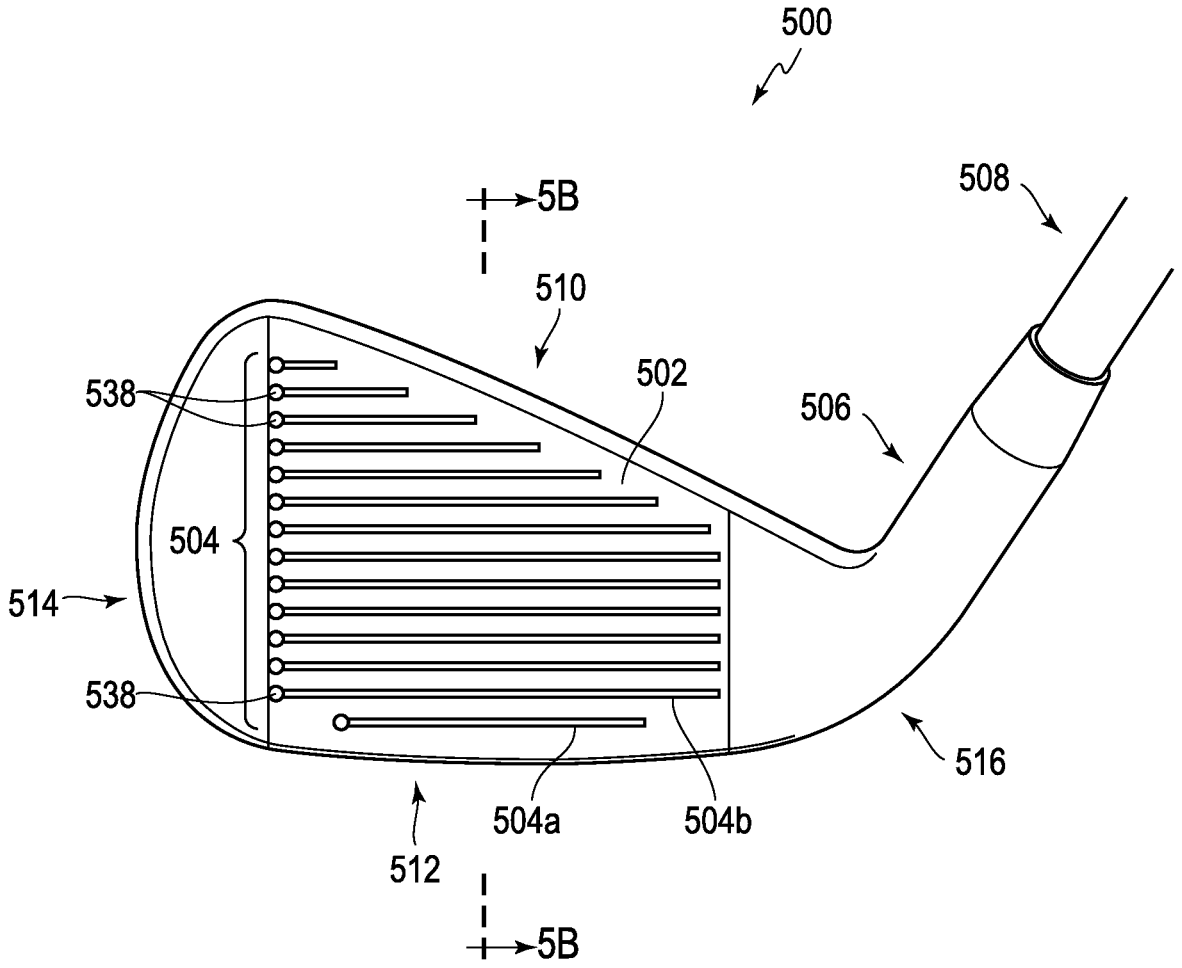
FIG. 5A is a front elevation view of a golf club head according to an implementation of the present disclosure.

Now referring to FIG. 5A, FIG. 5A is a front elevation view of a golf club head according to an implementation of the present disclosure. Club head 500 of FIG. 5A includes striking face 502 which includes final grooves 504. The final grooves 504 include, for example, final groove 504*a* and final groove 504*b* as well as entry holes 538. The club head 500 further includes a toe portion 514, a heel portion 516, a top portion 510, a rear portion 517 (not shown) opposite the striking face 502, and a sole portion 512. The club head 500 further includes hosel 506 for securing the club head 500 to a shaft 508.

The entry holes 538 are configured to allow a drill or mill bit to enter to a desired depth in order to machine the undercut grooves 530, which will be described in further detail below. More specifically, in some embodiments, the maximum width of the drill or mill bit may be wider than the width of the undercut grooves 530 and/or the final grooves 504, which may be a result of the portion of the bit that creates the undercut portion 570 of the undercut grooves 530. In order to accommodate for this discrepancy in widths, the entry holes 538 may be drilled or milled into the striking face 502 to create an entry point for the drill or mill bit. Although the entry holes 538 are illustrated near the toe portion 514 of the grooves on the striking face 502, in some embodiments the entry holes 538 may be located near the heel portion 516 of the grooves on the striking face 502. By including the entry holes 538 on either the toe portion 514 or the heel portion 516 side of the grooves, the mill bit only has one entry and exit point on the striking face 502. As such, for example, if the entry holes 538 are located on the toe portion 514 side of the grooves, the mill bit would enter the entry holes 538 descending such that the undercutting portion of the bit submerges below the striking face by a predetermined distance, complete a first pass in a toe to heel direction across the striking face 502 to the desired length of the groove, then return in a toe to heel direction across the striking face 502 back to the entry holes 538, and finally exit the striking face 502.

Alternatively, in some embodiments, the entry holes 538 may be located at both the toe portion 514 and the heel portion 516 of the grooves. In such an embodiment, the mill bit may enter either the toe side or heel side entry holes 538, make a single pass across the face in a heel to toe direction, and then exit the entry holes 538 on the opposing side of the striking face 502 as the entry point.

It should be noted that the undercut grooves 530 and the final grooves 504 may extend in a direction different than toe to heel across the face. For example, the undercut grooves 530 and the final grooves 504 may extend vertically on the face in a direction from the sole to the top portion of the club head 500, or alternatively may extend at any angle across the striking face 502 depending on the desired spin characteristics and the club type. As such, the milling and/or drilling paths may change to accommodate the desired layout of the undercut grooves 530 and the final grooves 504.

In yet another embodiment, the entry holes 538 may not be necessary. For example, if the drill or mill bit is not wider than the width of the initial grooves 530 or the final grooves 504, the entry holes 538 may not be necessary. For example, when looking at a cross-section of the final grooves 504, the mill bit may have a width that is less than the portion of a cross-section of the the final grooves 504 having the smallest width, and thus fit within and/or through the final grooves 504. As such, the entry holes 538 are not necessary in such an implementation. In such an implementation, the mill bit may make a first pass along the striking face 502 in a heel to toe direction, for example, then make a second pass, offset from the first pass, such that the final grooves 504 and the initial grooves 530 have desired dimensions and characteristics, such as the dimensions and characteristics of the final grooves 504 and initial grooves 530 described below with respect to FIGS. 5D-5G.

Further, it should be noted that although the embodiment of FIG. 5A includes heel to toe extending grooves, this embodiment is not intended to be limiting. As such, the final grooves 504 may extend in any direction on the striking face 502. For example, the final grooves 504 may extend in a vertical direction, or at angle across the striking face 502, depending on the desired spin characteristics at impact with a golf ball.

Figure 5B:
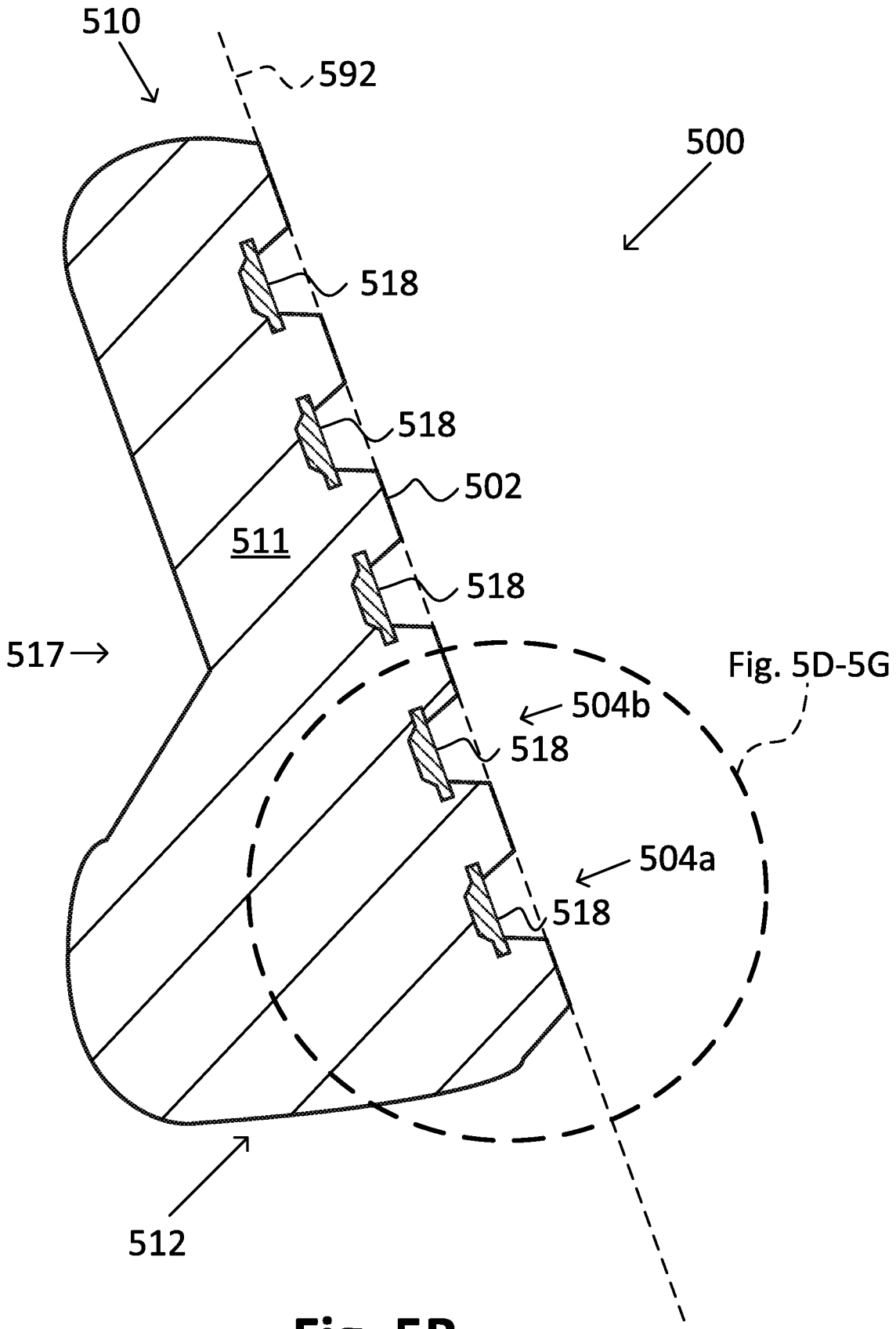
FIG. 5B is a cross-sectional view of a portion of the golf club head of FIG. 5A.

Now referring to FIG. 5B, FIG. 5B is a cross-sectional view of a portion of the golf club head of FIG. 5A. More specifically, FIG. 5B is a cross-sectional view of the club head 500 of FIG. 5A taken along plane 5B-5B. FIG. 5B includes the final grooves 504, which includes the final grooves 504*a* and 504*b*, the sole portion 512, the striking face 502, the rear portion 517 opposite the striking face 502, and the club head body 511. Each of the final grooves 504 includes resilient inserts 518. The striking face 502 defines a plane 592.

The club head body 511 may comprise any number of different materials including a metallic material, a composite material, a polymeric material, a carbon fiber material, or any other material suitable for use in the club head 500, similar to that of club head 200 of FIG. 2A-2D. In some implementations, the club head body 511 may be formed of the same material as the striking face 502, and at least part of the final grooves 504*a* and 504*b*. For example, if the club head body 511 is formed of a metallic material such as stainless steel, at least a portion of the sidewalls of the final grooves 504 in addition to the striking face 502 may also be formed of the same metallic material. However, in some implementations, such as those illustrated in FIG. 5G, the final grooves 504 may have sidewalls formed entirely of the same metallic material as the striking face 502 while only the base of the final grooves 504 are formed of the material from the resilient inserts 518.

In this embodiment, the scorelines 504 are preferably machined into the striking face 502, by milling or drilling, for example. Various different manufacturing methods will be described below in more detail with reference to FIGS. 5C-5G.

Figure 5C:
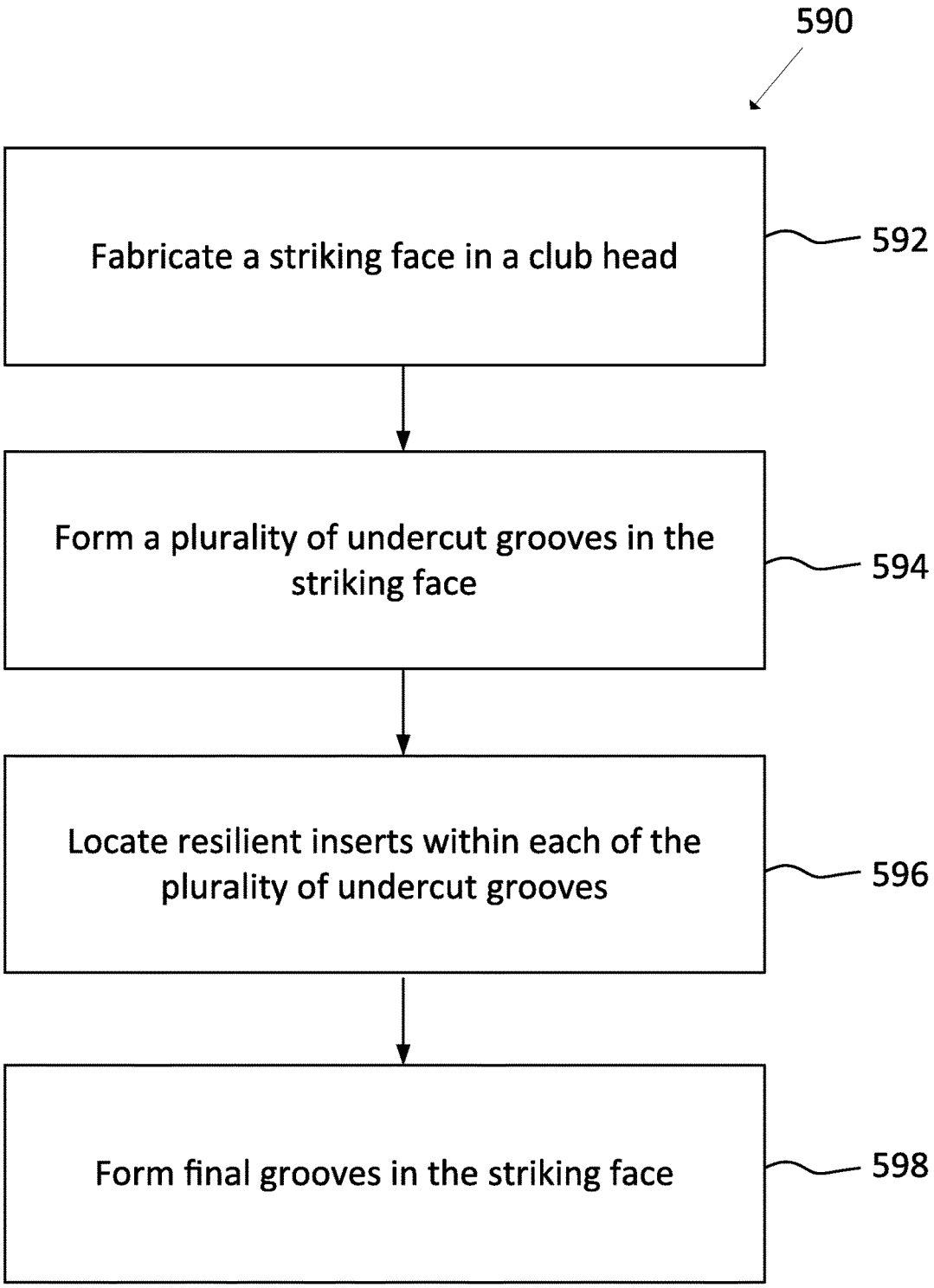
FIG. 5C is a flowchart exemplifying a process of manufacturing scorelines for a golf club head according to an implementation of the present disclosure.
Figure 5D:
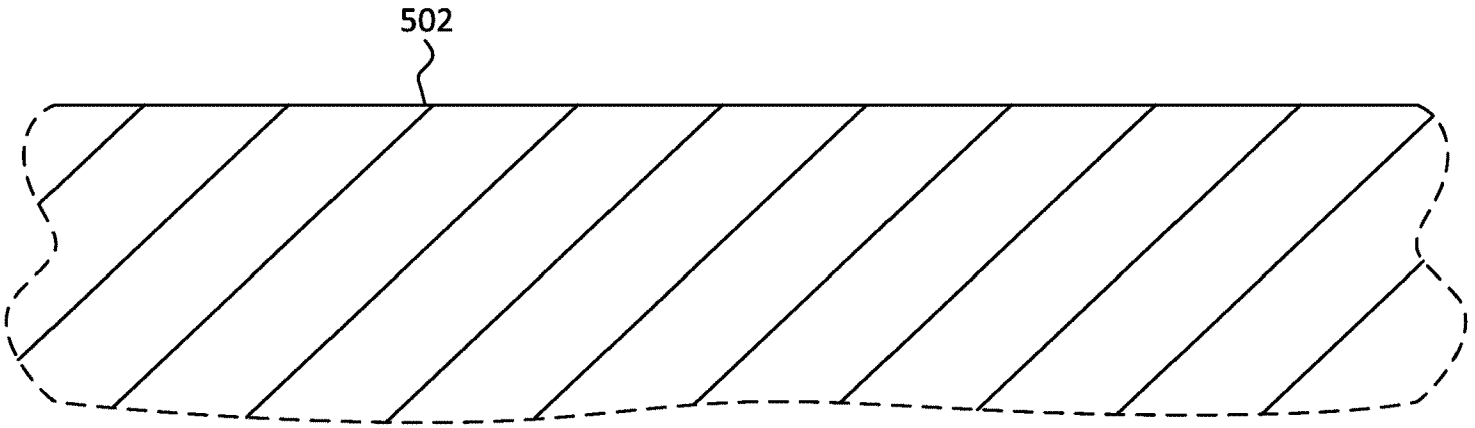
FIG. 5D is a flowchart exemplifying a process of manufacturing scorelines for a golf club head according to an implementation of the present disclosure.

Now referring to FIG. 5C, FIG. 5C is a flowchart exemplifying a process of manufacturing scorelines for a golf club head according to an implementation of the present disclosure. The approach and technique indicated by flowchart 590 are sufficient to describe at least one implementation of the present disclosure. However, other implementations of the disclosure may utilize approaches and techniques different from those shown in flowchart 590. Furthermore, while flowchart 590 is described with respect to FIGS. 5D-5G, the disclosed inventive concepts are not intended to be limited by specific features shown and described with respect to FIGS. 5D-5G. Furthermore, with respect to the method illustrated in FIG. 5C, it is noted that certain details and features may have been omitted in order not to obscure the discussion of inventive features in the present application.

Flowchart 590 (at 592) includes fabricating a striking face in a club head. For example, referring to FIG. 5D, the striking face 502 is fabricated into a club head, such as club head 500 of FIG. 5A. The striking face 502 can be fabricated utilizing a variety of methods, including but not limited to milling, stamping, casting, sandblasting, electroforming, or any other fabrication method known in the art.

Flowchart 590 (at 594) includes machining a plurality of undercut grooves into the striking face of the club head. For example, referring to FIG. 5E, the undercut grooves 530*a* and 530*b* (hereinafter collectively referred to as undercut grooves 530) are machined into the striking face 502 of the club head, such as club head 500 of FIG. 5A. The undercut grooves 530 may be machined by milling, drilling, punching, blasting, or any other suitable method known in the art. The undercut grooves 530 have sidewalls 534*a* and 534*b* (hereinafter collectively referred to as sidewalls 534), respectively. Each of the sidewalls 534 has an undercut portion 570. It should be noted that each of the undercut grooves 530 has two sidewalls and two undercut portions 570, the second sidewall 534 and second undercut portion 570 of each undercut groove is mirrored across the bases 532*a* and 532*b* (hereinafter collectively referred to as bases 532) of the undercut grooves 530*a* and 530*b*, respectively. In addition, the undercut grooves 530*a* and 530*b* have bases 532*a* and 532*b*, respectively.

The undercut portions 570 are preferably formed by a mill bit during a milling operation and their shape is based on both the shape of the mill bit as well as the path of the mill bit during the milling operation. Referring to mill bits 572*a* and 572*b* (hereinafter collectively referred to as mill bits 572) of FIGS. 5H and 5I, respectively, different types of mill bits may be utilized depending on the implementation, as described in greater detail below.

Figure 5E:
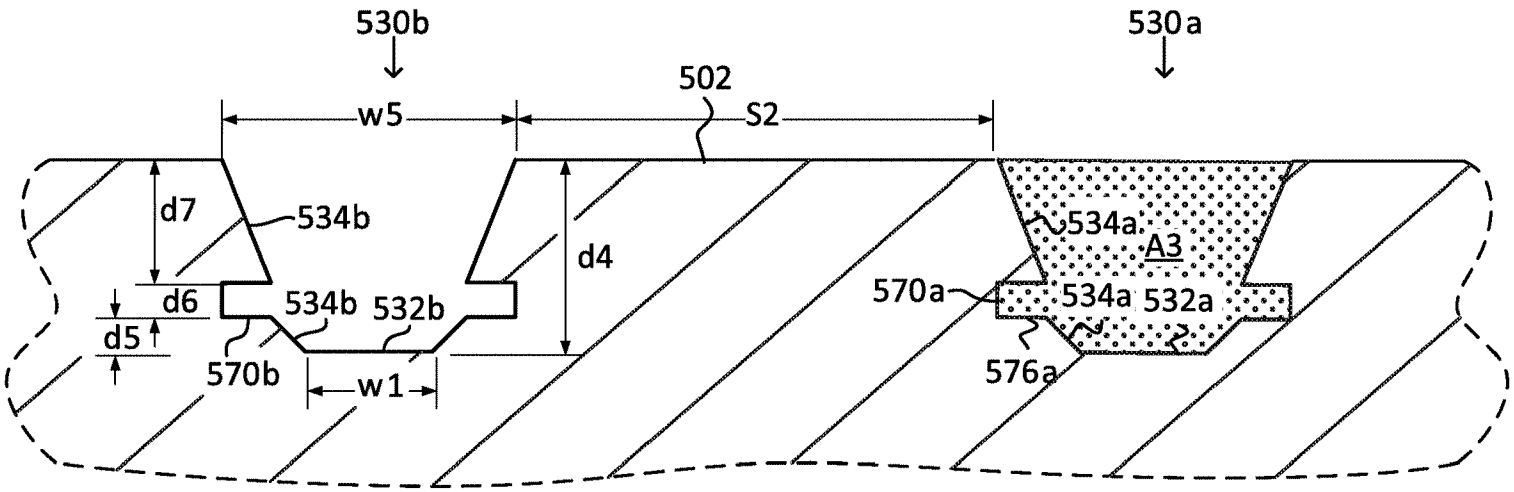
FIG. 5E is a cross-sectional view of a portion of an intermediate club head body corresponding to a step in the flowchart of FIG. 5C for manufacturing the scorelines for a golf club head.
Figure 5F:
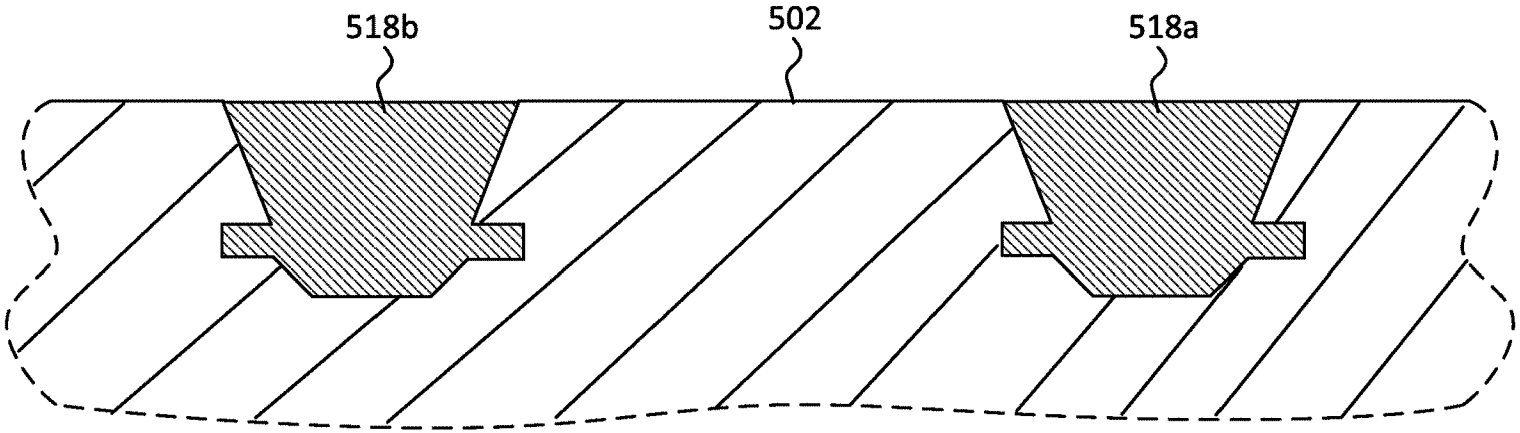
FIG. 5F is a cross-sectional view of a portion of an intermediate club head body corresponding to a step in the flowchart of FIG. 5C for manufacturing the scorelines for a golf club head.
Figure 5G:
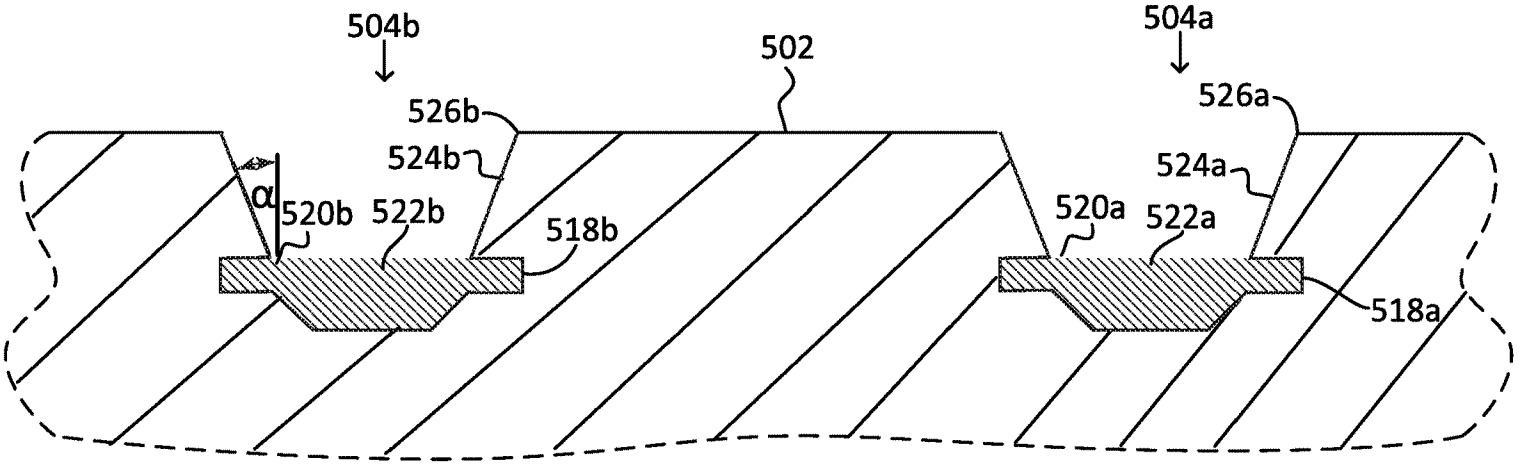
FIG. 5G is a cross-sectional view of a portion of a final club head body corresponding to a step in the flowchart of FIG. 5C for manufacturing the scorelines for a golf club head.
Figure 5H:
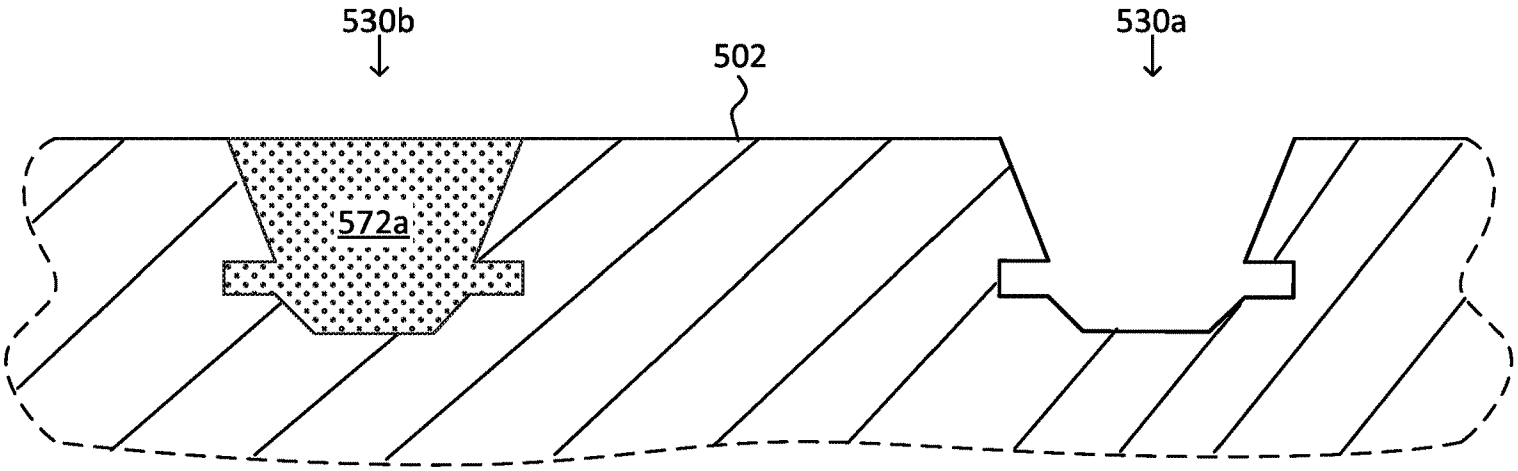
FIG. 5H is a cross-sectional view of a portion of a final club head body corresponding to a step in the flowchart of FIG. 5C for manufacturing the scorelines for a golf club head.

For a first example, mill bit 572*a* of FIG. 5H is illustrated as having a shape substantially identical to the shape of the undercut grooves 530. As explained above with reference to FIG. 5A, in order to accommodate the mill bits 572 having a width greater than the width of the undercut grooves 530, the mill bits 572 must enter the striking face 502 through one of entry holes 538. As such, in an implementation such as that of FIG. 5H where the mill bit 572*a* is wider than the undercut grooves 530, the entry holes 538 would preferably be drilled or milled into the striking face 502 before the mill bit 572*a* is utilized to create the undercut grooves 530. In such an implementation, the entry holes 538 would likely still be visible even after the undercut grooves 530 and the final grooves 504 are machined, such as illustrated in FIG. 5A.

Figure 5I:
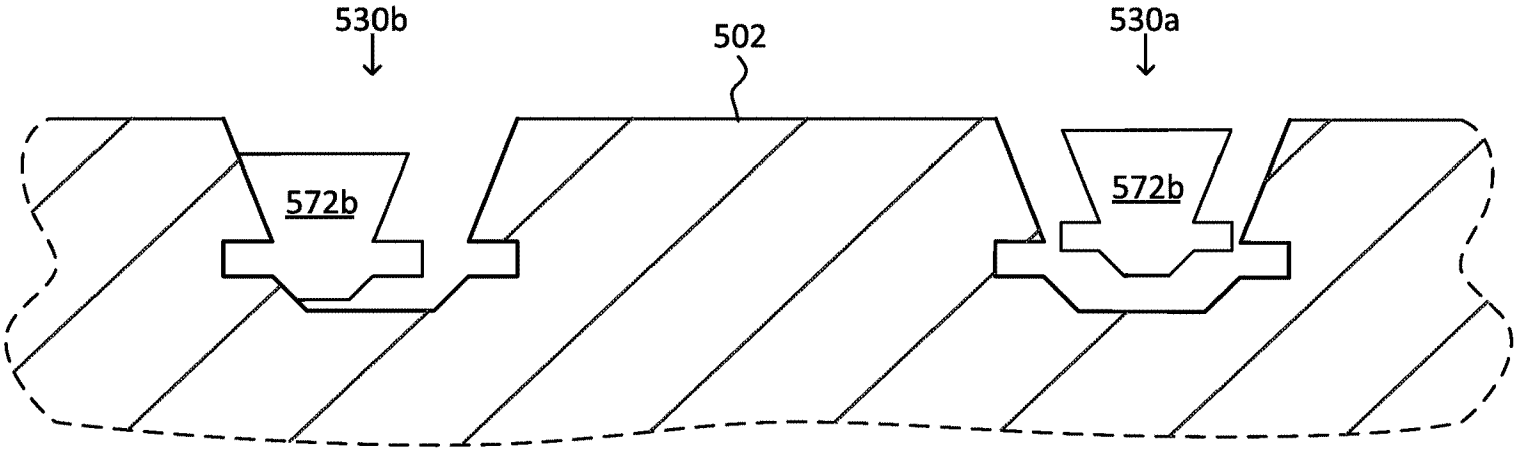
FIG. 5I is a cross-sectional view of a portion of a final club head body corresponding to a step in the flowchart of FIG. 5C for manufacturing the scorelines for a golf club head.

For a second example, mill bit 572*b* of FIG. 5I is illustrated as having a shape that is less wide than the cross-sectional width of the undercut grooves 530, such that the mill bit 572*b* is capable of exiting the undercut grooves 530 without interference from the sidewalls 534 of the undercut grooves 530. The mill bit 572*b* within the undercut groove 530*a* of FIG. 5I provides an illustration of this concept. In an implementation where the mill bit 572 is less wide than the cross-sectional width of the undercut grooves 530, the entry holes 538 may no longer be visible after the milling operations to create the undercut grooves 530 are completed.

For example, assuming the undercut grooves 530 are to extend in a toe to heel direction, the mill bit 572*b* may enter the entry holes 538 at a toe portion of the striking face 502, then mill into the sidewall of the entry holes 538 in a first direction toward the top portion 510 of the club head 500 to create the start of the undercut portion 570. Then, the mill bit 572*b* may make a first pass in a toe to heel direction across the striking face 502 until the desired length of the undercut groove 530 is reached. Next, the mill bit 572*b* may be offset in a direction toward the sole portion 512 of the club head 500 to create the undercut portion 570 that is opposite the first undercut portion 570, as illustrated in each of FIG. 5D-5I. Then, the mill bit 572*b* may make a second pass in a heel to toe direction across the striking face 502 back to the starting location where the mill bit 572*b* entered through the entry hole 538. Finally, the mill bit 572*b* may be offset to the middle of the just created undercut grooves 530 in order to allow for an exit of the mill bit 572*b* from the undercut grooves 530, such as that illustrated by mill bit 572*b* in undercut groove 530*a* of FIG. 5I. This process preferably effectively eliminates the appearance of entry holes 538 because the original dimensions of the entry holes 538 are now within the dimensions of the undercut grooves 530.

Referring particularly to FIG. 5E, the undercut grooves 530 have a variety of dimensions and characteristics that are determined based on the desired performance and feel of the club head, as will be explained in more detail below. First of all, the width w5 and the distance S2 preferably have similar values as the width w5 and the distance S2 of the initial grooves 330 and 430 as detailed in FIGS. 3C and 4B, respectively. In addition, the area A3 of the undercut grooves 530 is also preferably similar to that of the area A1 and A2 from FIGS. 3C and 4B, as explained above. As such, the pitch (w5+S2) to area A3 ratio of the undercut grooves 530 is preferably similar to that of the pitch (w5+S2) to area A2 ratio of the initial grooves 330 and 430 of FIGS. 3C and 4B, respectively. Ultimately, as explained in greater detail above with respect to the initial grooves 330 and 430 of FIGS. 3C and 4B, respectively, the pitch to area A3 ratio is preferably greater than 0.076 $mm^2$ (0.0030 $in^2$).

The width w1 is preferably between 0.36 mm and 1.02 mm (0.014 inch and 0.040 inch), more preferably between 0.41 mm and 0.89 mm (0.016 inch and 0.035 inch), and most preferably between 0.46 mm and 0.61 mm (0.018 inch and 0.024 inch), similar to that of the width w1 of the initial grooves 230, 330, and 430 explained above with respect to FIGS. 2C-2D, 3C and 4B, respectively. In addition, due to the sidewall geometry requirements in the Rules of Golf which state that the sidewalls 224 of the scorelines 204 cannot be converging, the width w1 is preferably equal to or less than the width w5 of the final grooves 504. The width w5 of the final grooves 504 is measured by using the 30 degree rule as outlined in the Rules of Golf.

The distance d4, which defines the total elevation of the undercut grooves 530, is also preferably similar to the distance d4 of the initial grooves 230, 330, and 430 of FIGS. 2C-2D, 3C, and 4B, respectively.

The distance d5 is defined as the elevation of the sidewalls 534 of the undercut grooves 530 below the undercut portions 570 of the undercut grooves 530. The distance d6 is defined as the thickness of the undercut portion 570 of the undercut grooves 530. The distance d5 and d6 preferably have a sum that is equal to the distance d1 of FIGS. 2C-2D. That is to say that the distances d5 and d6 preferably have a sum between 0.23 and 0.64 mm (0.009 inch and 0.025 inch), more preferably between 0.30 mm and 0.56 mm (0.012 inch and 0.022 inch), and most preferably between 0.36 mm and 0.51 mm (0.014 inch and 0.020 inch). The above mentioned ranges provide enough depth for the resilient inserts 518 that will occupy at least the area defined by d5 and d6 to provide adequate durability for the resilient inserts 518 while also allowing for the necessary resiliency desired of the resilient inserts 518 to accomplish the desired feel and spin characteristics of the golf club.

Although the distance d5 is defined in the illustration of FIG. 5E, the distance d5 in some implementations may be as close to zero as possible. That is to say, the base 576 of the undercut portion 570 in such an implementation also defines the base 532 of the undercut groove 530. However, in other implementations, such as that of FIG. 5E, the shape of the mill bit may form a portion of the undercut groove 530 that extends below the undercut portion 570 to create a distance d5 greater than zero. However, as discussed above with relation to the distances d5 and d6, the sum of the distances d5 and d6 is within the cited ranges, even in implementations where the distance d5 is zero.

Finally, the distance d7 is define as the total elevation of the sidewalls 534 of the undercut grooves 530. The distance d7 is preferably substantially the same as the sum of the distances d2 and d3 of the sidewalls 224 of the scorelines 204 of FIGS. 2C-2D. Flowchart 590 (at 596) includes locating resilient inserts within each of the plurality of undercut grooves. For example, referring to FIG. 5F, the resilient inserts 518 are located within the undercut grooves 530.

Flowchart 590 (at 596) includes locating resilient inserts within each of the plurality of undercut grooves. For example, referring to FIG. 5F, resilient inserts 518*a* and 518*b* (hereinafter collectively referred to as resilient inserts 518) are located within the undercut grooves 530*a* and 530*b*, respectively. The locating may be done by placing, filling, pouring, inserting, or any other method known in the art. The process and method used for locating may be done similarly to that described above with respect to FIGS. 3A-3E. In implementations where the resilient inserts 518 are fabricated to their final dimensions prior to being located within the undercut grooves 530, the resilient inserts 518 may be press fitted into the undercut grooves 530 such that the portion of the resilient inserts 518 dimensioned to fit within the undercut portions 570 of the undercut grooves 530 snap into place.

Flowchart 590 (at 598) includes forming final grooves in the striking face. For example, final grooves 504*a* and 504*b* (hereinafter collectively referred to as final grooves 504) are formed into the striking face 502. The final grooves 504 may be formed by any method known in the art including those recited above with respect to FIGS. 3A-3E and 4A-4D.

Additionally, the dimensions and characteristics of the scorelines 204 of FIGS. 2A-2D are consistent with the dimensions and characteristics of the final grooves 504 of FIG. 5G. As such, the ranges of values for the dimensions and characteristics of the striking face 502, the edges 526, the sidewalls 524, the base 522, the draft angle, and the transition portion 520 of the final grooves 504 correspond respectively to the striking face 202, the edges 226, the sidewalls 224, the base 222, the draft angle, and the transition portion 220 of the scorelines 204 of FIGS. 2A-2D.

Further, although the illustration of FIG. 5G shows the final grooves 504 with the transition portions 520 at the point where the base 522 meets the sidewall 524, it should be noted that the transition portion 520 could be anywhere along the sidewall 524 similar to that discussed above with reference to FIGS. 2A-2D. For example, the sidewalls 524 may comprise a portion that comprises the material of the striking face and a portion that comprises the material of the resilient inserts 518.

Ultimately, because the dimensions and characteristics of the final grooves 504 are similar to that of the scorelines 204 of FIG. 2A-2D, the primary difference between the golf club head 500 and the golf club head 200 is the undercut portion 570 of the final grooves 504 which enable additional flex of the sidewalls upon impact ultimately increasing the spin imparted onto the golf ball.

Now referring to FIGS. 6A-6F, in one or more embodiments a golf club head 600 may include a striking face insert 680 including a striking face 602, a resilient insert 682, and a main body 684. In such embodiments, the striking face insert 680 is formed by electroforming. The resilient insert 682 is located between the striking face insert 680 and the main body 684. The resilient insert 682 and the striking face insert 680 may be associated with the club head main body 684 by securement to, or affixing to, the club head main body 684. The club head 600 further includes a plurality of final scorelines 604, a toe portion 614, a heel portion 616, a top portion 610, a rear portion 617 opposite the striking face 602, and a sole portion 612. The club head 600 further includes hosel 606 for securing the club head 600 to a shaft 608.

In some embodiments, as will be described in greater detail below, the resilient insert 682 may form the base of the final scorelines on the striking face 602. In such an embodiment, the striking face insert 680 may have through holes at the base of the scorelines such that the striking face insert 680 forms only the striking face 602 and the sidewalls of the final scorelines, and the resilient insert 682 forms the base of the final scorelines. In other embodiments, the striking face insert 680 may form the entire final scorelines such that the resilient insert 682 is not visible and/or does not contact a golf ball upon impact with the striking face 602.

Figure 6A:
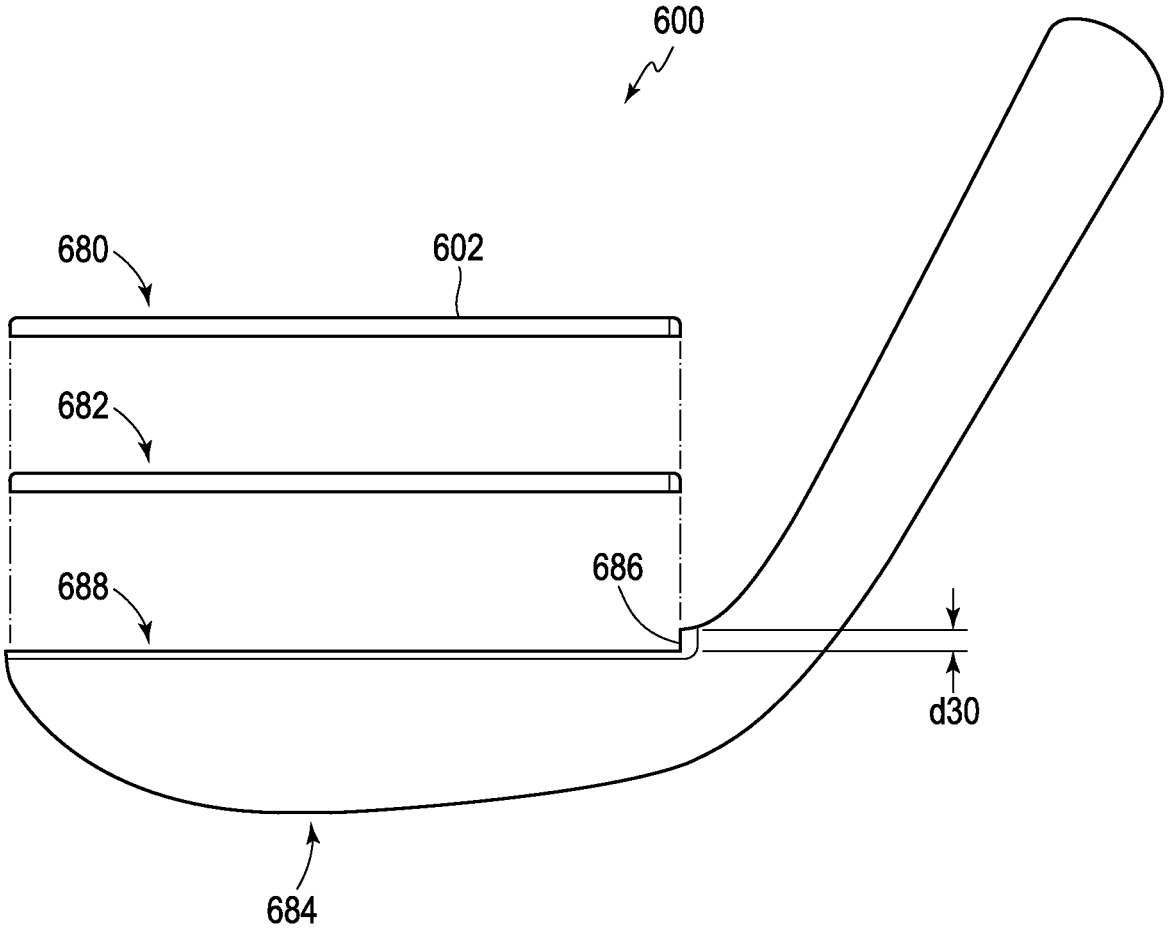
FIG. 6A is an exploded view of a golf club head according to an implementation of the present disclosure.
Figure 6B:
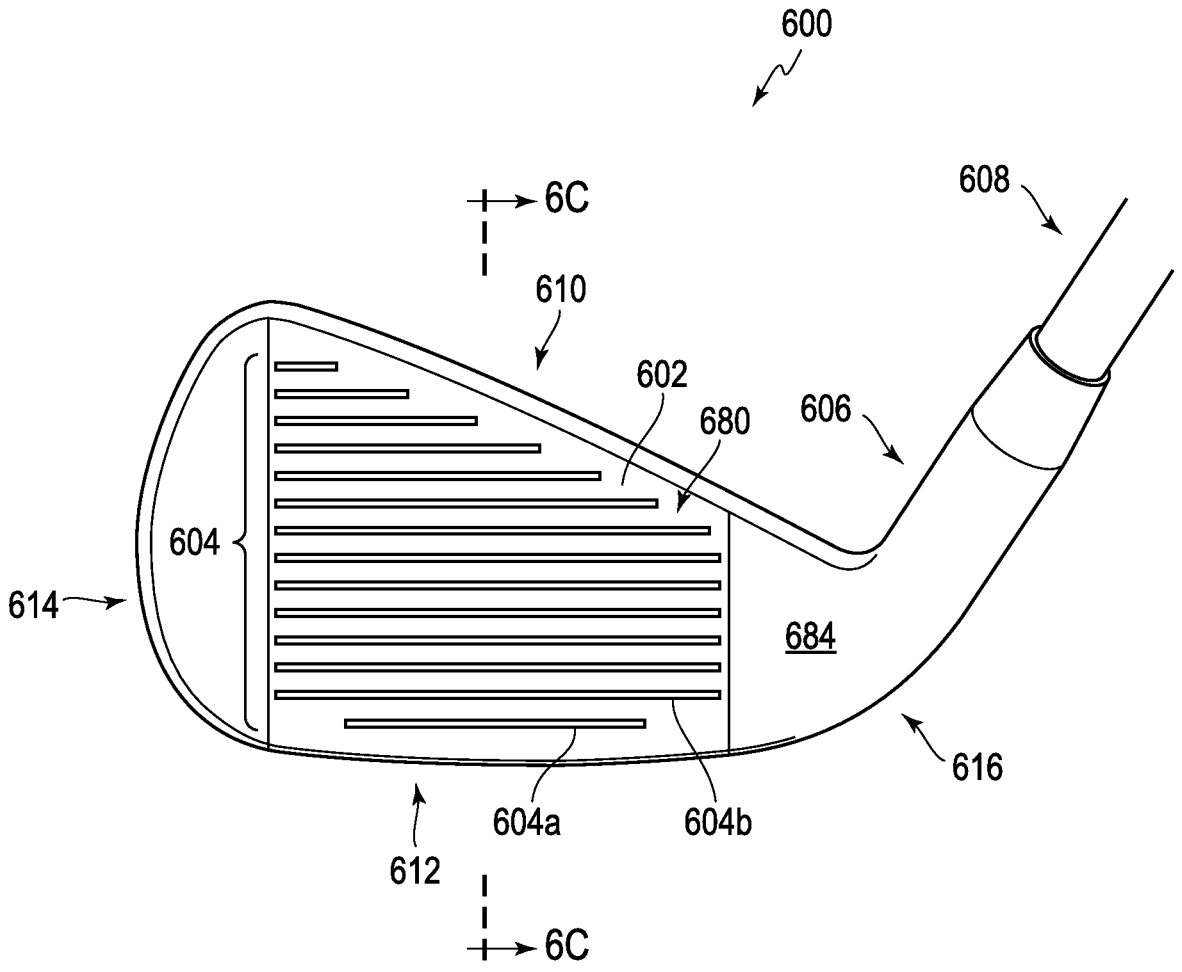
FIG. 6B is a front elevational view of the golf club head of FIG. 6A.

Now referring to FIG. 6B, FIG. 6B is a front elevation view of a golf club head according to an implementation of the present disclosure. Club head 600 of FIG. 6B includes striking face insert 680 which includes striking face 602 having final scorelines 604. The final scorelines 604 include, for example, final scoreline 604*a* and final scoreline 604*b*. The club head 600 further includes a toe portion 614, a heel portion 616, a top portion 610, a rear portion 617 (not shown) opposite the striking face 602, and a sole portion 612. The club head 600 further includes hosel 606 for securing the club head 600 to a shaft 608.

Figure 6C:
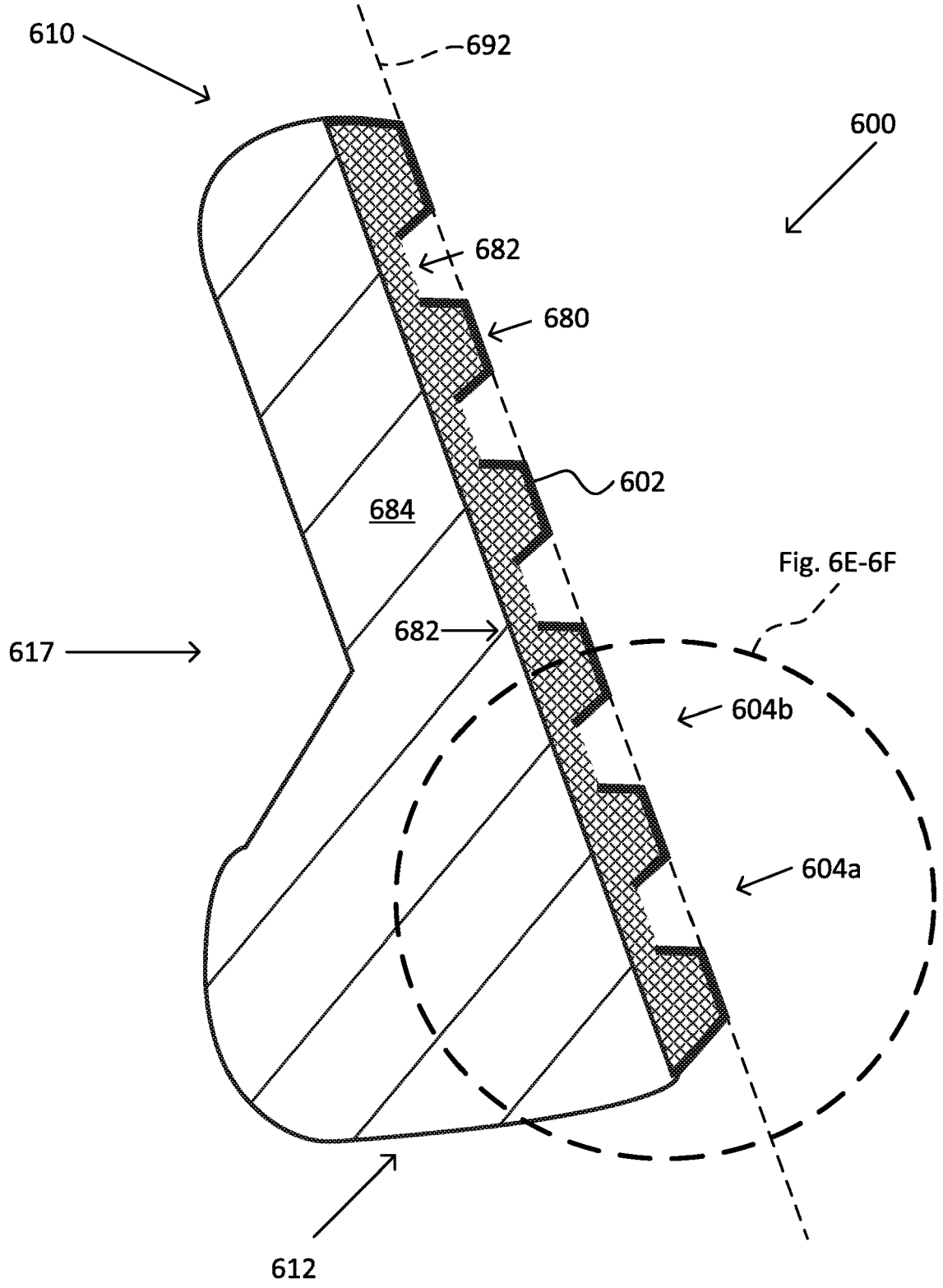
FIG. 6C is a cross-sectional view of a portion of the golf club head of FIG. 6B.

Now referring to FIG. 6C, FIG. 6C is a cross-sectional view of a portion of the golf club head of FIG. 6B. More specifically, FIG. 6C is a cross-sectional view of the club head 600 of FIG. 6B taken along plane 6C-6C. FIG. 6C includes the final scorelines 604, which includes the final scorelines 604*a* and 604*b*, the sole portion 612, the striking face insert 680 including the striking face 602, the rear portion 617 opposite the striking face 602, the club head body 684, and the resilient insert 682. The striking face 602 defines a plane 692.

Figure 6D:
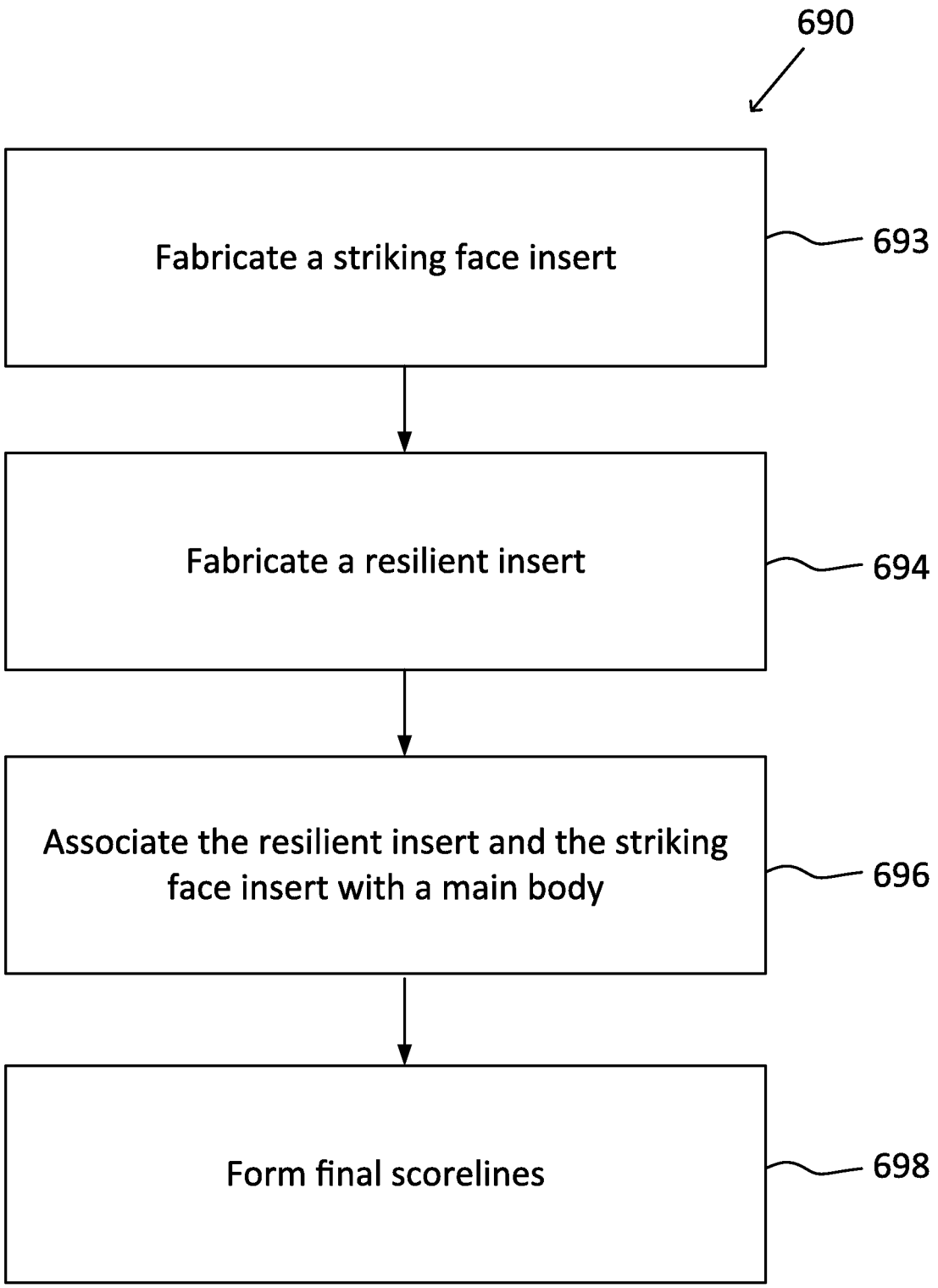
FIG. 6D is a flowchart exemplifying a process of manufacturing a golf club head according to an implementation of the present disclosure.

Now referring to FIG. 6D, FIG. 6D is a flowchart exemplifying a process of manufacturing a golf club head according to an implementation of the present disclosure. The approach and technique indicated by flowchart 690 are sufficient to describe at least one implementation of the present disclosure. However, other implementations of the disclosure may utilize approaches and techniques different from those shown in flowchart 690. Furthermore, while flowchart 690 is described with respect to FIGS. 6A-6B and 6E-6F, the disclosed inventive concepts are not intended to be limited by specific features shown and described with respect to FIGS. 6A-6C and 6E-6F. Furthermore, with respect to the method illustrated in FIG. 6D, it is noted that certain details and features may have been omitted in order not to obscure the discussion of inventive features in the present application.

Flowchart 690 (at 693) includes fabricating a striking face insert. For example, referring to FIG. 6A, the striking face insert 680 is fabricated utilizing any known method in the art. In some implementations, the striking face insert 680 of FIG. 6A is preferably formed by an electroforming process, as known to those of skill in the art. An exemplary method of electroforming is described in U.S. Pat. No. 9,033,819, specifically with reference to FIG. 6 and the accompanying text in column 6, line 58, through column 7, line 53. Preferably, the through holes at the bottom of the final scorelines 604 are formed during the electroforming process. In doing so, additional steps are not required to form the through holes in the final scorelines 604, thus minimizing the risk of manufacturing defects such as inconsistent through hole formation, dents in the grooves, and inconsistent face textures. However, implementations where the through holes are not formed during the electroforming process are described in more detail below.

It should be noted that fabricating the striking face insert 680 utilizing an electoforming process provides advantages over other methods known in the art, namely, more consistent fabrication with less manufacturing errors. In addition, more minute details, such as face texturing, are able to be included in the striking face insert 680 during an electroforming process, whereas more conventional methods require additional surface treatments to the striking face 602 after formation of the striking face insert 680. However, the striking face insert 680 may also, in some embodiments, be formed by casting, molding, or another method known in the art. In addition, whether the striking face insert 680 is formed by electroforming, or another method, additional surface treatments, such as milling, lasering, polishing, sandblasting, etc., may be performed on the striking face insert 680 after the striking face insert 680 is fabricated.

In implementations where the through holes of the final scorelines 604 are not fabricated during the electoforming process, the through holes may be machined into the striking face insert 680 after the electroforming process. In one implementation, the through holes may be formed by machining off the bottom of the scoreline from the back side (opposite the striking face 602) of the striking face insert 680. The machining may include milling, drilling, cutting, or any method known in the art. In another implementation, the through holes may be formed by laser cutting, such that the bottom of the scoreline is cut out from the back side of the striking face insert 680. The laser cutting may be done using fiber laser cutting, for example. In such an example, it may be necessary to subject the striking face insert 680 to an annealing heat treatment to prevent deformation of the striking face insert 680 due to extreme heats during the fiber laser cutting process.

It should also be noted that the through holes need not include the entire base of the scorelines, and that only a portion of the base of the scorelines may be removed during the through hole creation process. In such an example, the resilient insert 682 may ultimately only form a portion of the base of the final scorelines 604.

In implementations where the striking face insert 680 includes final scorelines 604 having a portion of the sidewalls 624 formed of the resilient insert 682, the striking face insert 680 may be formed with initial grooves having similar dimensions to those of the initial grooves 330 of FIG. 3C. As such, once the resilient insert 682 is formed, the initial grooves and the resilient insert 682 can be machined to form the final grooves 604 having similar dimensions to those of the final grooves 304 of FIG. 3E.

Figure 6E:
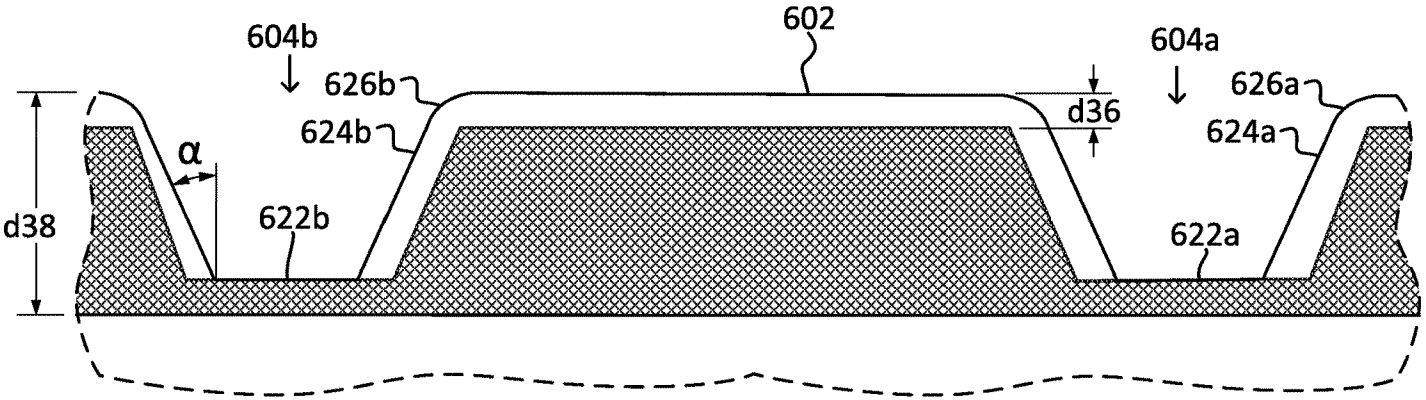
FIG. 6E is a cross-sectional view of a portion of the golf club head of FIG. 6C.

The striking face insert 680 has a thickness d36, as illustrated at least in FIG. 6E. The thickness d36 of the striking face insert 680 need not be consistent throughout the entire striking face insert 680. For example, the sidewall 624 portion of the striking face insert 680 may be thinner than the striking face 602 portion because the sidewalls 624 are not subjected to the same levels of impact as the striking face 602. In other embodiments, the striking face insert 680 may have a consistent thickness throughout.

Preferably, the thickness d36 is between 0.2 mm and 0.8 mm (0.008 inch and 0.031 inch), more preferably between 0.3 mm and 0.7 mm (0.012 inch and 0.023 inch), even more preferably between 0.4 mm and 0.6 mm (0.016 inch and 0.024 inch), and most preferably about 0.5 mm (0.020 inch). In addition, the thickness d36 may be dependent on the hardness of the resilient insert 682. For example, if the resilient insert 682 has a durometer hardness of between 70 and 80 Shore D, the thickness d36 may be between to 0.3 mm to 0.4 mm (0.012 inch and 0.016 inch). If the resilient insert 682 has a durometer hardness of between 60 and 70 Shore D, the thickness d36 may be between 0.4 mm and 0.5 mm (0.016 inch and 0.020 inch). If the resilient insert 682 has a durometer hardness value of between 50 and 60 Shore D, the thickness d36 may be between 0.5 mm and 0.6 mm (0.020 inch and 0.024 inch).

Flowchart 690 (at 694) includes fabricating a resilient insert. For example, referring to FIG. 6A, the resilient insert 682 is fabricated according to any known method in the art. In some implementations, preferably, the resilient insert 682 is formed of a resilient material including a resin material, such as a polyurethane material, including, for example, a thermoplastic polyurethane ("TPU"). An example of a TPU suitable for the resilient material of the resilient insert 682 is Surlyn, which is an ionomer resin ethylene copolymer found in golf balls. However, in other implementations, the resilient insert 682 may be formed of any material known in the art, including those materials discussed in this application with respect to resilient inserts.

The resilient material preferably has a durometer hardness of between 30 and 80 Shore D, more preferably between 50 and 75 Shore D, even more preferably between 55 and 70 Shore D, and most preferably about 66 Shore D. As described above, the hardness may be determined based on the thickness d36 of the striking face insert 680.

Figure 6F:
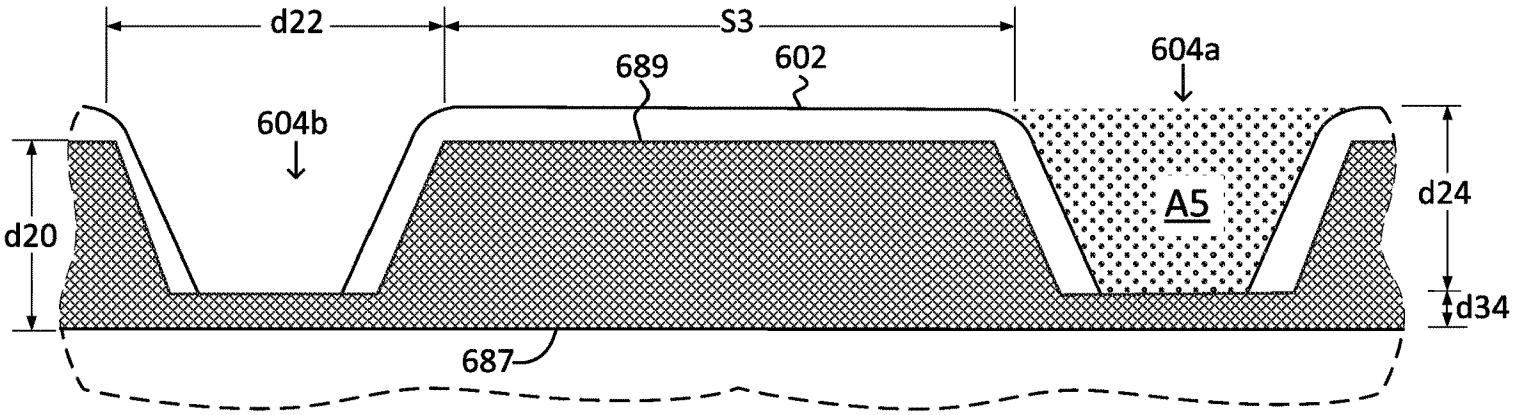
FIG. 6F is another cross-sectional view of a portion of the golf club head of FIG. 6C.

The resilient insert 682 also has a thickness d20, as illustrated in FIG. 6F, measured from the bottom portion 687 of the resilient insert 682 to the top portion 689 of the resilient insert 682. The thickness d20 is preferably between about 1.0 and 2.5 mm (0.04 inch and 0.01 inch), more preferably between about 1.2 mm and 2.0 mm (0.047 inch and 0.079 inch), even more preferably between about 1.4 mm and 1.7 mm (0.06 inch and 0.067 inch), and most preferably about 1.6 mm (0.06 inch).

The resilient insert 682 also has a thickness d34, as illustrated in FIGS. 6E-6F, measured from the bottom portion 687 of the resilient insert 682 to the base 622 of the scorelines 604. The thickness d34 is preferably between about 0.5 mm and 1.8 mm (0.020 inch and 0.071 inch), more preferably between about 0.75 mm and 1.5 mm (0.030 inch and 0.060 inch), even more preferably between about 0.9 mm and 1.2 mm (0.035 inch and 0.047 inch), and most preferably about 1.1 mm (0.043 inch).

The thicknesses d34 and d20 may be chosen based on the thickness d36 of the striking face insert 680 as well as the hardness of the resilient insert 682. For example, if the durometer hardness of the resilient insert 682 is between 70 and 80 Shore D, the thickness d20 may be between to 1.0 mm and 1.2 mm (0.04 inch and 0.047 inch) and the thickness d34 may be between 0.6 mm and 0.8 mm (0.023 inch and 0.031 inch). If the resilient insert 682 has a durometer hardness of between 60 and 70 Shore D, the thickness d20 may be between 1.2 mm and 1.7 mm (0.047 inch and 0.067 inch) and the thickness d34 may be between 0.8 mm and 1.3 mm (0.031 inch and 0.051 inch). If the resilient insert 682 has a durometer hardness value of between 50 and 60 Shore D, the thickness d20 may be between 1.7 mm and 2.5 mm (0.067 inch and 0.098 inch) and the thickness d34 may be between about 1.3 mm and 2.1 mm (0.051 inch and 0.083 inch).

In some implementations, the resilient insert 682 is formed by heating and pressing the resilient material into the back side of the striking face insert 680. In such implementations, the resilient insert 682 is bonded to the striking face insert 680. The resilient insert 682 may be associated with the striking face insert 680 such that the resilient insert 682 forms the base 622 of the final scorelines 604. If the resilient insert 682 is associated in this manner, the final scorelines 604 may have the design discussed below with respect to FIGS. 6E and 6F, where only the bases 622 of the final scorelines 604 are formed by the resilient insert 682.

However, in some implementations, during fabrication of the resilient insert 682 and/or during association of the resilient insert 682 with the striking face insert 680, the resilient material may overflow into the through holes of the scorelines from the rear of the striking face insert 680 such that the resilient insert 682 at least partially fills the scorelines. In such implementations, the resilient insert 682 may be further machined to form final scorelines 604 where the resilient insert 682 only forms the base. In implementations where the resilient inserts 682 only form the base, such as where the resilient material that overflowed into the scorelines is removed from the scorelines by milling, drilling, or another machining method, the final scorelines 604 may have characteristics and dimensions similar to those discussed below with respect to FIGS. 6E and 6F, where only the bases 622 of the final scorelines 604 are formed by the resilient insert 682.

In other implementations where the resilient material overflows into the through holes of the scorelines, the resilient inserts 682 may form more than just the base of the final scorelines 604. For example, only a portion of the resilient material that overflows into the through holes may be machined away. Similar to the implementations of FIGS. 2A-2D, 3A-3E, and 4A-4D described above, the resilient insert 682 may also form a portion of the sidewalls 624 of the final scorelines 604. More specifically, in such an implementation, the dimensions and characteristics of the scorelines 204 of FIGS. 2A-2D are consistent with the dimensions and characteristics of the final scorelines 604. In addition, in implementations where the resilient insert 682 forms more than just the base 622 of the final scorelines 604, the striking face insert 680 may be fabricated to include initial grooves having similar dimensions and characteristics to the initial grooves 430 of FIG. 4B, for example. In such implementations, the resilient insert 682 is placed within the initial grooves, and optionally further machined, to form the final scorelines 604 having the desired dimensions and characteristics.

The total thickness d38, as illustrated in FIG. 6E, of the striking face insert 680 and the resilient insert 682 after association with one another is preferably between 1.0 mm and 3.0 mm (0.040 inch and 0.12 inch), more preferably between about 1.5 mm and 2.5 mm (0.060 inch and 0.98 inch), even more preferably between about 1.75 mm and 2.25 mm (0.069 inch and 0.089 inch), and most preferably about 2.0 mm (0.079 inch).

Dimensioning the total thickness d38, the thickness d36, the thickness d20, and the hardness of the resilient insert 682 in the manner described above allows for the positive performance characteristics that come with having a resilient insert 682 to be accomplished while simultaneously not dramatically affecting the overall mass and mass distribution characteristics of the golf club head. For example, if the total thickness d38 were to be greater than 5.0 mm, too much mass may be lost due to the size of the striking face insert 680 and due to the resilient material of the resilient insert 682 not having as much mass as the metallic material it replaces. In order to compensate for such a great loss of mass, the overall look and feel (as a result of, e.g., CG location, MOI values, etc.) of the golf club may be modified and ultimately differ from the look and feel that golfers are accustomed to. Also, if the total thickness d38 were too thin, such as less than 1.0 mm, the performance benefit from the resilient insert 682 may be lost because the impact on performance may be too minimal. This same logic can be applied to the other dimensions and characteristics of the striking face insert 680 and the resilient insert 682.

Flowchart 690 (at 696) includes associating the resilient insert and the striking face insert with a main body. For example, referring to FIGS. 6A and 6B, the resilient insert 682 and the striking face insert 680 are associated with an insert region 688 of the main body 684. In some implementations, the resilient insert 682 and the striking face insert 680 are associated with the main body 684 as two separate components. In such implementations, the resilient insert 682 may be associated with the insert region 688 of the main body 684 by bonding, adhesive, or any other known method in the art. For example, the resilient insert 682 may be heated and bonded to the main body 684 prior to association of the striking face 680 with the main body 684. Once the resilient insert 682 is associated with the main body 684, the striking face insert 680 may be associated with the main body 684. The striking face insert 684 may be associated with the main body 684 by welding, brazing, bonding, soldering, or any other known method in the art. In addition, the striking face insert 680 may be bonded to the resilient insert 682. For example, the striking face insert 680 may be welded to the main body 684 and adhesively associated with the resilient insert 682.

In other implementations, as described above with reference to step 694, the resilient insert 682 may be associated with the striking face insert 680 prior to associating the resilient insert 682 and the striking face insert 680 with the main body 684. In such an implementation, the resilient insert 682 may be bonded to, adhesively attached to, or similarly associated with the striking face insert 680 prior to association with the main body 684. In such implementations, the striking face insert 680 resilient insert 682 pairing may be associated with the main body 684 by welding, brazing, bonding, soldering, or another known method in the art.

Preferably, the association of the striking face insert 680 and the resilient insert 682 with the main body 684 creates surfaces having smooth transitions between the main body 684 and the striking face insert 680 as well as the resilient insert 682. In order to accomplish this, it is preferable that the main body 684 have an offset 686 at least partially bordering the insert region 688 of the main body 684 adapted to receive the striking face insert 680 and the resilient insert 682. The offset 686 may at least border the heel portion of the insert region 688 adapted to receive the striking face insert 680 and the resilient insert 682, as illustrated in FIG. 6A. However, the offset 686 may also border the toe, top, and sole portions of the insert region 688. In some embodiments, the striking face insert 680 and/or the resilient insert 682 may extend to the top and/or bottom portion of the main body such that the striking face insert 680 and/or resilient insert 682 are visible when looking at the sole portion and/or top portion of the club head. In other embodiments, the offset 686 may extend around at least two of the toe, heel, top, and sole portions of the golf club head such that the main body 684 forms at least a portion of the striking face 602 adjacent the offset 686 around the at least two portions. For example, the offset 686 may border the entire insert region 688 such that the striking face insert 680 and the resilient insert 682 are completely bordered by the main body 684.

Once the striking face insert 680 and the resilient insert 682 are associated with the main body 684, further machining operations may be completed to ensure smooth transitions and secure association between and among the striking face insert 680, the resilient insert 682, and the main body 684. For example, transition portions (i.e., portions of the main body 684 immediately adjacent the striking face insert 680 and/or the resilient insert 682) between the striking face insert 680 and/or the resilient insert 682 and the main body 684 may undergo blasting, milling, sanding, lasering, or any other known method in the art to create the desired look of the club head. In some implementations, the desired look may include continuous smooth transition portions with similar surface finishing between the striking face insert 680 and the main body. However, in other implementations, the desired look may include a finished offset between the striking face insert 680 and the main body 684, or may include a contrast in finishes (e.g., blasted vs. polished) between the main body 684 and the striking face insert 680. Having a contrast in finishes between the striking face insert 680, the resilient insert 682, and/or the main body 684 provides an indication of the latent properties of the club head, including but not limited to the presence of the resilient insert 682, the presence of the striking face insert 680, or an indication of the optimal impact locations on the club head 600 (e.g., the scoreline region of the striking face).

As such, the offset 686 is preferably dimensioned to enable the smooth transitions portions described above. As such, the offset 686 has a distance d30 substantially equal to the total thickness d38 described above. Thus, the distance d30 is preferably between 1.0 mm and 3.0 mm (0.039 inch and 0.012 inch), more preferably between about 1.5 mm and 2.5 mm (0.059 inch and 0.098 inch), even more preferably between about 1.75 mm and 2.25 mm (0.069 inch and 0.089 inch), and most preferably about 2.0 mm (0.079 inch), depending on the total thickness d38. It should be noted that in some implementations, depending on the surface treatments and bonding treatments to be performed on the striking face insert 580, the resilient insert 682, and the main body 584, the distance d30 and the total thickness d38 may differ by between 0.05 to 0.2 mm (0.002 inch and 0.008 inch). This difference allows at least one of the main body 684, the striking face insert 680, and the resilient insert 682 to have material removed by milling, drilling, sanding, blasting, lasering, or any other treatment known in the art to create the desired transition regions between the main body 684, the striking face insert 680, and the resilient insert 682, as explained above.

Flowchart 690 (at 698) includes forming final scorelines. For example, referring to FIG. 6E-6F, the final scorelines 604 are formed. In implementations where the striking face insert 680 is electroformed, the final scorelines 604 are primarily formed during the electroforming process. As described above with respect to step 694, forming the resilient inserts 682 is the final process to forming the final scorelines 604. For example, as described above, the resilient inserts 682 may be fabricated to form only the base 622 of the final scorelines 604, or may be fabricated to form a the base 622 and a portion of the sidewalls 624 of the final scorelines 604. The dimensions of the final scorelines 604, including, for associated embodiments, the dimensions of the portion of the sidewalls 624 formed by the resilient insert 682, are similar to the dimensions and characteristics described above with respect to the scorelines 204 of FIGS. 2A-2D. In addition, the preferable dimensions and characteristics of the final scorelines 604 are further outlined below.

The final scorelines 604 may be designed to be in compliance with USGA regulations. These final scorelines 604 may therefore preferably have an average width d22 between 0.6 mm and 0.9 mm (0.024 inch and 0.035 inch), more preferably between 0.65 mm and 0.8 mm (0.026 inch and 0.031 inch), and even more preferably between 0.68 mm and 0.75 mm (0.027 inch and 0.030 inch). For all purposes herein, and as would be understood by those of ordinary skill in the art, scoreline width is determined using the "30 degree method of measurement," as described in Appendix II of the current USGA Rules of Golf (hereinafter "Rules of Golf"). The final scorelines 604 may have an average depth d24, measured according to the Rules of Golf, of no less than 0.10 mm (0.004 inch), preferably between 0.25 mm and 0.60 mm (0.010 inch and 0.024 inch), more preferably between 0.30 mm and 0.55 mm (0.012 inch and 0.002 inch), and most preferably between 0.36 mm and 0.44 mm (0.014 inch and 0.017 inch). To further comply with USGA regulations, the draft angle $\alpha$ of the final scorelines 604 as that term would be construed by one of ordinary skill may be between 0 and 25 degrees, more preferably between 10 and 20 degrees, and most preferably between 13 and 19 degrees. And the groove edge effective radius of the final scorelines 604, as outlined in the Rules of Golf, may be between 0.150 mm and 0.30 mm (0.006 inch and 0.012 inch), more preferably between 0.150 mm and 0.25 mm (0.006 inch and 0.010 inch), and most preferably between 0.150 mm and 0.23 mm (0.006 inch and 0.009 inch). Ultimately, the final scorelines 604 dimensions may be calculated such that:

$$A5/d22+S3\leq 0.076\ \text{mm}^2(0.0030\ \text{in}^2),$$

where A5 is the cross-sectional area of the final scorelines 604, d22 is their width, and S is the distance between edges of adjacent final scorelines 604, as outlined in the Rules of Golf.

Now referring to FIGS. 7A-7F, in one or more embodiments a golf club head 700 may include a striking face insert 780 including a striking face 702, a resilient insert 782, and a main body 784 defining a hollow region 785. In such embodiments, the striking face insert 780 may be formed by electroforming, casting, molding, milling, or any method known in the art. The resilient insert 782 is located between the striking face insert 780 and the main body 784. The resilient insert 782, as will be described in greater detail below, is formed by pouring resilient material into the hollow region 785. The resilient insert 782 and/or the striking face insert 780 may be associated with the club head main body 784 by securement to, or affixing to, the club head main body 784. The club head 700 further includes a plurality of final scorelines 704, a toe portion 714, a heel portion 716, a top portion 710, a rear portion 717 opposite the striking face 702, and a sole portion 712. The club head 700 further includes hosel 706 for securing the club head 700 to a shaft 708.

Figure 7A:
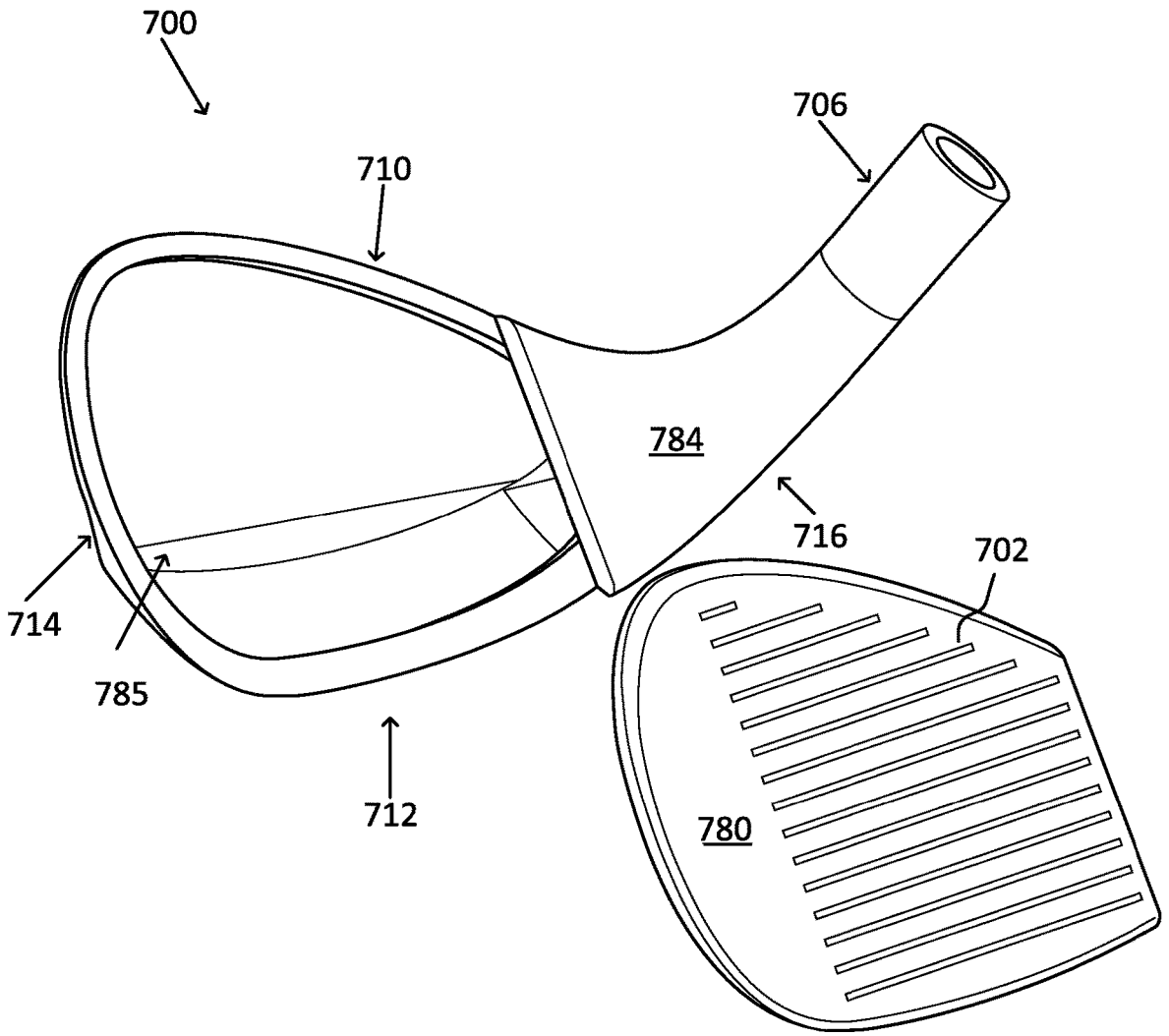
FIG. 7A is an exploded view of a golf club head according to an implementation of the present disclosure.

Referring to FIG. 7A, FIG. 7A is an exploded view of a golf club head according to an implementation of the present disclosure. More specifically, FIG. 7A includes the golf club head 700 in an exploded view without the resilient insert 782 in order to more clearly illustrate the hollow region 785. The striking face insert 780 is shown removed from the main body 784, and the main body 784 has a hollow region 785 defined by the rear portion 717, the toe portion 714, the heel portion 716, the top portion 710, and the sole portion 712. The hollow region 785 is further defined by the rear side of the striking face insert 780 when the striking face insert 780 is associated with the main body 784. In the final club head, the hollow region 785 is at least partially filled by resilient material to form the resilient insert 782.

Figure 7B:
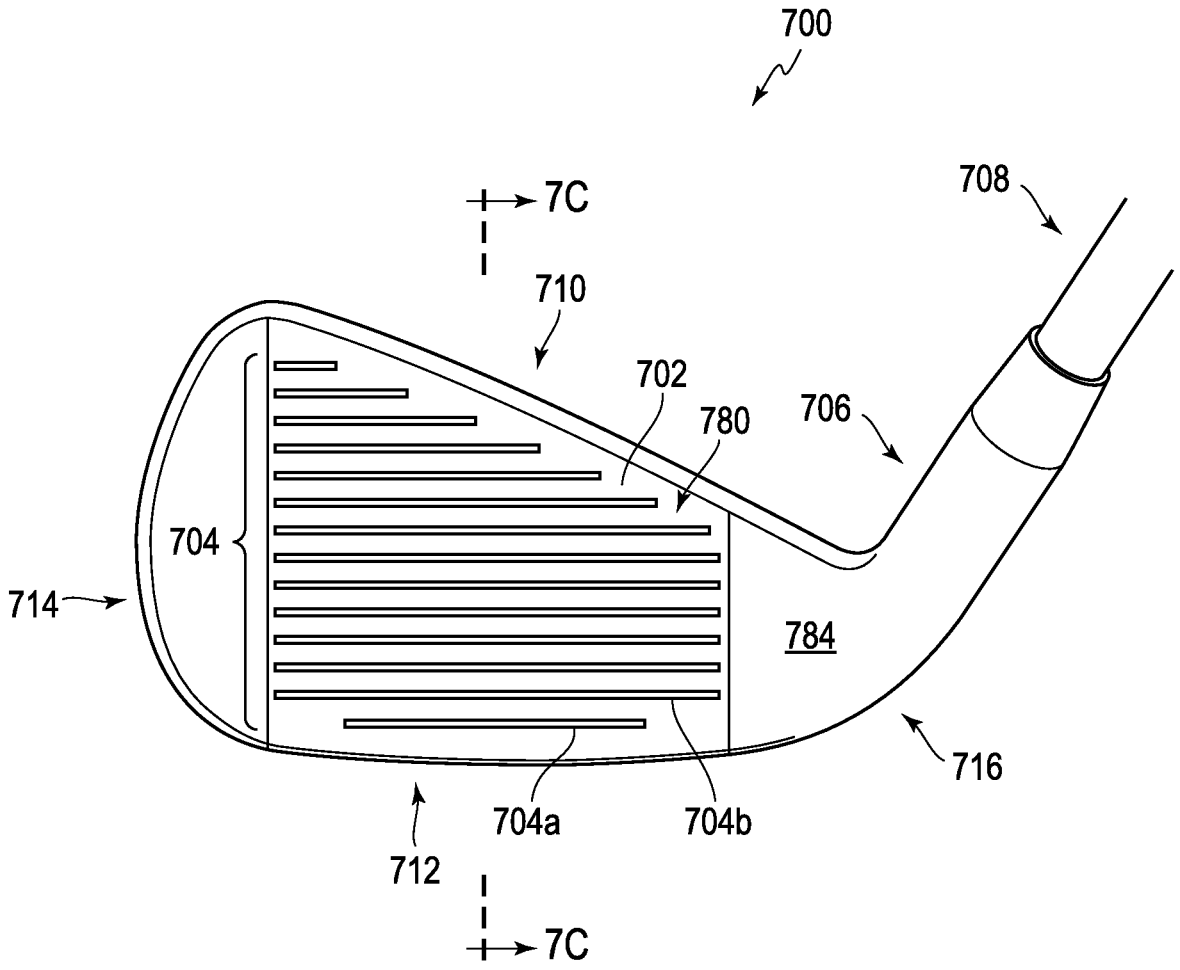
FIG. 7B is a front elevational view of the golf club head of FIG. 7A.
Figure 7C:
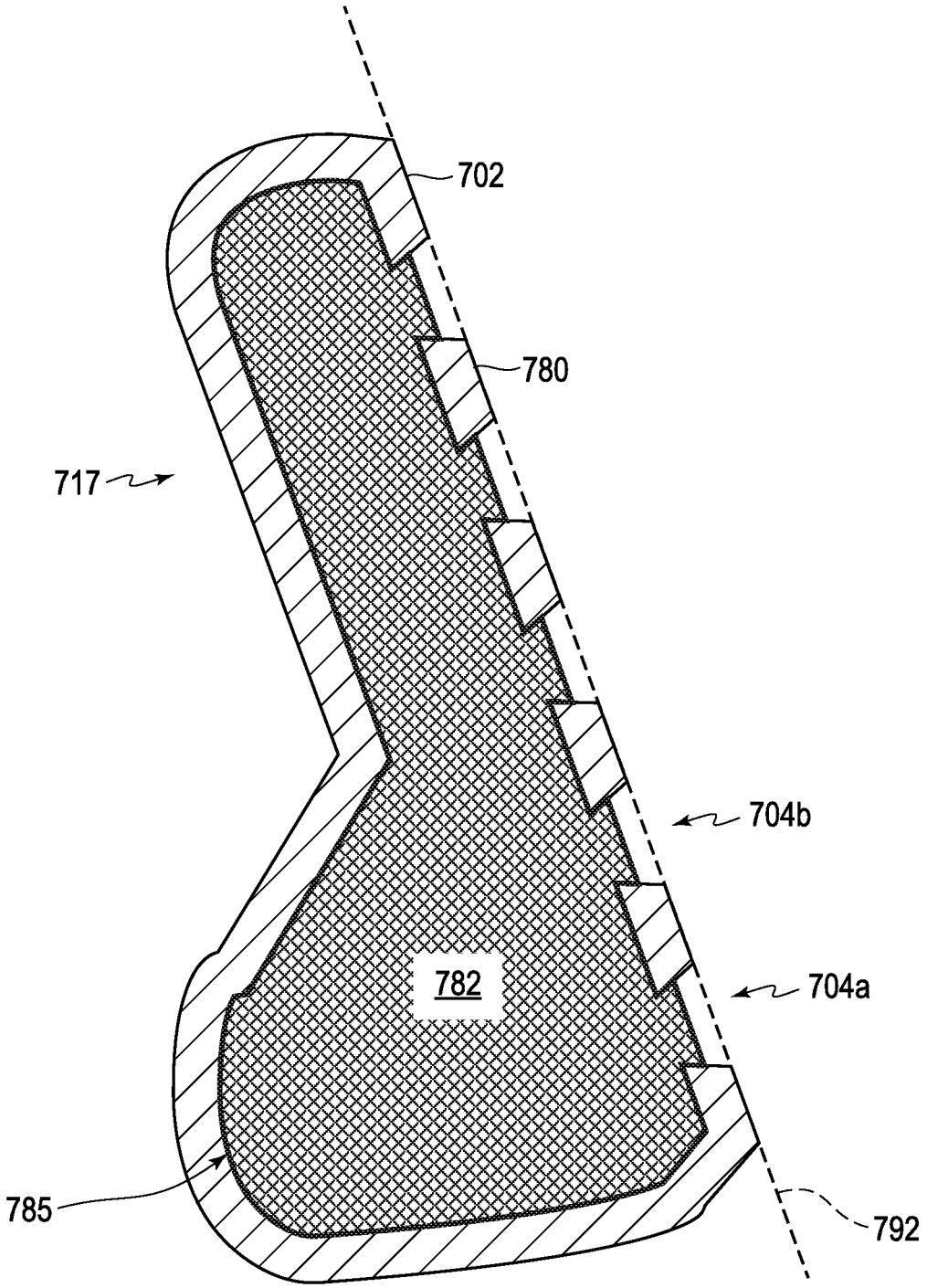
FIG. 7C is a cross-sectional view of a portion of the golf club head of FIG. 7B.

Referring to FIG. 7C, FIG. 7C is a cross-sectional view of the golf club head of FIG. 7B. In the implementation illustrated in FIG. 7C, the golf club head 700 has the hollow region 785 completely filled with the resilient insert 782. In addition, the resilient insert 782 partially extends through the final scorelines 704 to make a portion of the sidewalls of the final scorelines 704. In such an implementation, the dimensions and spacing of the final scorelines 704 are similar to those of the scorelines 204 of FIGS. 2C-2D.

However, the implementation of FIG. 7C is not intended to be limiting. In some implementations, the resilient insert 782 may not fill the entire hollow region 785. For example, the resilient insert 782 may only fill the muscle portion, or the blade portion of the club head 700. For another example, the resilient insert 782 may only extend partially into the hollow portion 785. In such an example, the resilient insert 782 may be associated with the rear of the striking face insert 780 and extend a distance from the rear of the striking face insert 780 into the hollow region 785, such that the hollow region maintains a portion that is absent any material. The resilient insert 782 in such an example may have a thickness similar to that of the thickness d38 of the resilient insert 682 of the club head 600, described above, such that the resilient insert 782 extends only partially into the hollow region 785.

Further, in some implementations the resilient insert 782 may not form any part of the sidewalls 724 of the final scorelines 704. In such implementations, the resilient insert 782 may form only the base 722 of the final scorelines 704. In such an implementation, the final scorelines 704 may have similar dimensions and characteristics to that of the final scorelines 604 of the club head 600 described above.

In yet another implementation, where the striking face insert 780 does not include through holes in the final scorelines 704, the resilient insert 782 may not form any part of the final scorelines 704.

Figure 7D:
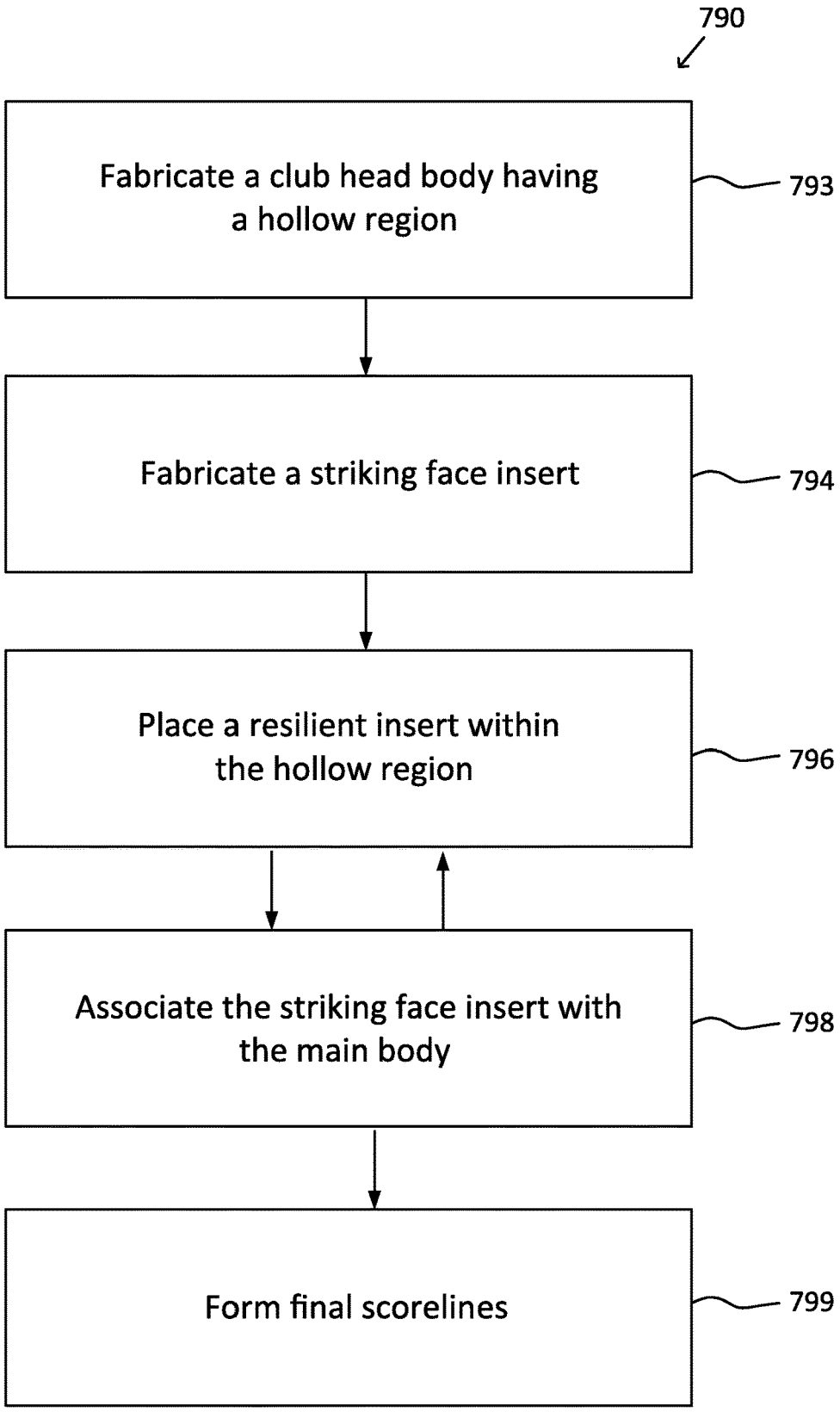
FIG. 7D is a flowchart exemplifying a process of manufacturing a golf club head according to an implementation of the present disclosure.
Figure 7E:
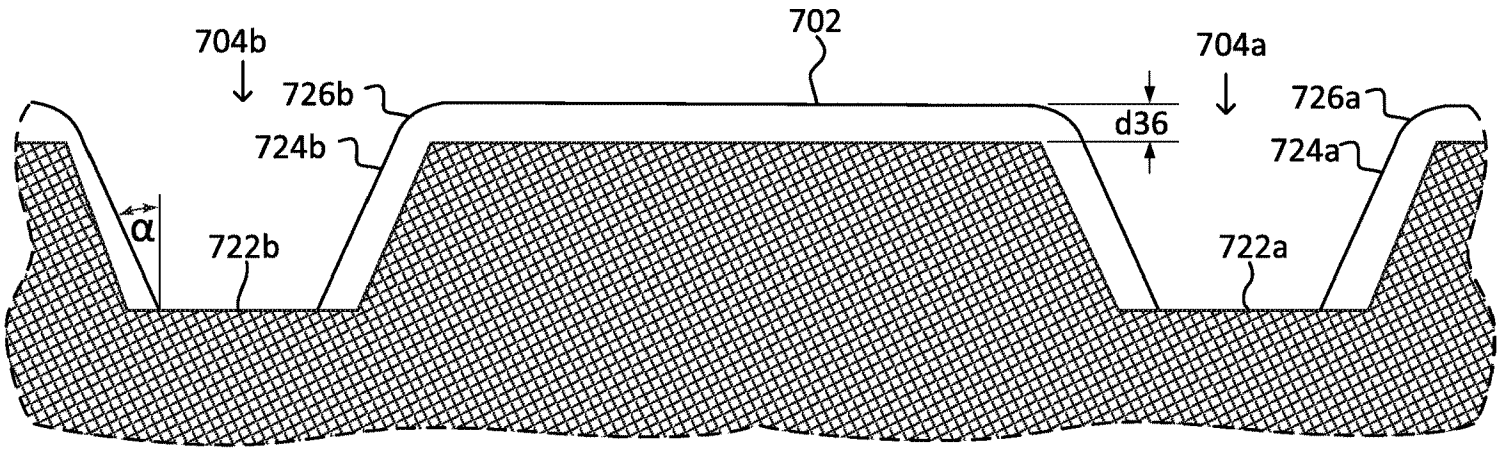
FIG. 7E is a cross-sectional view of a portion of the golf club head of FIG. 7C.
Figure 7F:
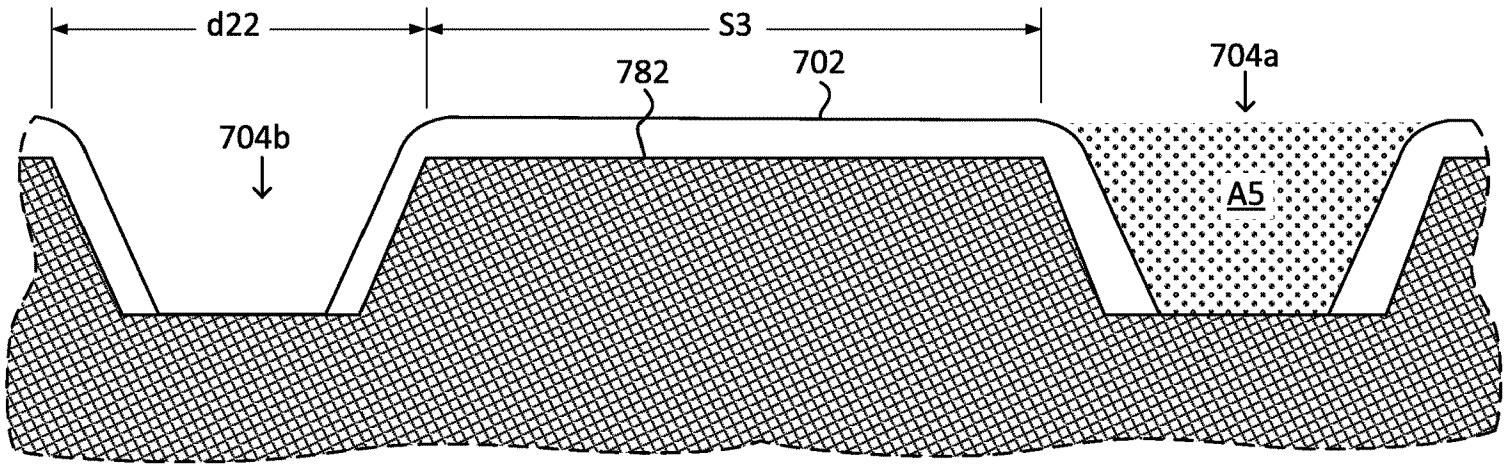
FIG. 7F is another cross-section view of the portion of the club head of FIG. 7C.

Now referring to FIG. 7D, FIG. 7D is a flowchart exemplifying a process of manufacturing a golf club head according to an implementation of the present disclosure. The approach and technique indicated by flowchart 790 are sufficient to describe at least one implementation of the present disclosure. However, other implementations of the disclosure may utilize approaches and techniques different from those shown in flowchart 790. Furthermore, while flowchart 790 is described with respect to FIGS. 7A-7C and 7E-7F, the disclosed inventive concepts are not intended to be limited by specific features shown and described with respect to FIGS. 7A-7C and 7E-7F. Furthermore, with respect to the method illustrated in FIG. 7D, it is noted that certain details and features may have been omitted in order not to obscure the discussion of inventive features in the present application.

Flowchart 790 (at 793) includes fabricating a club head body having a hollow region. For example, the main body 784 of club head 700 is fabricated to have the hollow region 785. The hollow region 785 may extend into any portion of the club head, including the muscle portion and/or the blade portion of the club head 700.

Flowchart 790 (at 794) includes fabricating a striking face insert. For example, the striking face insert 780 is fabricated by any method known in the art, such as electroforming (as described above with respect to FIGS. 6A-6F), casting, molding, milling, and the like. The striking face insert 780 is preferably fabricated to include through holes at the base of the final scorelines 704 allowing at least a portion of the final scorelines 704, e.g. the sidewalls 724 and/or the base 722, to be formed by the resilient insert 782. However, in some implementations, the final scorelines 704 of the striking face insert 780 may not have through holes.

The striking face insert 780 may be formed to have the same thickness as the thickness d36 of the striking face insert 680.

In implementations where the striking face insert 780 includes final scorelines 704 having a portion of the sidewalls 724 formed of the resilient insert 782, the striking face insert 780 may be formed with initial grooves having similar dimensions to those of the initial grooves 330 of FIG. 3C. As such, once the resilient insert 782 is formed, the initial grooves and the resilient insert 782 can be machined to form the final grooves 704 having similar dimensions to those of the final grooves 304 of FIG. 3E.

Flowchart 790 (at 796) includes placing the resilient insert within the hollow region. For example, the resilient insert 782 is placed within the hollow region 785 of the club head 700. In addition, as described above, the resilient insert 782 may also form part of the final scorelines 704 such that the placement of the resilient insert 782 further includes placement within the scorelines of the striking face insert 780.

The resilient insert 782 may comprise any of a variety of materials. Including any of the materials discussed above with respect to resilient inserts, including TPU, resin, plastic, rubber, metal, or the like. As also discussed above, the characteristics of the material may change dependent on the feel desired by the club head 700.

The resilient insert 782 may be placed by a variety of methods. In some implementations, the resilient material may be melted and poured into the hollow region 785 to form the resilient insert 782. This may be done through the hosel, for example, so long as the hosel includes a hollow opening that extends into the hollow region 785.

In another implementation, the resilient material may be melted and poured through the scorelines 704 of the striking face insert 780 once the striking face insert 780 is associated with the main body 784. In such an implementation, the resilient material may be melted and poured through the scorelines until the hollow region 785 is filled to the desired level.

In yet another implementation, the resilient material may be melted and poured into the hollow region 785 prior to association of the striking face insert 780 with the main body 784. In such an implementation, the striking face insert 780 may be associated with the main body 784 after the resilient material has been poured into the hollow region 785. It should be noted that in this implementation, the resilient insert 782 may be formed prior to placement within the hollow region 785, and may be placed within the hollow region 785 in a non-liquid state prior to association of the striking face insert 780 with the main body 784.

Flowchart 790 (at 798) includes associating the striking face insert with the main body. For example, the striking face insert 780 is associated with the main body 784 by bonding, welding, brazing, soldering, or any other metal associating methods known to those of ordinary skill in the art. It should be noted that steps 798 and 796 may be switched. For example, the striking face 780 may be associated with the main body 784 and the resilient insert 782 may then be placed within the hollow region 785 by melting and pouring through the hosel or through the scorelines as described above. In another example, the resilient insert 782 may be placed within the hollow region 785 prior to the striking face insert 780 being associated with the main body 784. In such an example, the resilient insert 782 may be pre-fabricated and placed within the hollow region 785, or may be melted and poured into the hollow region 785 prior to associating the striking face insert 780 with the main body 784.

It should be noted that once the striking face insert 780 and the resilient insert 782 are associated with the main body 784, the club head 700 may undergo additional surface treatments, including sanding, blasting, milling, polishing, or any other treatments to create the desired look of the club head 700. For example, the additional surface treatments may create smooth transitions between the striking face insert 780 and the main body 784, and also may be utilized to create desired surface contrasts.

Flowchart 790 (at 799) includes forming the final scorelines. The final scorelines 704 may be formed similar to the final scorelines 604 of FIGS. 6A-6C and 6E-6F. For example, if the resilient insert 782 penetrates the through holes at the bottom of the scorelines, the scorelines may be milled, drilled, or otherwise machines to create the desired final scorelines 704. The desired final scorelines 704 may include final scorelines 704 formed having the base 722 and a portion of the sidewalls 724 formed of the resilient insert 782, or may include final scorelines 704 formed having just the base 722 formed of the resilient insert 782, or may be formed where the resilient insert 782 does not form any portion of the final scorelines 704. The final scorelines 704 thus may have dimensions and characteristics similar to that of the scorelines 204 of FIGS. 2C-2D or of the final scorelines 604 of FIGS. 6E-6F, as described above. It should also be noted that the spacing of the final scorelines 704 on the striking face insert 780 are similar to that of the spacing of the scorelines 204 of FIGS. 2C-2D.

Each of club heads 200, 300, 400, 500, 600, 700, and 800 are designed to generate the desired spin on a golf ball at impact with the club head. As mentioned above, the resilient material of the resilient inserts, especially the presence of the resilient inserts as part of or surrounding the scorelines, enables the scorelines to deform more than standard metallic scorelines. This increase in deformation creates a longer time of contact between the outer shell of the golf ball and the scorelines at impact, as well as allows more surface are of the golf ball and the scorelines to come into contact thus creating increased spin on the golf ball. Additionally, utilizing resilient inserts provides a higher static coefficient of friction than standard metallic materials and thereby enables increased accommodation of fluid and debris during impact with a golf ball, ultimately resulting in increased spin on imparted on the golf ball.

As further described throughout this disclosure, golfers expect a certain feel from a golf club in addition to having the desired spin. In an effort to create a club head that has the desired feel golfers are looking for at impact while simultaneously imparting greater spin on to the golf ball than prior art club heads, a significant amount of testing was performed to determine the proper materials, dimensions, characteristics, and implementations for the resilient inserts. Those materials, dimensions, characteristics, and implementations are described above with respect to the club heads 200, 300, 400, 500, 600, 700, and 800.

Referring to FIGS. 8A-8G, in one or more embodiments a golf club head 800 include a top portion 802, a bottom portion 804, a heel portion 806 and a toe portion 808. A hosel 810 extends from top portion 802 and is adapted to secure a conventional golf shaft 812 to the golf club head 800 thereby forming a golf club. The golf club head 800 further includes a striking face 814 being generally planar and having formed therein a plurality of grooves (or scorelines) 816. Preferably, the grooves 816 extend parallel to each other and more preferably extend and are elongate in a heel to toe direction. The golf club head 800 as shown comprises a putter-type golf club head. However, features of the striking face 816 as described in further detail below may alternatively be applied in like manner to striking faces embodied in other types of golf club heads, e.g. iron-type, wedge-type, wood-type, or hybrid-type.

Figure 8A:
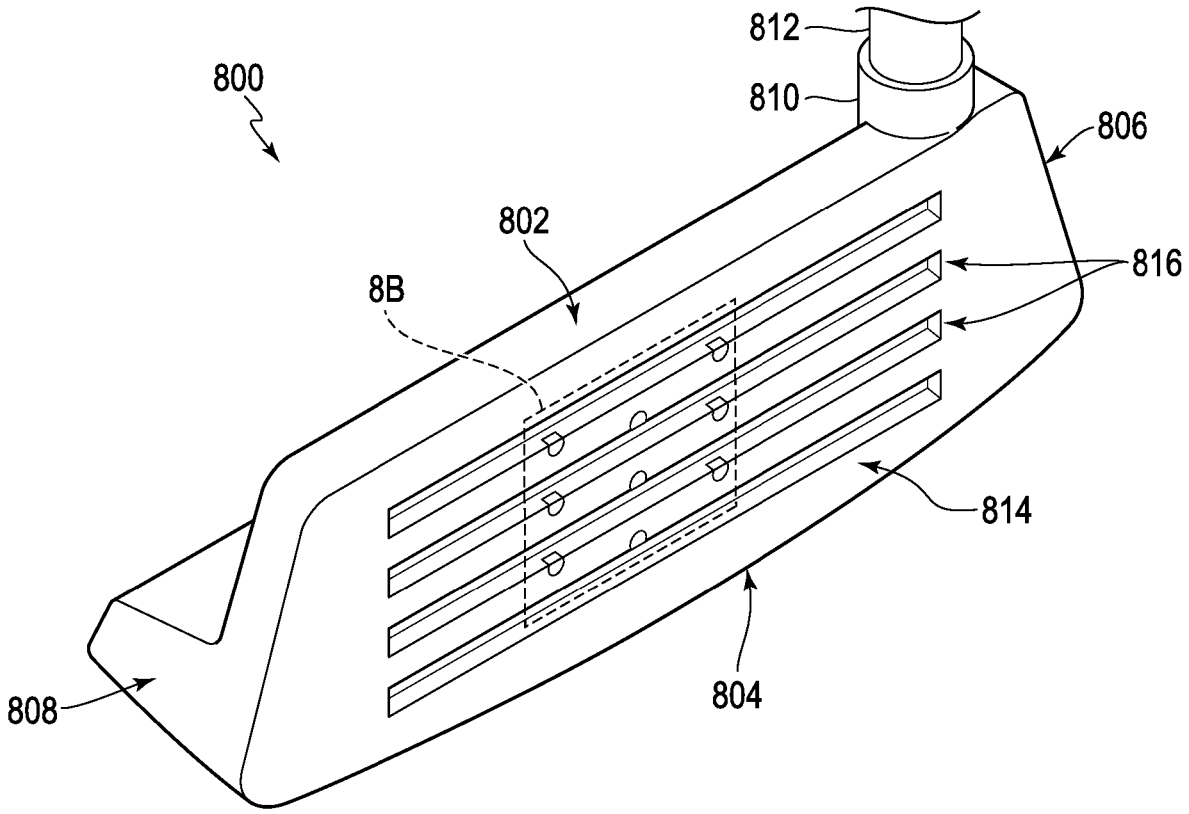
FIG. 8A is a perspective view of a golf club head in accordance with one or more aspects of the present disclosure.
Figure 8B:
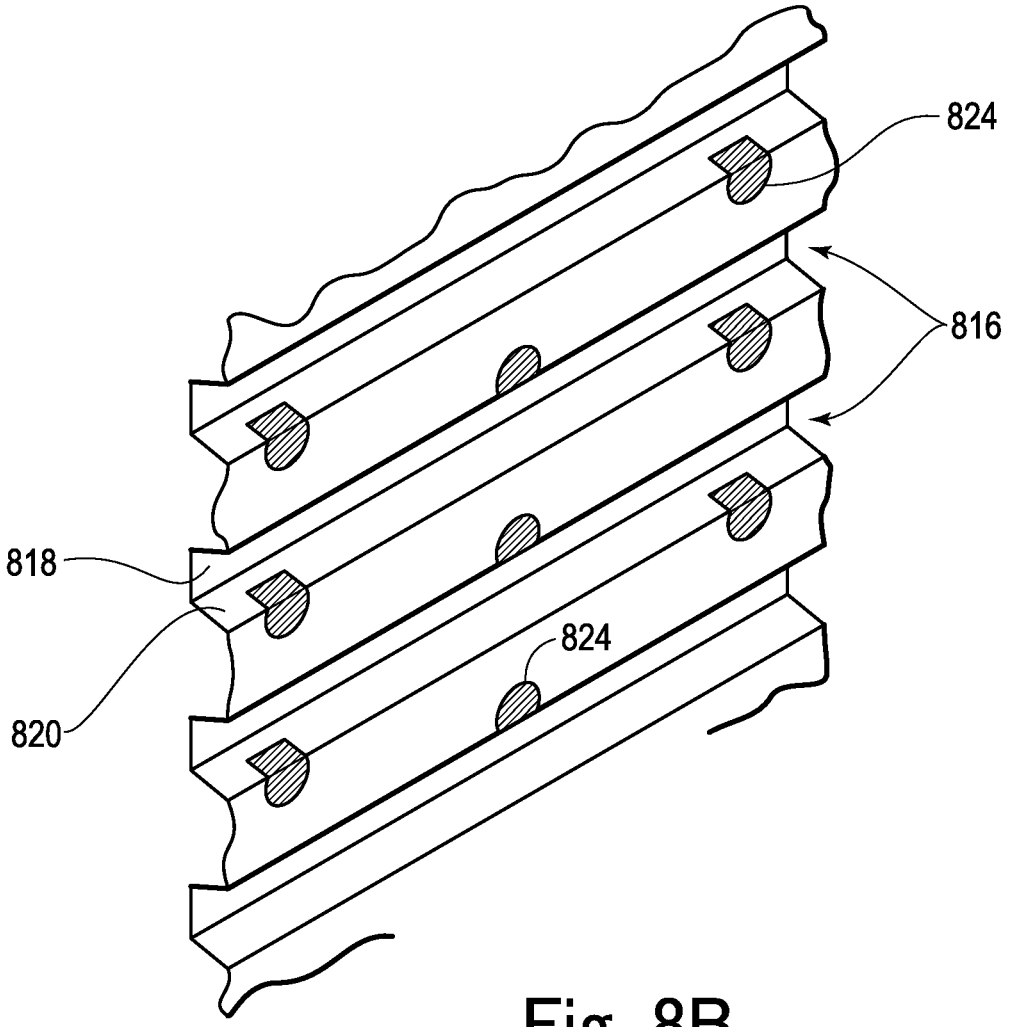
FIG. 8B is a detail view of a portion of the golf club head of FIG. 8A.

Referring specifically to FIGS. 8A and 8B, the grooves 816 each include a bottom surface 818, and opposing sidewalls 820 and 822. The sidewalls 820 include one or more recesses 824. Each of the recesses 824 are preferably filled with a first material different from a second material constituting adjacent portion of the sidewall and/or striking face. Preferably the first material comprises a material having a hardness (e.g. durometer) less than the hardness of the second material. More specifically, the first material preferably comprises a hardness no greater than 150 Rockwell R, more preferably greater than or equal to 20 Shore A and less than or equal to 90 Shore D, more preferably between about 45 Shore D and 75 Shore D. Preferably, the second material constitute the majority of the striking face impact area and comprises a hardness no less than about 10 Rockwell B, more preferably no less than about 50 Rockwell B, and most preferably between about 70 Rockwell B and 90 Rockwell B. The first material preferably comprise a polymeric material, e.g. polyurethane, thermoplastic polyurethane, polyethylene, synthetic rubber, synthetic resin, or polyamide. Preferably, the second material comprises a metallic material, e.g. copper, stainless steel, titanium, aluminum, zinc, or alloys and combinations thereof. In alternative embodiments, however, both the first material and the second material comprise metal or metal alloys, albeit preferably with different material properties such as hardness. Similarly, in other alternative embodiments, the first and second materials each comprise a polymeric material, albeit preferably with different properties, e.g. hardness.

Figure 8C:
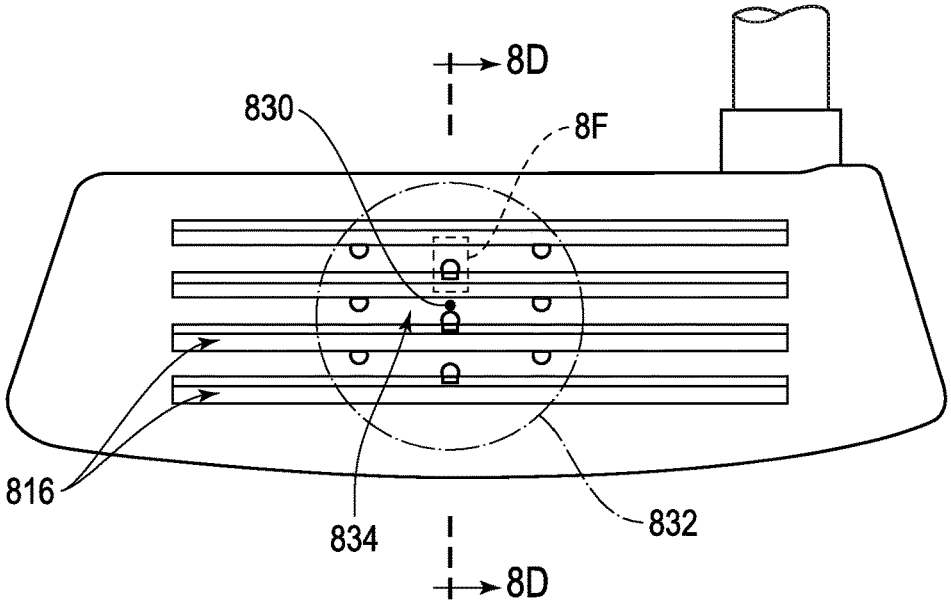
FIG. 8C is a front elevation view of the golf club head of FIG. 8A.
Figure 8D:
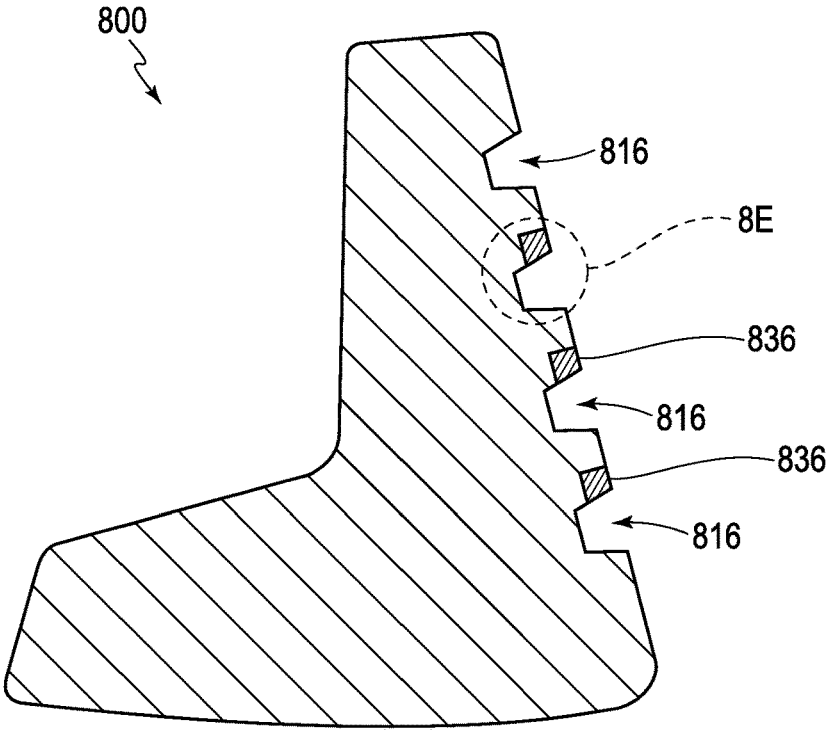
FIG. 8D is a cross-sectional view of the golf club head of FIG. 8A through cross-section.

As shown in FIG. 8C, the recesses 824 formed into the plurality of grooves 816 are dispersed about the striking face 814. In some aspects, the plurality of recesses 824 are dispersed in a random pattern. In other aspects, the plurality of recesses are substantially equally spaced from each other, forming a geometric array. In some such aspects, the plurality of recesses are aligned in a plurality of vertical columns and, in some cases, also laterally aligned and, in other cases, staggered such that adjacent such recesses 824 are vertically offset in the lateral (or heel-to-toe) direction. Preferably, the recesses 824 are generally concentrated in a central area of the striking face 814. E.g. preferably, a greater number (or density) of such recesses 824 are located within a central region 834 of the striking face 814 defined by all points on the striking face 814 within an imaginary circle 832 drawn on the striking face 814, centered at the face center 830, and having a radius equal to the radius of a conventional golf ball (e.g. 21.35 mm). In some such aspects, each of the plurality of recesses 824 are located within such central region 834.

Additionally, or alternatively, for any particular groove 816, plural recesses 824 are formed therein, e.g. formed in the sidewalls thereof, e.g. sidewalls 820(*a*) and 820(*b*). In some such aspects, such recesses 824 are evenly dispersed on upper sidewalls and respective lower sidewalls, such that pairs of recesses 824 are vertically aligned for corresponding upper and lower sidewalls 820(*a*) and 820(*b*) of the grooves 816. However, in alternative aspects, in the heel to toe direction, recesses 824 alternate from being formed in the upper sidewall 820(*a*) to being formed in the lower sidewall 820(*b*), e.g. in a staggered pattern (as shown, e.g., in FIG. 8C). Other patterns are also contemplated. For example, in some aspects, the frequency of recesses 824 gradually increases toward the center from either the toe, the heel, or both the toe and heel.

Figure 8E:
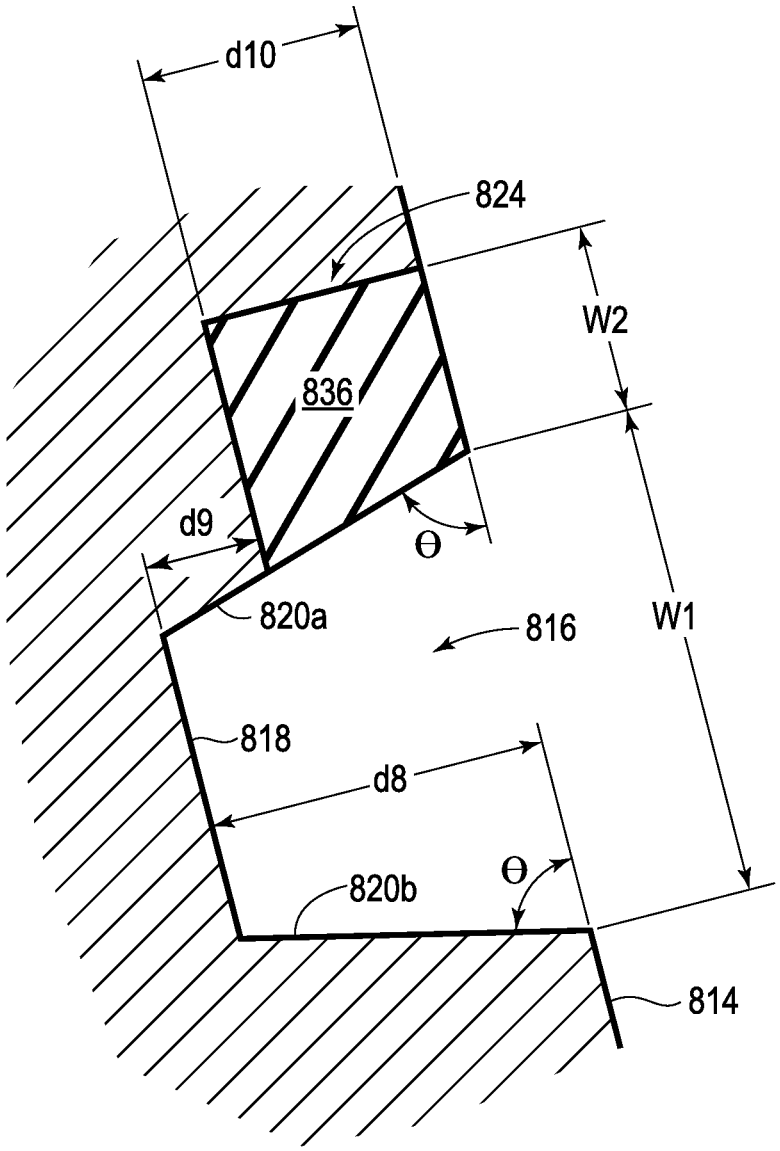
FIG. 8E is a detail view of a portion of the golf club head of FIG. 8A.

As shown particularly in FIGS. 8B and 8E, each of the recesses 824 intersects with, and opens to, a sidewall, e.g. sidewall 820, and the striking face 814. Preferably, the recesses 824 extend only partially of the full depth of the grooves 816, thereby forming a stepped region between the recesses 824 and respective bottom surfaces 818 of the grooves 816. However, in alternative embodiments, one or more recesses 824 extend the full depth of the grooves 816 thereby having recess bottom surfaces that are substantially flush with the bottom surfaces 818 of the grooves 816. Such configuration may maximize the volume capable of containing a distinct material, such as a resilient and/or vibration-absorbing material, e.g. as described above. In yet alternative aspects, the recesses 824 extent a depth from the striking face 814 that is greater than a depth of the grooves 816. In some such aspects, some of the recesses 824 extend fully through the striking face 814 thereby constituting through-bores.

Alternatively, or in addition, the depths of the recesses 824 vary from recess to recess. For example, in some aspects, depth increases toward the face center 830. Such configuration may provide increase vibration damping at locations undergoing greater average stress due to repeated impact of the striking face with a golf ball during play. Alternatively, or in addition, the depths of the recesses 824 vary in either the top to bottom direction, or in the bottom to top direction. Preferably, depth increases in the top to bottom direction, which, if such recess are filled with a resilient material, may result in a de-lofting effect, counter-acting potential over-lofting resulting from contact, between the striking face 814 and a golf ball, at a location relatively low on the striking face 814 (e.g. below the face center 830).

Referring to FIG. 8E, an exemplary recess 824 of the plurality of recesses 824 is shown in cross-section 8D (see FIG. 8C). A groove (or scoreline) 816 extends from the striking face 814 a depth d8. The groove 816 is delimited by an upper sidewall 820(*a*), a lower sidewall 820(*b*) opposite the upper sidewall 820(*a*), and a bottom surface 818. The depth d8 is preferably no less than 0.1 mm, and more preferably between 0.1 mm and 4 mm. The sidewalls 820(*a*) and 820(*b*) are preferably inclined relative to the bottom surface 818 and preferably each form an interior draft angle θ relative to the general plane of the striking face 814 of between 60° and 95°, and more preferably between 75° and 90°. However, in some aspects, the sidewalls 820*a*(*a*) and 820(*b*) are substantially perpendicular to the general plane of the striking face 814.

The recess 824 preferably extends a depth d10, measured perpendicularly relative to the general plane of the striking face 814. Preferably, the depth d10 is less than the depth of the grooves d8. More specifically, preferably, the depth d10 of the recess 824 is no greater than 0.80×d8, more preferably no greater than 0.50×d8, even more preferably between 0.10×d8 and 0.50×d8.

Such configurations ensure a sufficient volume for housing, e.g., a resilient material (e.g. resilient filler material 836) for generating beneficial golf-ball/striking face interaction-related properties. For example, such a resilient material 836 occupying a volume characterized in terms of the parameters described above may provide greater way upon impact, thereby better accommodating debris and water during such impact and, as a result, increasing the purity of interaction between a golf ball (e.g. of an elastomeric-coated type) and the metallic (or otherwise harder) surface regions of the striking face 814 peripheral to the recess 824 and/or forming edges and contours of grooves 816. Additionally, or alternatively, such configurations increases the extent of metallic edge per unit impact area, which edges may be considered particularly effective at engaging with a golf ball to induce appropriate spin (as opposed to a golf ball contacting a generally planar metallic portion). Varying the depth d10 may be related to the degree to which impact behaves like the filler material 836 as compared with, e.g., metallic material surrounding the filler material 836. E.g., greater depth of d10 may correlate with normal impact (between the striking face 814 and a golf ball) that bears impact properties more similar to known impact properties of the filler material 836, e.g. vibration damping and/or vibratory wave propagation attributes.

The depth d9 corresponds the depth of the step defined by the contour of the sidewall 820(*a*) of the groove 816 and the recess 836. The depth d9 is preferably no less than 0.20×d8, more preferably no less than 0.50×d8, even more preferably between 0.50×d8 and 0.90×d8.

Figure 8F:
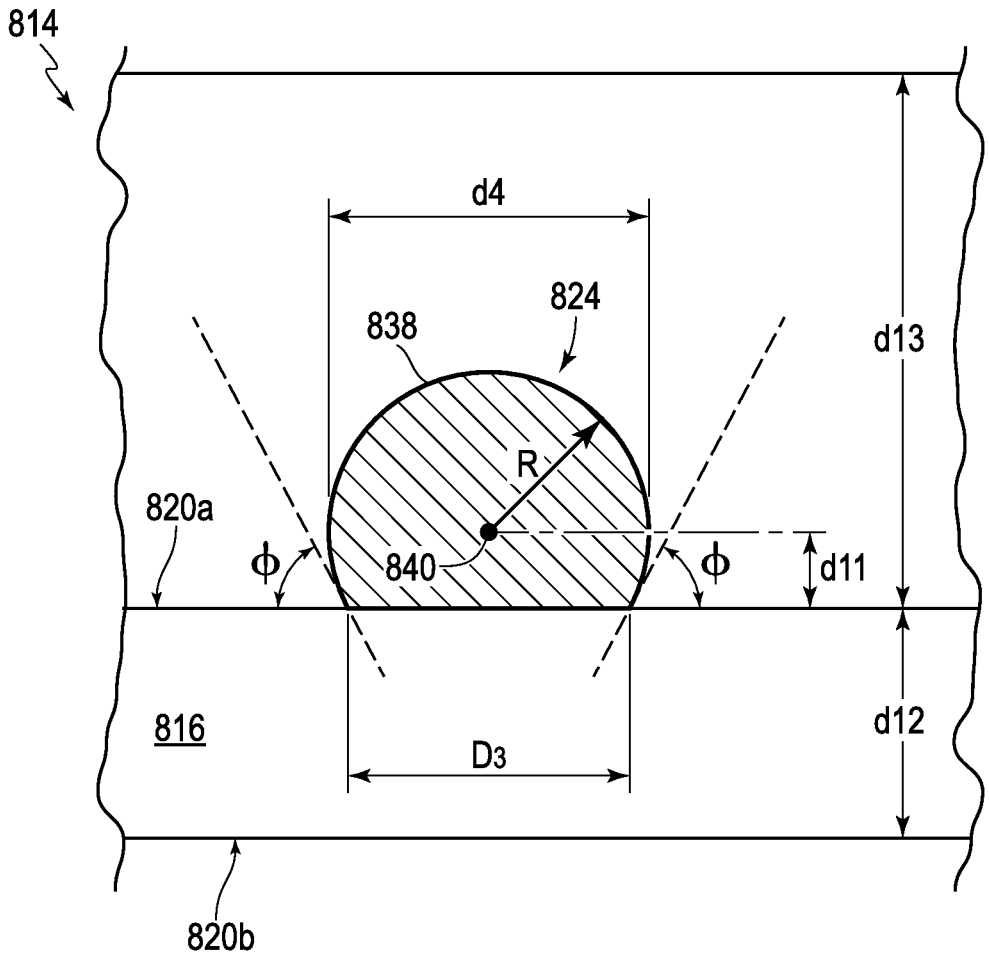
FIG. 8F is a detail of a portion of the perspective view of FIG. 8A.

Referring to FIG. 8F, the portion 8F of the striking face 814, as shown in FIG. 8A, is illustrated in greater detail. As shown, the recess 824 (and corresponding filler material 836), as viewed in front elevation, bears the shape of a portion of a circle 838. Preferably, the recess 824 is configured such that a virtual center 840 of such circle 838 is located outside of the periphery of groove 816 (i.e. preferably above the groove 816 if the recess 824 intersects an upper sidewall 820(*a*) of the groove 816 and below the groove 816 if the recess 824 intersects a lower sidewall 820(*b*) of the groove 816).

Preferably the groove 816 comprises a groove width, d12. In some embodiments, preferably, the groove width d12 is generally constant over the length of the groove 816. Furthermore, the groove width d12 is preferably constant from groove to groove through each of the plurality of grooves 816 (as shown particularly in e.g. FIG. 8C). However, in alternative embodiments, the groove depth, d12, varies along the length of the groove 816, and/or from groove to groove throughout the plurality of grooves 816. Each of the plurality of grooves 816 are also preferably spaced from each other by a distance, d13, which is preferably constant between each adjacent pair of grooves 816 of the plurality of grooves 816. However, in alternative embodiments, the spacing d13 may vary.

The center 840 of the circle 838 is spaced from the sidewalls 820 of the groove 816 by a distance, d11, that is no less than 0.05×d12, more preferably no less than 0.10×d12, and even more preferably no less than 0.25×d12. Additionally, the distance d11 is no greater than 0.50×d13, and more preferably no greater than 0.25×d13. The radius R of the recess 824 is preferably less than d11. Preferably R is no less than 0.10×d11, and/or no greater than 0.50×d11.

Additionally, or alternatively, the circumference of the circle 838 intersects with the upper sidewall 820(*a*) to form an interior angle, (I), that is no greater than 90°, more preferably between 2° and 90°, more preferably between 40° and 85°, even more preferably between 45° and 85°.

The above attributes are believed to provide advantages such as ensuring that filler material 836 remains intact within the recess 824, and is not easily removed, e.g., by shearing during typical use. As a result, the need for aft-applied (or pre-applied) adhesive, or a relatively high hardness material, is reduced. Materials of greater resilience (or flexibility or ductility) may be implemented as the filler material 836 without concern of "bounce out." In addition, in similar manner as described above, these attributes increase groove edge extent per unit impact area, resulting in improved, or purer, interaction between a golf ball and the striking face 814. However, such attributes also acknowledge that, say, an angle $\phi$ that is too great may result in manufacturing difficulties and/or sharp corners, which may be easily damaged, easily wear, or cause injury.

Figure 8G:
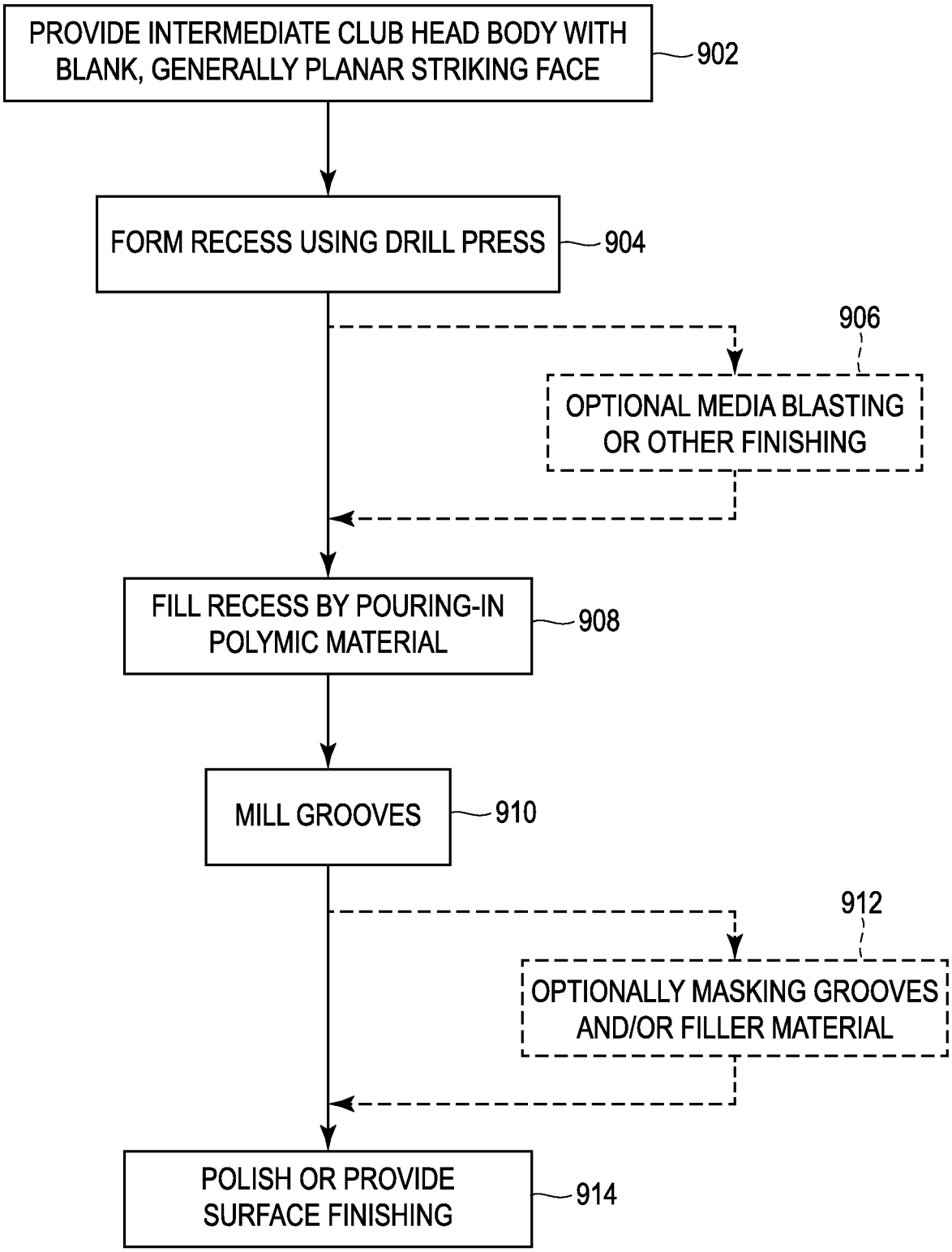
FIG. 8G is a flowchart exemplifying a process of manufacturing a golf club head according to an implementation of the present disclosure.

Referring to FIG. 8G, an exemplary process is described for manufacturing various golf club head aspects shown in FIGS. 8A through 8F. In step 902, an intermediate stage golf club head main body is provided. Preferably, the intermediate main body may include a generally planar striking face that may or may not include finishing applications such as polishing, media blasting, surface milling, laser-etching, chemical etching, physical vapor deposition, anodizing, plating, painting, or any other known finishing application that may impart performance benefit.

In step 904, a plurality of recesses (e.g. recesses 824) are formed in the striking face of the intermediate club head. Preferably such formation is by way of a drill press either operated by hand or in conjunction with a computer numerical control (CNC) machine. However, punching, stamping, chemical or laser material removal process may alternatively be employed for this purposes.

Optionally, additional or first finishing processes are then conducted on the striking face 814 subsequent to step 904. For example, step 906 may include applying to the striking face any of: polishing, media blasting, surface milling, laser-etching, chemical etching, physical vapor deposition, anodizing, plating, painting, or any other known finishing application that may impart performance benefit. In this manner, any burrs or other aberrations formed in the generation of recesses 824 may be removed or minimized prior to introduction of the filler material, which may comprise a relatively soft material and thus sensitive to abrasives and chemicals commonly used in finishing applications.

In step 908, the recesses 824 are filled with filler material. Preferably, filler material in, say, the form of a polymeric material is poured in place and permitted to cure in situ. Alternatively, a plurality of preformed inserts may be placed in recesses 824. In such cases, chemical adhesives may further be introduced and/or mechanical means may be employed to secure such aft-attached insert to the striking face. Such mechanical means may include screws, clamps, magnets, interference fit components, or deformable components configured to deform in lockable orientation. In some aspects such inserts or filler material may be removable/interchangeable, whereby worn materials may be replaced, or inserts with different material characteristics (e.g. mass, density or durometer) may be interchanged between plural of recesses 824.

In step 910, grooves 816 are formed in the striking face 814 in such a manner as to intersect with recesses 824. Preferably, the grooves 816 are formed by milling, in which a milling cutter rotates about an axis perpendicular to the general plane of the striking face. However, in other aspects, the grooves 816 are formed by "spin milling" wherein the milling cutter rotates about an axis parallel to the general plane of the striking face 814.

In step 912, optionally, the grooves 816 and/or filler material 836 are masked, using solid mask (e.g. durable tape) and/or liquid mask, to protect such aspects against any subsequent finishing processes, e.g. those described below with regard to step 914.

Optionally, in step 914, further finishing processes are carried out. Such processes may include applications such as polishing, media blasting, surface milling, laser-etching, chemical etching, physical vapor deposition, anodizing, plating, painting, or any other known finishing application that may impart performance benefit. Such processes may serve to remove burrs or other aberrations formed from the milling of grooves 816.

It is contemplated that the above aspects and processes for their formation, described with regard to FIGS. 8A through 8G, may be applied to other types of golf clubs, e.g. driver-type, wood-type, hybrid-type, iron-type, or wedge-type for providing similar performance-related benefits. Variations may also be made without departing from the spirit or scope of this disclosure, e.g. variations for compliance with the Rules of one or more rule-promulgating bodies, e.g. the USGA. Processes described with regard to any manufacturing methods, e.g. those described in reference to FIG. 8G, unless otherwise indicated need not be carried temporally in the order in which they are described.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A golf club head comprising:

a toe portion;

a heel portion;

a sole portion;

a top portion;

a rear portion; and a striking face formed of a first material and including a plurality of primary grooves, each of the primary grooves having a groove bottom surface and being only partially filled with a second material such that the plurality of only partially filled primary grooves define a plurality of scorelines, each of the scorelines comprising:

a planar scoreline base surface comprising the second material, the planar scoreline base surface being spaced from the groove bottom surface by a distance between 0.009 inch and 0.025 inch;

sidewalls comprising the first material, the sidewalls extending forward from the scoreline base surface;

a depth D; and a distance d measured in the same direction as the depth D from the scoreline base surface of the scoreline to a junction where the first and second materials meet, the distance d being 30%-50% of depth D;

wherein the primary grooves have a first pitch P1 and a first cross-sectional area A1 such that A1/P1>0.0030 in., and the scorelines have a second pitch P2 and a second cross-sectional area A2 such that A2/P2<0.0030 in.

2. The golf club head of claim 1, wherein each of the primary grooves has a depth greater than 0.020 in. and a width less than 0.035 in.

3. The golf club head of claim 2, wherein the depth D is less than 0.020 in. and each of the scorelines has a width less than 0.035 in.

4. The golf club head of claim 1, wherein the second material is a Surlyn material or a thermoplastic polyurethane.

5. The golf club head of claim 1, wherein the sidewalls of the scorelines each comprise the first and second materials and the junction.

6. The golf club head of claim 5, wherein each of the junctions are substantially smooth.

7. The golf club head of claim 1, wherein the first material is harder than the second material.

8. The golf club head of claim 1, wherein the first material is metallic and the second material is one of a polymer, foam, rubber, or resin.

9. The golf club head of claim 1, wherein the second material contrasts in color from the first material.

* * * * *